US010660499B2

(12) United States Patent
Woo et al.

(10) Patent No.: US 10,660,499 B2
(45) Date of Patent: May 26, 2020

(54) DISHWASHER

(71) Applicant: LG ELECTRONICS INC., Seoul (KR)

(72) Inventors: Seyoung Woo, Seoul (KR); Taehee Lee, Seoul (KR); Kyuhyung Choi, Seoul (KR); Joonho Pyo, Seoul (KR)

(73) Assignee: LG Electronics Inc., Seoul (KR)

( * ) Notice: Subject to any disclaimer, the term of this patent is extended or adjusted under 35 U.S.C. 154(b) by 125 days.

(21) Appl. No.: 15/617,897

(22) Filed: Jun. 8, 2017

(65) Prior Publication Data

US 2017/0354312 A1 Dec. 14, 2017

(30) Foreign Application Priority Data

Jun. 10, 2016 (KR) ..... 10-2016-0072193

(51) Int. Cl.
*A47L 15/42* (2006.01)
*A47L 15/23* (2006.01)

(52) U.S. Cl.
CPC ..... *A47L 15/4282* (2013.01); *A47L 15/23* (2013.01)

(58) Field of Classification Search
CPC ..... A47L 15/22; A47L 15/23; A47L 15/4282
See application file for complete search history.

(56) References Cited

U.S. PATENT DOCUMENTS 4,175,575 A 11/1979 Cushing
5,415,350 A * 5/1995 Yoon ..... A47L 15/23 134/179
5,464,482 A 11/1995 Michael et al.
2011/0146734 A1 6/2011 Rappette
2014/0069462 A1* 3/2014 Becker ..... A47L 15/22 134/10
2016/0220090 A1* 8/2016 Woo ..... A47L 15/23
2016/0220092 A1* 8/2016 Woo ..... A47L 15/4282
2017/0020359 A1* 1/2017 Choi ..... A47L 15/20
(Continued)

FOREIGN PATENT DOCUMENTS

EP 2898810 A1 * 7/2015 ..... A47L 15/23
EP 3050480 8/2016
JP 08089467 4/1996
(Continued)

OTHER PUBLICATIONS

KR930006002—Machine Translation (Google Patents) (Year: 1993).*
(Continued)

*Primary Examiner* — Marc Lorenzi
(74) *Attorney, Agent, or Firm* — Fish & Richardson P.C.

(57) ABSTRACT

A dishwasher that includes: a washing tub that includes an interior space to accommodate objects; a main arm that is configured to rotate in the interior space and spray water to the objects; an auxiliary arm that is configured to rotate in the interior space and spray water to the objects; a stationary gear unit that is configured to rotate with the main arm, and that includes a plurality of gear teeth; an eccentric gear unit that is configured to rotate based on rotation of the main arm, the eccentric gear unit being in engagement with one or more teeth of the plurality of gear teeth; and a link member that is configured to (i) generate elastic force based on rotation of the eccentric gear unit and (ii) rotate the auxiliary arm based on elastic force is disclosed.

20 Claims, 43 Drawing Sheets

(56) References Cited

U.S. PATENT DOCUMENTS

2018/0271348 A1* 9/2018 Li ..... A47L 15/22

FOREIGN PATENT DOCUMENTS

| | | |
|---|---|---|
| JP | 3437241 | 6/2003 |
| KR | 930006002 B1 * | 7/1993 |
| KR | 10-2012-0134370 | 12/2012 |
| KR | 10-2014-0039747 | 4/2014 |
| WO | WO2016126086 | 8/2016 |

OTHER PUBLICATIONS

KR101821201—Machine Translation (Year: 2018).*
Extended European Search Report in European Application No. 17174948.4, dated Aug. 14, 2017, 9 pages (with English translation).
Australian Office Action in Australian Application No. 2017278898, dated Sep. 17, 2019, 3 pages.

* cited by examiner (a)

(b)

(a)

(b)

B' - B"

C' - C"

F' - F"

G' - G"

(a)

(b)

DISHWASHER

CROSS-REFERENCE TO RELATED APPLICATION

This application claims priority to Korean Patent Application No. 10-2016-0072193, filed on Jun. 10, 2016, whose entire content is hereby incorporated by reference.

TECHNICAL FIELD

The present application relates to technologies related to a dishwasher.

BACKGROUND

A dishwasher is a device that removes filth, such as food waste, from dishes or cooking tools (hereinafter, referred to as 'objects to be washed') using detergent and wash water.

A dishwasher generally includes a washing tub having therein a washing space, a rack provided in the washing tub for receiving objects to be washed, a spray arm for spraying wash water to the rack, a sump for storing wash water, and a supply channel for supplying the wash water stored in the sump to the spray arm.

In general, the dishwasher uniformly sprays wash water to objects to be washed, such as dishes, while rotating the spray arm for spraying the wash water to wash the objects. In recent years, there has been developed a dishwasher further including an auxiliary arm configured to roll along an arc track of a spray arm in order to spray wash water, in addition to the spray arm, which is configured to spray wash water during the rotation of the spray arm using rotational force generated when the spray arm is rotated.

Such a dishwasher is disclosed in Korean Patent Application Publication No. 10-2012-0126598, in which the dishwasher has a structure in which wash water is sprayed upward through a nozzle of a spray arm disposed in a washing tub.

In some implementations, when wash water is sprayed to objects to be washed, such as dishes, it is necessary to uniformly spray wash water to the surfaces of the dishes. Consequently, it is necessary to spray wash water at various angles. In a conventional dishwasher, a spray arm is rotated to rotate a spray nozzle. In order to achieve more efficient washing, however, it is necessary to vary the spray angle.

SUMMARY

This application describes technologies for a dishwasher.

In general, one innovative aspect of the subject matter described in this specification can be embodied in a dishwasher including: a washing tub that includes an interior space to accommodate objects; a main arm that is coupled to the washing tub, that extends in a first direction, and that is configured to rotate in the interior space and spray water to the objects; an auxiliary arm that is coupled to the main arm, that extends in a second direction, and that is configured to rotate in the interior space and spray water to the objects; a stationary gear unit that is coupled to the washing tub, that is configured to rotate with the main arm, and that includes a plurality of gear teeth; an eccentric gear unit that is coupled to the main arm and that is configured to rotate based on rotation of the main arm, the eccentric gear unit being in engagement with one or more teeth of the plurality of gear teeth of the stationary gear unit; and a link member that is supported by the main arm, that couples the eccentric gear unit to the auxiliary arm, and that is configured to (i) generate elastic force based on rotation of the eccentric gear unit and (ii) rotate the auxiliary arm based on elastic force.

The foregoing and other implementations can each optionally include one or more of the following features, alone or in combination. In particular, one implementation includes all the following features in combination. The link member includes: a rim-shaped body, a main link that couples the rim-shaped body to the main arm and that extends in the first direction, an auxiliary link that couples the rim-shaped body to the auxiliary arm and that extends in the second direction, wherein the second direction is different from the first direction, and an elastic shock-absorbing unit that is located between the rim-shaped body and the auxiliary link and that is configured to generate elastic force. The elastic shock-absorbing unit includes: at least one elastic shock-absorbing member that extends in the second direction. The auxiliary link includes a first end and a second end, the second end being coupled to the rim-shaped body, and wherein the elastic shock-absorbing unit includes: a first extension link that extends from the rim-shaped body toward the first end of the auxiliary link, a second extension link that extends from a portion of the auxiliary link toward the second end of the auxiliary link, and an elastic link that couples the first extension link to the second extension link. The elastic shock-absorbing unit further includes: a plurality of reinforcement parts, each of the plurality of reinforcement parts being (i) coupled to the first extension link, the second extension link, and the elastic link respectively and (ii) configured to protect a point of coupling. Each of the first extension link, the second extension link, and the elastic link has a bar shape and has a respective length. At least one of the first extension link, the second extension link, and the elastic link has a curved portion. The curved portion is elastic such that (i) the link member is configured to generate elastic force and (ii) rotate the auxiliary arm based on elastic force. At least one of the first extension link, the second extension link, and the elastic link has a bar shape and has a first width in a direction in which the auxiliary link moves. The first extension link, the second extension link, and the elastic link are arranged to establish a particular angle with each other. The link member includes an integrated body comprising a first material, and wherein the integrated body includes the rim-shaped body, the auxiliary link, and the elastic shock-absorbing unit. The main arm includes a guide protrusion, and wherein the main link includes a guide recess (i) into which the guide protrusion is inserted and (ii) that is configured to guide the link member. The link member is configured to move in the first direction along the guide protrusion. The eccentric gear unit includes an eccentric protrusion, and wherein the main link includes an eccentric protrusion insertion slot into which the eccentric protrusion is inserted, the eccentric protrusion insertion slot being configured to guide the link member. The link member is configured to move linearly between a first position and a second position in the first direction. The link member is configured to, based on rotation of the eccentric gear unit, move linearly between a first position and a second position. The auxiliary arm is configured to rotate based on linear movement of the link member. The main arm includes: a first spray port that is located at a first portion of the main arm and that is configured to spray water to the objects in a third direction, and a second spray port that is located at a second portion of the main arm and that is configured to spray water in a fourth direction that is different from the third direction. The auxiliary arm is configured to spray water to a first position in the interior space while the auxiliary arm rotates.

The auxiliary arm includes: a first spray port that is located at a first portion of the auxiliary arm and that is configured to spray water to the objects in a third direction, and a second spray port that is located at a second portion of the auxiliary arm and that is configured to spray water in a fourth direction that is different from the third direction.

The subject matter described in this specification can be implemented in particular implementation so as to realize one or more of the following advantages. Comparing to a conventional dishwasher, a dishwasher has a structure that increases a spray region of wash water sprayed through an spray arm so improves washing efficiency.

Furthermore, the dishwasher can include a spray arm that can be rotated using thrust force generated by spraying wash water without using an additional driving device.

Moreover, the dishwasher can include a spray arm including a main arm and auxiliary arms rotatably mounted to the main arm such that (i) an spray angle of the auxiliary arms can be adjustable based on the rotation of the main arm and (ii) the auxiliary arms can be rotated based on rotational force of the main arm, and (iii) the main arm is rotatable even when the auxiliary arms are not rotatable.

The details of one or more implementations of the subject matter of this specification are set forth in the accompanying drawings and the description below. Other features, aspects, and advantages of the subject matter will become apparent from the description, the drawings, and the claims.

DETAILED DESCRIPTION

Figure 1:
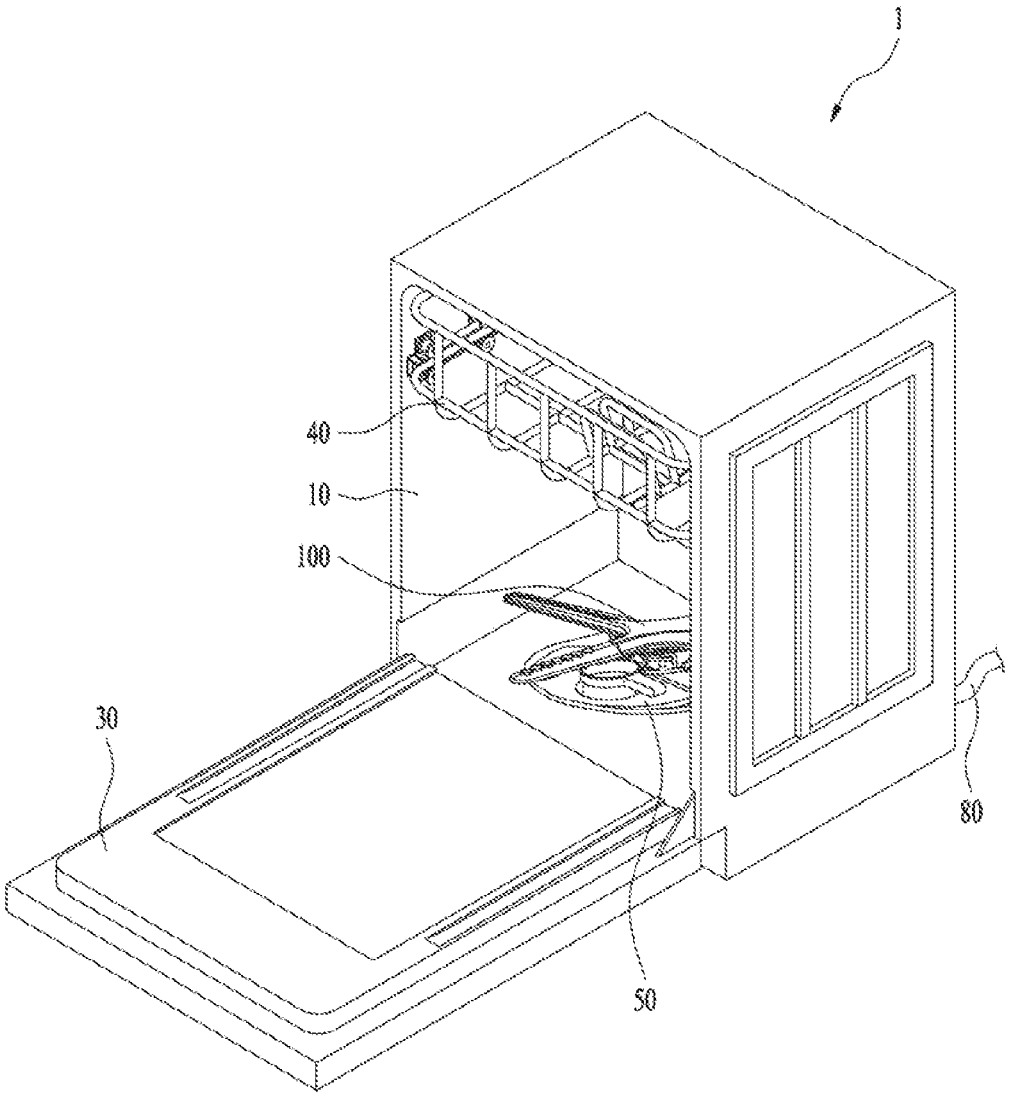
FIG. 1 is a diagram illustrating an example dishwasher.
Figure 2:
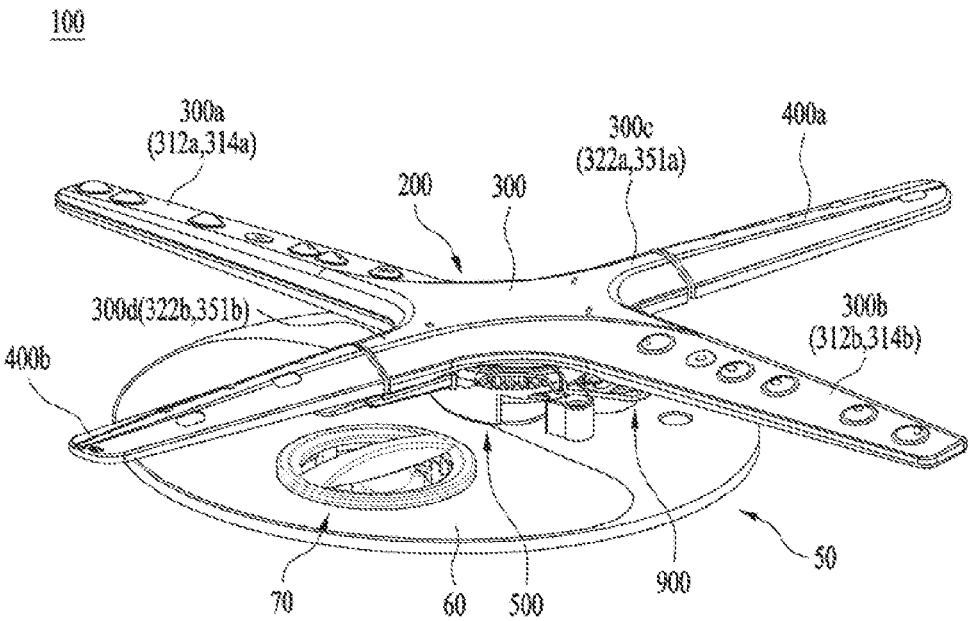
FIG. 2 is a diagram illustrating an example sump cover and an example spray arm assembly of a dishwasher.
Figure 3:
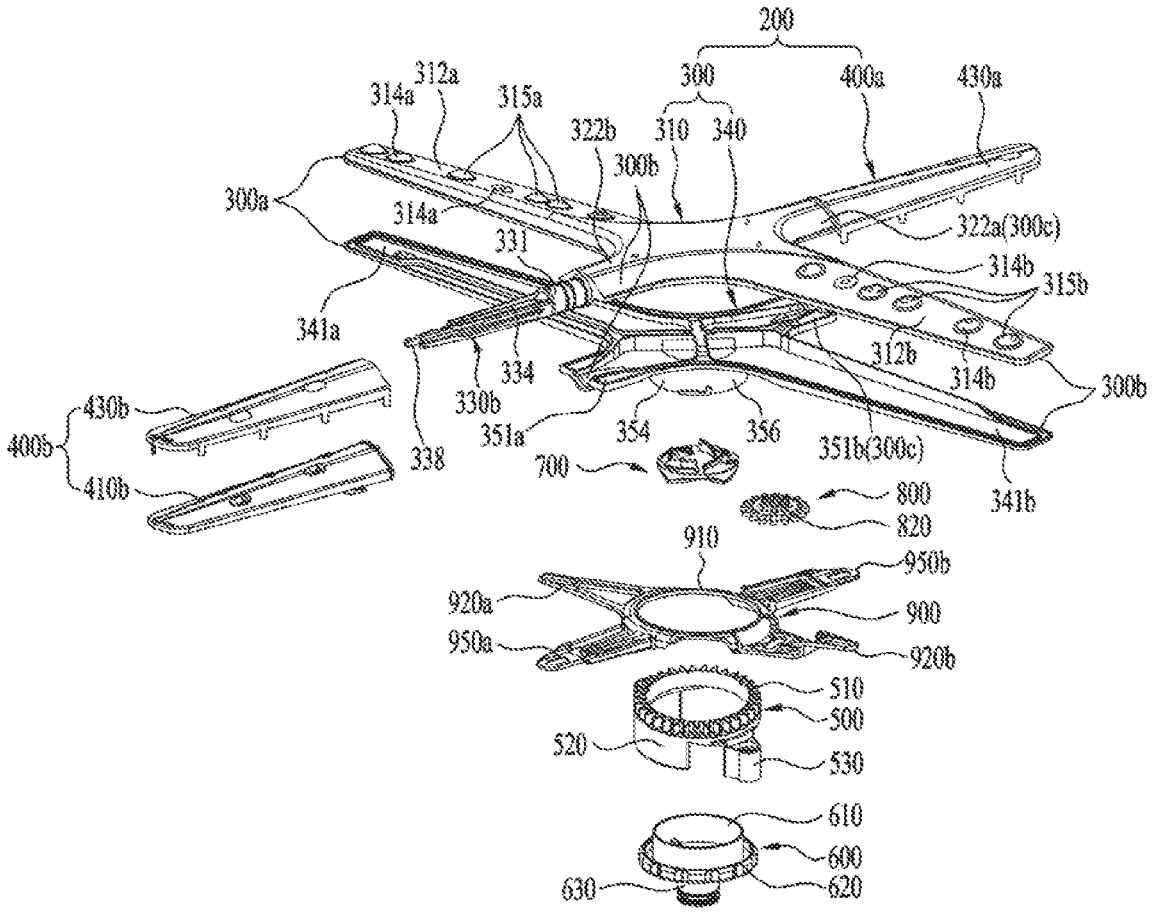
FIG. 3 is a diagram illustrating an example spray arm assembly of a dishwasher.

FIG. 1 illustrates an example dishwasher. FIG. 2 illustrates an example sump cover and an example spray arm assembly of a dishwasher. FIG. 3 illustrates an example spray arm assembly of a dishwasher.

As shown in FIGS. 1 and 2, a dishwasher 1 includes a washing tub 10 having a washing space defined therein, a door 30 for selectively opening and closing the washing space, a rack 40 provided in the washing tub 10 for receiving objects to be washed, a sump provided in the washing tub 10 for storing wash water, and a spray arm assembly 100 provided in the washing tub 10 for spraying wash water to the objects received in the rack 40.

The rack 40 may be mounted so as to be capable of being pulled to the front of the washing tub 10. The rack 40 may include an upper rack located in the upper part of the washing tub 10 and a lower rack located in the lower part of the washing tub 10. A user may pull the rack 40 to the front of the washing tub 10 in order to put objects to be washed in the rack 40 or to remove the objects from the rack 40.

The sump may include a sump cover 50 and a filter 70 and a filter cover 60 provided in the sump cover 50 for filtering foreign matter from wash water that has been used to wash the objects. The sump may receive wash water from the outside through a water supply pipe 80, and wash water sprayed into the washing tub 10 may be drained through an additional drainage unit. In addition, although not shown, a water supply pump for supplying wash water stored in the sump to the spray arm assembly 100 may be provided in the sump.

In some implementations, foreign matter, such as food waste, contained in the wash water sprayed into the washing tub 10 is filtered by the filter 70 and the filter cover 60, provided in the sump cover 50. The wash water collected into the sump through the filter 70 and the filter cover 60 may be supplied to the spray arm assembly 100 through the water supply pump provided in the sump. That is, the wash water supplied through the water supply pipe 80 may be used several times.

The filter cover 60 defines a portion of the sump cover 50. The filter cover 60 may be formed in front of the lower part of the washing tub 10 (i.e. at the lower part of the washing tub 10 adjacent to the door 30). The filter 70 is inserted into the middle part of the filter cover 60. The filter cover 60 may be configured to be separated from the sump cover 50 together with the filter 70 when the filter 70 is separated from the sump cover 50.

In some implementations, the filter cover 60 is provided in the middle part thereof with a spray arm holder location unit 53, into which the spray arm assembly 100 is rotatably inserted and into which wash water is supplied. The spray arm holder location unit 53 is provided in the middle part thereof with a water supply port 59 for supplying wash water. The spray arm holder location unit 53 is provided at opposite sides thereof with a pair of protruding coupling bosses 51 for fixing a stationary gear unit 500 of the spray arm assembly 100, a description of which will follow.

In addition, the spray arm holder location unit 53 is provided at the upper side thereof with a protruding support boss 55 for supporting a spray arm holder 600 located in the spray arm holder location unit 53. The support boss 55 may extend to a predetermined height so as to prevent wash water or foreign matter introduced into the sump cover 50 from being introduced into the spray arm holder location unit 53.

In some implementations, the spray arm holder location unit 53 is provided in the middle part thereof with a water supply port 59 for supplying wash water. The water supply port 59 is provided on the inner circumferential surface of the end thereof with a location rib 57 extending upward toward the spray arm holder 600 so as to correspond to the shape of the end of the spray arm holder 600 inserted into the spray arm holder location unit 53.

The location rib 57 is formed in a shape surrounding an extension part 636 formed at the spray arm holder 600 from the lower side thereof so as to minimize the leakage of water between the spray arm holder 600 and the spray arm holder location unit 53. The spray arm holder location unit 53 will be described in more detail when describing the spray arm holder 600.

As shown in FIG. 3, the spray arm assembly 100 is mounted at the sump cover 50 to spray the wash water stored in the sump to the objects received in the rack. In some implementations, the dishwasher 1 may further include an upper spray arm located between the upper rack and the lower rack and a top spray arm located above the upper rack, in addition to the spray arm assembly 100.

In some implementations, the spray arm assembly 100 may include a spray arm 200 including a main arm 300 for spraying wash water and auxiliary arms 400*a* and 400*b* rotatably coupled to the main arm 300, a spray arm holder 600 coupled to the lower part of the spray arm 200 for receiving wash water from the sump cover 50 and rotatably supporting the spray arm 200, a stationary gear unit 500 fixed to the sump cover 50 for preventing the separation of the spray arm holder 600, an eccentric gear unit 800 rotatably coupled to the spray arm 200 and engaged with the stationary gear unit 500 so as to rotate and revolve along the outer circumferential surface of the stationary gear unit 500 as the spray arm 200 is rotated, and a link member 900 reciprocably coupled to the spray arm 200 and configured to be reciprocated as the eccentric gear unit 800 is rotated for transferring rotational force to the auxiliary arms 400*a* and 400*b*.

Unlike what is shown, the spray arm assembly 100 may also be provided above the rack 40 as well as under the rack 40. In addition, a plurality of spray arm assemblies 100 may be provided to spray wash water to the upper part and the lower part of the rack 40.

The spray arm 200 may include a main arm 300 formed by the coupling between a main arm upper housing 310 and a main arm lower housing 340 and one or more auxiliary arms 400*a* and 400*b* rotatably connected to the main arm upper housing 310 of the main arm 300.

In some implementations, the main arm 300 may include first and second main arms 300*a* and 300*b* extending in opposite directions based on the center of rotation of the spray arm assembly 100. The auxiliary arms 400*a* and 400*b* may include first and second auxiliary arms 400*a* and 400*b* coupled between the first and second main arms 300*a* and 300*b* based on the center of rotation of the spray arm assembly 100 so as to be spaced apart from the first and second main arms 300*a* and 300*b* by a predetermined angle.

In some implementations, the first and second main arms 300*a* and 300*b* may be provided in the upper sides thereof with a plurality of spray ports 314*a*, 315*a*, 314*b*, 315*b*, and 317*b*, through which wash water introduced into the main arm 300 is sprayed. Wash water introduced into the main arm 300 from the sump may be sprayed upward from the main arm 300 in a direction opposite the direction in which the main arm 300 is rotated through the spray ports 314*a*, 315*a*, 314*b*, 315*b*, and 317*b*.

Consequently, the main arm 300 may have thrust force, by which the objects received in the rack 40 are washed using wash water sprayed through the spray ports 314*a*, 315*a*, 314*b*, 315*b*, and 317*b* and by which the main arm 300 is rotated.

The main arm lower housing 340 of the main arm 300 defines the lower surface of the main arm 300. A spray arm holder coupling part 356, in which at least a portion of the spray arm holder 600 is received, protrudes from the main arm lower housing 340. Wash water is supplied to the first and second main arms 300*a* and 300*b* and the first and second auxiliary arms 400*a* and 400*b* through the spray arm holder coupling part 356.

In some implementations, the main arm 30 may include a first extension unit 300*c* and a second extension unit 300*d* extending in the radial direction based on the spray arm holder coupling part 356. The first extension unit 300*c* and the second extension unit 300*d* may be provided with first and second auxiliary arm connection units 330*a* and 330*b*, at which the auxiliary arms 400*a* and 400*b* are rotatably mounted, respectively.

The first and second main arms 300*a* and 300*b* and the first and second extension units 300*c* and 300*d* may be provided therein with first and second main channels 301*a* and 301*b*, along which wash water introduced through the arm holder is guided to the first and second main arms 300*a* and 300*b*, and first and second auxiliary channels 301*c* and 301*d*, along which the wash water is guided to the first and second extension units 300*c* and 300*d*.

The first and second auxiliary arms 400*a* and 400*b* may be rotated in a reciprocating fashion within a predetermined angular range by the link member 900, which is interlocked with the rotation of the main arm 300, when the main arm 300 is rotated by thrust force generated by wash water sprayed from the first and second main arms 300*a* and 300*b*. The first and second auxiliary arms 400*a* and 400*b* may also be provided with a plurality of spray ports 414*a*, 415*a*, 414*b*, 415*b*, 422*a*, and 422*b*, through which wash water introduced into the main arm 300 is sprayed.

In some implementations, the auxiliary arms 400*a* and 400*b* may include a first auxiliary arm 400*a* rotatably connected to the first extension unit 300*c* and a second auxiliary arm 400*b* rotatably connected to the second extension unit 300*d*. Some of the wash water introduced into the main arm 300 may move to the first and second auxiliary channels 301*c* and 301*d* formed in the first and second auxiliary arms 400*a* and 400*b* (see FIG. 14). In some implementations, an additional decoration panel 430*a* for covering the upper surface of the spray arm 200 may be attached to the upper surface of the spray arm 200.

The spray arm 200 may be rotated by an additional driving device. However, the spray arm 200 may be rotated by thrust force of wash water sprayed through the spray ports 314*a*, 315*a*, 314*b*, 315*b*, and 317*b* formed in the first and second main arms 300*a* and 300*b* or the spray ports 414*a*, 415*a*, 414*b*, 415*b*, 422*a*, and 422*b* formed in the first and second auxiliary arms 400*a* and 400*b*.

That is, the spray arm 200 may be rotated by the thrust force generated by spraying wash water without using an additional driving device, such as a motor. The rotation of the spray arm 200 by spraying wash water will be described below.

The spray arm holder 600 may be coupled to the lower part of the spray arm 200 so as to be fixed to the spray arm 200. Consequently, the spray arm holder 600 may be rotated together with the spray arm 200. In addition, the spray arm holder 600 may serve as the rotational axis of the spray arm 200.

The spray arm holder 600 includes a main arm insertion unit 610 inserted and coupled into the spray arm holder coupling part 356, formed in the main arm 300, a separation prevention unit 620 protruding from the lower part of the main arm insertion unit 610 for preventing separation of the stationary gear unit 500, and a sump insertion unit 630 rotatably inserted into the spray arm holder location unit 53 of the sump cover 50.

The spray arm holder 600 may be inserted into the spray arm holder location unit 53 of the sump cover 50 in the state of being coupled to the spray arm 200 so as to be rotatably supported. In addition, wash water supplied from the sump may be introduced into the spray arm holder 600 through the water supply port 59 of the spray arm holder location unit 53, and the wash water introduced into the spray arm holder 600 may be supplied to the first and second main channels 301*a* and 301*b* or the first and second auxiliary channels 301*c* and 301*d* through the channel-switching unit 700.

The channel-switching unit 700 may serve to divert the flow of the wash water received in the spray arm holder 600 and supplied from the spray arm holder 600 to the spray arm 200 to the first and second main channels 301*a* and 301*b* or to the first and second auxiliary channels 301*c* and 301*d*.

In some implementations, the channel-switching unit 700 may be inserted into the spray arm holder coupling part 356 of the main arm 300, and may move upward and downward in the spray arm holder coupling part 356 in response to the supply of wash water and interruption of the supply of wash water so as to divert the flow of wash water.

The channel-switching unit 700 includes a rotary plate 710 having a plurality of open holes 722*a* and 722*b*, a plurality of upper inclined protrusions 720*a*, 720*b*, 720*c*, and 720*d* for rotating the rotary plate 710 by a predetermined angle when the channel-switching unit 700 moves upward in response to the supply of wash water, and a plurality of lower inclined protrusions 730*a*, 730*b*, 730*c*, and 730*d* for rotating the rotary plate 710 by a predetermined angle when the channel-switching unit 700 moves downward in response to the interruption of the supply of wash water.

The stationary gear unit 500 may be fixed to the sump cover 50 to prevent the separation of the spray arm holder 600 coupled to the spray arm 200 and to limit the movement of the spray arm holder 600 such that the spray arm 200 can be rotated.

The stationary gear unit 500 includes a rim part 510, through which the spray arm holder coupling part 356 formed in the main arm 300 rotatably extends, a gear being formed on the outer circumferential surface of the rim part 510, and fastening parts 530 extending from opposite sides of the rim part 510 so as to be coupled to the coupling bosses 51 of the sump cover 50.

In some implementations, the spray arm holder 600 is coupled to the spray arm holder coupling part 356 in the state in which the spray arm holder coupling part 356 is inserted into the stationary gear unit 500. Subsequently, the stationary gear unit 500 may be fixed to the coupling bosses 51 of the sump cover 50 using additional fastening members (e.g. screws).

Consequently, the stationary gear unit 500 prevents the spray arm holder 600 from being separated from the spray arm holder location unit 53 in the state in which the stationary gear unit 500 is fixed to the sump cover 50, thereby rotatably supporting the spray arm 200 while preventing the separation of the spray arm 200.

The eccentric gear unit 800 may be rotatably mounted at the lower surface of the spray arm 200 in the state of being engaged with the stationary gear unit 500. As the spray arm 200 is rotated, the eccentric gear unit 800 may revolve along the circumference of the stationary gear unit 500, which is fixed to the sump cover 50, and at the same time may rotate in the state of being engaged with the stationary gear unit 500.

The eccentric gear unit 800 includes a rim part 810 provided at the outer circumferential surface thereof with a gear engaged with the gear of the stationary gear unit 500, a shaft support protrusion 820 rotatably coupled to a shaft of the main arm 300, and an eccentric protrusion 830 spaced apart from the center of rotation of the shaft support protrusion 820 for converting rotational force into linear reciprocation movement and transferring the linear reciprocation to the link member 900.

The link member 900 may be movably mounted at the lower part of the spray arm 200, and may be rotated together with the spray arm 200. The link member 900 may rotate the auxiliary arms 400*a* and 400*b* in a reciprocating fashion in the longitudinal direction as the eccentric gear unit 800 rotates according to the rotation of the spray arm.

The link member 900 includes a rim-shaped body 910 having a rectangular through hole so as to be linearly movable with respect to the spray arm holder coupling part 356 of the main arm by a predetermined distance, first and second main links 920*a* and 920*b* extending from the rim-shaped body 910 so as to be linearly movably coupled with respect to the first and second main arms 300*a* and 300*b*, and first and second auxiliary links 950*a* and 950*b* extending from the rim-shaped body 910 so as to be spaced apart from the first and second main links 920*a* and 920*b* by a predetermined angle and coupled to the first and second auxiliary arms 400*a* and 400*b* for rotating the first and second auxiliary arms 400*a* and 400*b* in a reciprocating fashion according to the movement of the rim-shaped body 910. The second main link 920*b* is provided with an eccentric gear receiving part 940, which supports the eccentric gear unit 800 and into which the eccentric protrusion 830 of the eccentric gear unit 800 is inserted.

The process of fastening the above components constituting the spray arm assembly 100 will be described in brief with reference to FIGS. 3 and 4.

Figure 4:
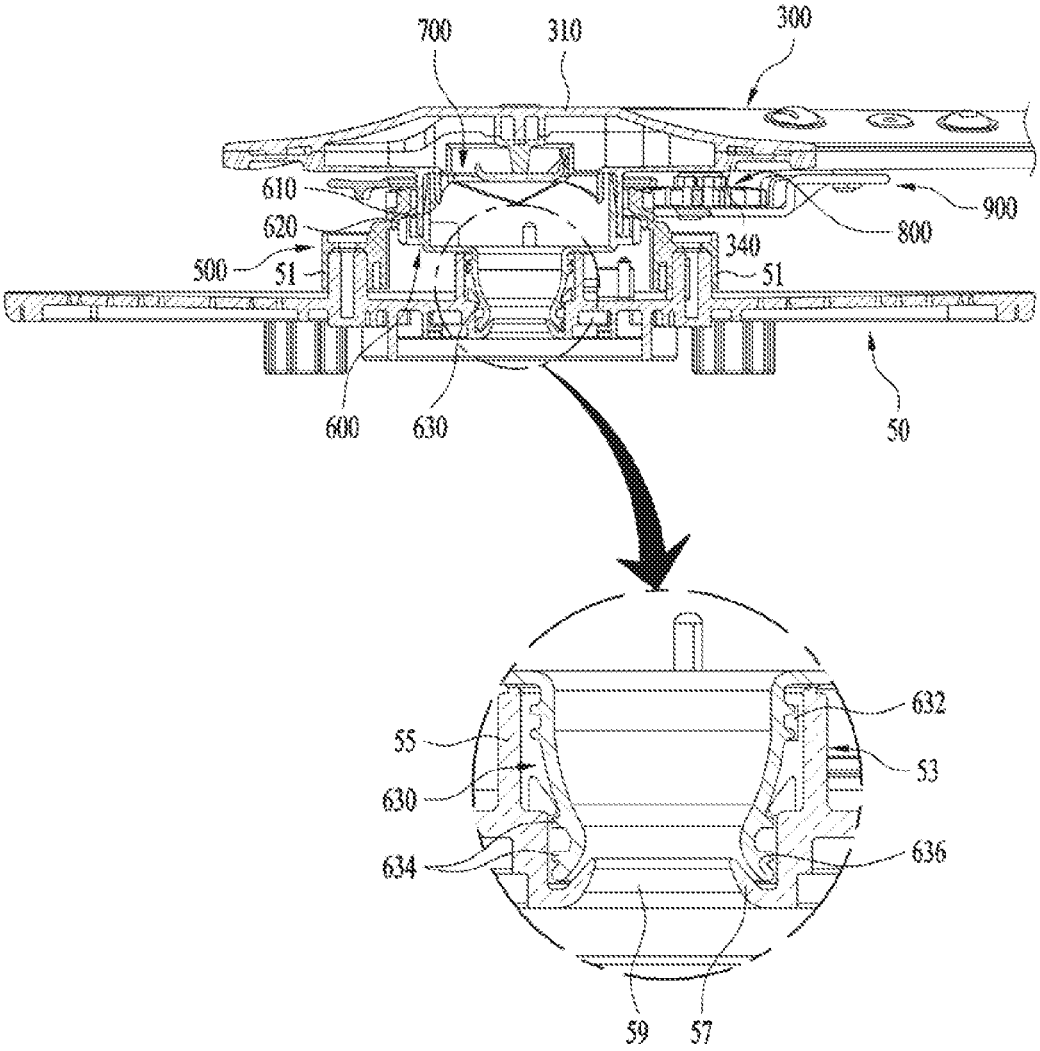
FIG. 4 is a diagram illustrating an example sump cover and an example spray arm assembly of a dishwasher.

FIG. 4 illustrates an example sump cover and an example spray arm assembly of a dishwasher.

First, the first and second auxiliary arms 400*a* and 400*b* are rotatably inserted into the first and second auxiliary arm connection units 330*a* and 330*b* of the main arm 300, and the spray arm holder coupling part 356, formed at the lower part of the spray arm 200, is inserted into the rim-shaped body 910 of the link member 900.

The first and second main links 920*a* and 920*b* of the link member 900 may be coupled to the first and second main arms 300*a* and 300*b* of the main arm 300 so as to be capable of being linearly reciprocated. The first and second auxiliary links 950*a* and 950*b* of the link member 900 may be coupled to the first and second auxiliary arms 400*a* and 400*b* so as to rotate the first and second auxiliary arms 400*a* and 400*b* according to the reciprocation of the link member 900.

In some implementations, the eccentric protrusion 830 is supported in the state of being inserted into the eccentric gear receiving part 940, formed in the second main link 920*b*, whereby the eccentric gear unit 800 is rotatably provided at the lower part of the main arm 300.

Subsequently, the stationary gear unit 500 may be rotatably inserted and coupled into the spray arm holder coupling part 356 formed at the lower part of the spray arm 200. The eccentric gear unit 800, supported by the eccentric gear receiving part 940 of the second main link 920*b*, is engaged with the gear formed on the stationary gear unit 500 such that the eccentric gear unit 800 can rotate and revolve along the outer circumferential surface of the stationary gear unit 500 as the main arm 300 is rotated.

In some implementations, the channel-switching unit 700 is inserted into the spray arm holder coupling part 356. The channel-switching unit 700 may be received in the main arm insertion unit 610, provided in the spray arm holder 600.

When wash water is introduced into the main arm insertion unit 610, the channel-switching unit 700 moves upward due to the pressure of the wash water. When the introduction of wash water is interrupted, the water pressure in the main arm insertion unit 610 is reduced, whereby the channel-switching unit 700 moves downward.

The spray arm holder 600 is fastened to the lower part of the spray arm holder coupling part 356. Consequently, the stationary gear unit 500 may be prevented from being separated from the spray arm holder coupling part 356 by the spray arm holder 600.

Subsequently, the stationary gear unit 500 is inserted into the sump insertion unit 630 formed at the lower part of the spray arm holder 600, the fastening parts 530 of the stationary gear unit 500 are coupled to the coupling bosses 51 of the sump cover 50, and the stationary gear unit 500 is fixed to the sump cover 50 using additional fastening members.

That is, the stationary gear unit 500 is rotatably coupled to the spray arm holder coupling part 356 of the spray arm 200, and then the spray arm holder 600 is coupled and fixed to the spray arm 200 at the lower side of the stationary gear unit 500. Subsequently, the spray arm holder 600 is rotatably located in the spray arm holder location unit 53 of the sump cover 50, and then the stationary gear unit 500 is fixed to the sump cover 50.

Consequently, only the stationary gear unit 500 of the spray arm assembly 100 is fixed to the sump cover 50, and the spray arm 200, the spray arm holder 600, and the link member 900 of the spray arm assembly 100 are rotatably provided with respect to the sump cover 50. At this time, upward movement of the spray arm holder 600 is limited by the stationary gear unit 500, whereby the spray arm holder 600 is prevented from being separated from the spray arm holder location unit 53.

Wash water introduced through the water supply pipe 80 is moved to the sump by the water supply pump and is introduced into the spray arm assembly 100 through the water supply port 59 formed in the spray arm holder location unit 53 of the sump cover 50. The wash water introduced into the spray arm assembly 100 may be sprayed to objects to be washed through the first and second main arms 300*a* and 300*b* or the first and second auxiliary arms 400*a* and 400*b* of the spray arm 200.

The spray arm 200 may be rotated in a direction opposite to the direction in which the wash water is sprayed by the thrust force of the wash water sprayed through the first and second main arms 300*a* and 300*b* or the first and second auxiliary arms 400*a* and 400*b*.

The supply of wash water to the first and second main arms 300*a* and 300*b* or the first and second auxiliary arms 400*a* and 400*b* may be switched by the operation of the channel-switching unit 700 based on the supply of wash water and interruption of the supply of wash water through the water supply pump.

In some implementations, as the spray arm 200 is rotated, the eccentric gear unit 800, provided at the lower part of the main arm 300, rotates while revolving along the outer circumferential surface of the stationary gear unit 500. That is, the stationary gear unit 500 is fixed to the sump cover 50, with the result that the stationary gear unit 500 remains stationary despite the rotation of the spray arm 200. The eccentric gear unit 800 is engaged with the stationary gear unit 500 in the state of being rotatably coupled to the main arm 300, with the result that the eccentric gear unit 800 may rotate and revolve along the outer circumferential surface of the stationary gear unit 500 as the main arm 300 is rotated.

In some implementations, the eccentric protrusion 830 of the eccentric gear unit 800 is inserted into the second main link 920*b* of the link member 900. According to the rotation of the eccentric gear unit 800, the eccentric protrusion 830 performs a circular motion while being spaced apart from the center of rotation of the eccentric gear unit 800 by a predetermined distance. Consequently, the link member 900, into which the eccentric protrusion 830 is inserted, is linearly reciprocated at the lower part of the main arm 300 by the rotation of the eccentric protrusion 830.

The first and second auxiliary arms 400*a* and 400*b* are connected to the first and second auxiliary links 950*a* and 950*b* of the link member 900. According to the reciprocation of the link member 900, the first and second auxiliary arms 400*a* and 400*b*, connected to the first and second auxiliary links 950*a* and 950*b*, are rotated in a reciprocating fashion to change the spray angle of the wash water sprayed through the first and second auxiliary arms 400*a* and 400*b*.

The main arm 300, which is one of the principal components of the spray arm assembly 100, will be described in detail with reference to the accompanying drawings.

Figure 5:
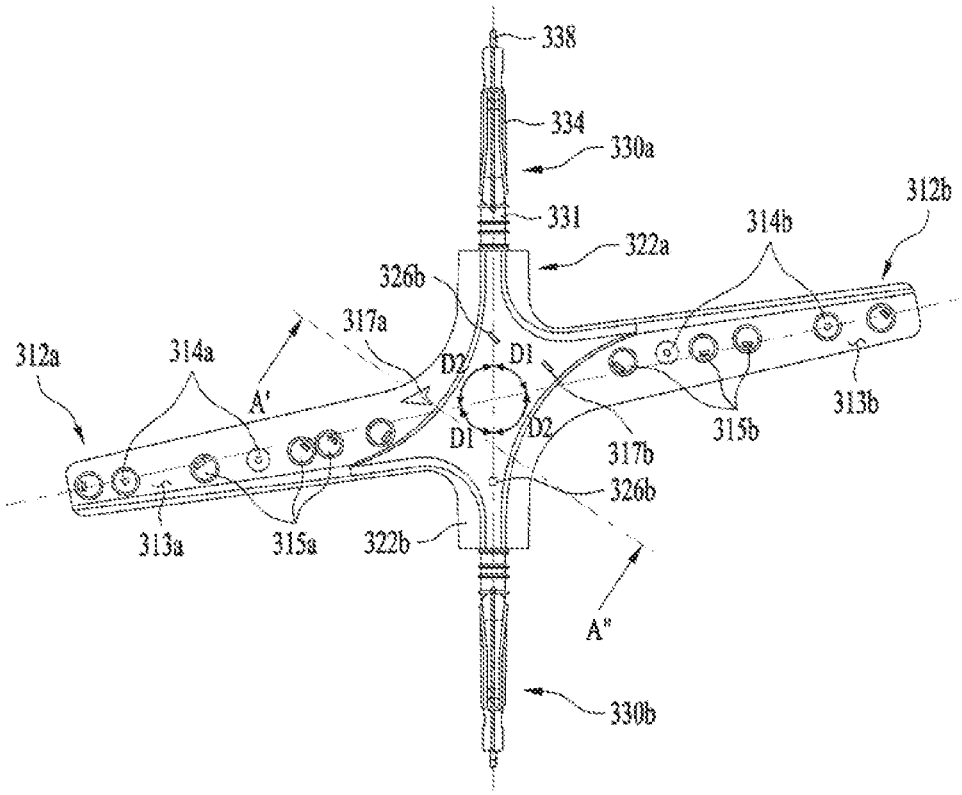
FIGS. 5 and 6 are diagrams illustrating an example main arm of a dishwasher.

FIG. 5 illustrates an example main arm of a dishwasher.

As shown in FIG. 5, the main arm 300 may include asymmetric first and second main arms 300*a* and 300*b* extending in opposite directions and first and second extension units 300*c* and 300*d* extending between the first and second main arms 300*a* and 300*b* so as to be inclined with respect to the first and second main arms 300*a* and 300*b* by a predetermined angle. First and second auxiliary arm connection units 330*a* and 330*b*, to which first and second auxiliary arms 400*a* and 400*b* are rotatably fastened, may be formed at the ends of the first and second extension units 300*c* and 300*d*.

In some implementations, a channel, along which wash water flows, is defined in the main arm 300. The channel may be defined by a main arm upper housing 310, which forms the upper part of the main arm 300, and a main arm lower housing 340.

The main arm upper housing 310 is provided with first and second upper main arms 312*a* and 312*b*, which form the upper parts of the first and second main arms 300*a* and 300*b*, and first and second upper extension units 322*a* and 322*b*, which form the upper parts of the first and second extension units 300*c* and 300*d*.

The main arm lower housing 340 is provided with first and second lower main arms 341*a* and 341*b*, which form the lower parts of the first and second main arms 300*a* and 300*b*, and first and second lower extension units 351*a* and 351*b*, which form the lower parts of the first and second extension units 300*c* and 300*d*. The first and second auxiliary arm connection units 330*a* and 330*b* may be integrally formed at the ends of the first and second upper main arms 312*a* and 312*b*.

The first main arm 300*a* (or the second main arm 300*b*) and the first extension unit 300*c* (or the second extension unit 300*d*) may form an obtuse angle D2, and the first main arm 300*a* (or the second main arm 300*b*) and the second extension unit 300*d* (or the first extension unit 300*c*) may form an acute angle D1.

That is, the center line passing through the centers of the first and second main arms 300*a* and 300*b* and the center line passing through the centers of the first and second extension units 300*c* and 300*d* may be inclined from the center of rotation of the main arm 300 by a predetermined angle.

The obtuse angle is formed between the first and second main arms 300*a* and 300*b* and the first and second extension units 300*c* and 300*d* in order to provide a space for mounting and removal of the filter 70 and the filter cover 60, located at the lower part of the spray arm 200.

In the case in which the space for mounting and removal of the filter 70 and the filter cover 60 is provided without consideration of the angle between the first and second main arms 300*a* and 300*b* and the first and second extension units 300*c* and 300*d*, however, the angle between the first and second main arms 300*a* and 300*b* and the first and second extension units 300*c* and 300*d* may be changed.

Alternatively, the angle between the first and second main arms 300*a* and 300*b* and the first and second extension units 300*c* and 300*d* may be a right angle, which is made possible by changing the design of the main arm. However, the angle between the first and second main arms 300*a* and 300*b* and the first and second extension units 300*c* and 300*d* is not limited thereto.

In addition, the first and second main arms 300*a* and 300*b* may be formed asymmetrically with respect to the first and second extension units 300*c* and 300*d*. However, the positional relationship between the first and second main arms 300*a* and 300*b* is not limited. Alternatively, the first and second main arms 300*a* and 300*b* may be formed symmetrically with respect to the first and second extension units 300*c* and 300*d*.

A channel, along which wash water flows, may be formed in the main arm 300 by the coupling between the main arm upper housing 310 and the main arm lower housing 340.

Figure 6:
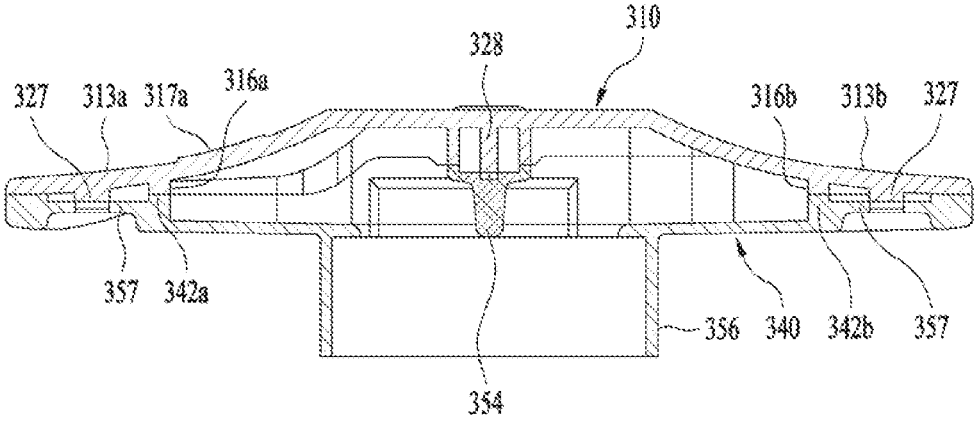

FIG. 6 illustrates an example main arm of a dishwasher.

As shown in FIG. 6, the main arm 300 is formed by the coupling between the main arm upper housing 310 and the main arm lower housing 340. The main arm upper housing 310 and the main arm lower housing 340 may be integrated by thermal/ultrasonic fusion.

The main arm upper housing 310 is provided at the lower surface thereof with a protruding fusion rib 327, which defines the first and second main channels 301*a* and 301*b* of the first and second main arms 300*a* and 300*b* and the first and second auxiliary channels 301*c* and 301*d* of the first and second extension units 300*c* and 300*d* and which is fused to the main arm lower housing 340.

The main arm lower housing 340 is provided at the upper surface thereof with a fusion step 357, which has a shape corresponding to the shape of the fusion rib 327 and to which the fusion rib 327 is fused, formed along the outer circumferential surfaces of the first and second main channels 301*a* and 301*b* of the first and second main arms 300*a* and 300*b* and the first and second auxiliary channels 301*c* and 301*d* of the first and second extension units 300*c* and 300*d*. The fusion rib 327 and the fusion step 357 will be described in detail when describing the main arm upper housing 310 and the main arm lower housing 340.

The shape of the upper surface of the main arm upper housing 310 will be described with reference to FIG. 5.

As shown in FIG. 5, the upper surface of the first upper main arm 312*a* of the main arm upper housing 310 may be provided with a first inclined surface 313*a*, which is inclined downward in a direction opposite the direction in which the spray arm 200 is rotated, and the upper surface of the second upper main arm 312*b* may be provided with a second inclined surface 313*b*, which is inclined downward in a direction opposite the direction in which the spray arm 200 is rotated.

The first and second inclined surfaces 313*a* and 313*b* may be curved so as to be inclined toward the first and second upper extension units 322*a* and 322*b*. The first and second inclined surfaces 313*a* and 313*b* may be formed to increase a range in which the spray angle of spray ports 314*a*, 315*a*, 314*b*, and 315*b* formed in the first upper main arm 312*a* and the second upper main arm 312*b* is formed.

In some implementations, the first inclined surface 313*a* may be provided with a first spray port 314*a* for spraying wash water in the direction perpendicular to the spray arm 200 and a first inclined spray port 315*a* formed so as to be inclined in a direction opposite to the direction in which the spray arm 200 is rotated for generating thrust force necessary to rotate the spray arm 200.

In addition, the second inclined surface 313*b* may be provided with a second spray port 314*b* for spraying wash water in the direction perpendicular to the spray arm 200 and a second inclined spray port 315*b* formed so as to be inclined in a direction opposite the direction in which the spray arm 200 is rotated for generating thrust force necessary to rotate the spray arm 200.

The first and second spray ports 314*a* and 314*b* and the first and second inclined spray ports 315*a* and 315*b* may be formed so as to have different radii with respect to the center of rotation of the main arm upper housing 310 or with respect to different spray regions.

The dishwasher can include any suitable number of first and second spray ports 314*a* and 314*b* and first and second inclined spray ports 315*a* and 315*b*. Furthermore, the positions at which the spray ports are formed and the direction in which wash water is sprayed through the spray ports can be changed.

In addition, the first and second inclined spray ports 315*a* and 315*b* may have various spray angles to secure the washing region. The sum of thrust forces generated by the wash water sprayed through the first and second inclined spray ports 315*a* and 315*b* may be equal to or greater than the minimum thrust force necessary to rotate the spray arm 200.

Furthermore, the first upper main arm 312*a* may be further provided at the surface thereof with a specific figure- or letter-type upper indication part 317*a* for enabling the direction in which the main arm upper housing 310 is fused to be checked when the main arm upper housing 310 and the main arm lower housing 340 are fused.

In addition, an additional center spray port 317*b* for spraying wash water toward the center of rotation of the main arm 300 may be further formed in a portion of the first upper main arm 312*a* or the second upper main arm 312*b* that is adjacent to the center of rotation thereof.

Since the spray ports 314*a*, 315*a*, 314*b*, and 315*b* are uniformly distributed in the first and second upper main arms 312*a* and 312*b*, the center spray port 317*b* may be formed in only one of the first and second upper main arms 312*a* and 312*b*.

The first and second upper extension units 322*a* and 322*b* include first and second auxiliary arm connection units 330*a* and 330*b* for rotatably supporting the first and second auxiliary arms 400*a* and 400*b*. First and second discharge ports 324*a* and 324*b* (see FIG. 7) for communication with the first and second auxiliary arm connection units 330*a* and 330*b* are formed in the first and second upper extension units 322*a* and 322*b*.

In some implementations, additional first and second center spray ports 326*a* and 326*b* for spraying wash water toward the center of rotation of the main arm 300 may be further formed in portions of the first and second upper extension units 322*a* and 322*b* that are adjacent to the centers of rotation thereof.

Since the spray ports 414*a*, 415*a*, 414*b*, 415*b*, 422*a*, and 422*b* (see FIG. 12) are formed in only the first and second auxiliary arms 400*a* and 400*b*, a relatively small amount of wash water may be sprayed toward the centers of the first and second upper extension units 322*a* and 322*b*. For this reason, additional first and second center spray ports 326*a* and 326*b* may be further formed in the first and second upper extension units 322*a* and 322*b*.

In addition, the first and second center spray ports 326*a* and 326*b* may be formed to have various radii with respect to the center of rotation of the main arm 300, and the shape of the first and second center spray ports 326*a* and 326*b* may be changed to have different washing efficiencies. For example, the first center spray port 326*a* may be formed in a slot shape, and the second center spray port 326*b* may be formed in a circular shape.

Figure 7:
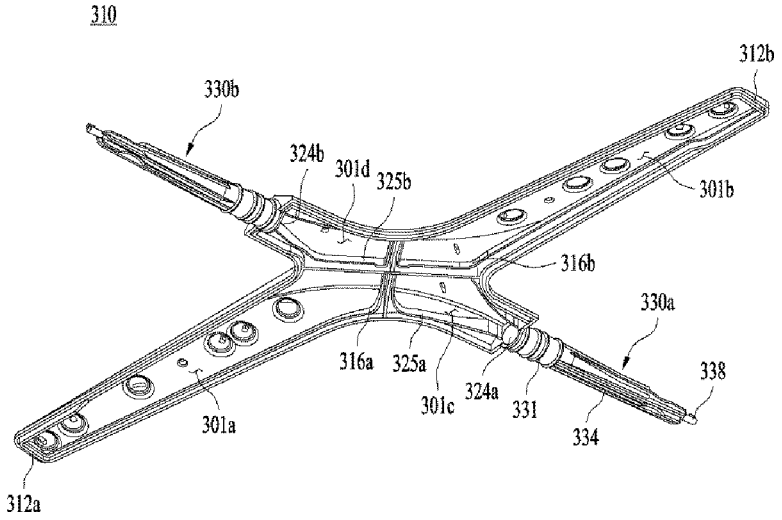
FIG. 7 is a diagram illustrating an example upper housing of a main arm of a dishwasher.

FIG. 7 illustrates an example upper housing of a main arm of a dishwasher.

As shown in FIG. 7, the main arm upper housing 310 is provided on the lower surface thereof with a fusion rib 327 for fusion with the main arm lower housing 340. The fusion rib 327 extends to partition the first and second upper main arms 312*a* and 312*b* and the first and second upper extension units 322*a* and 322*b* such that the first and second main channels 301*a* and 301*b* and the first and second auxiliary channels 301*c* and 301*d* are defined.

A cross-shaped upper channel-forming rib 328 for enabling wash water introduced through the main arm lower housing 340, a description of which will follow, to be introduced into the first and second main channels 301*a* and 301*b* and the first and second auxiliary channels 301*c* and 301*d* is formed at the center of rotation of the main arm upper housing 310.

In some implementations, a plurality of ribs for guiding the flow of the wash water flowing in the first and second main channels 301*a* and 301*b* and the first and second auxiliary channels 301*c* and 301*d* may be provided on the inside of the fusion rib 327 (i.e. on the inside of the fusion rib 327 defining the respective channels).

First and second upper ribs 316*a* and 316*b* formed in the first and second main channels 301*a* and 301*b* may protrude from the upper channel-forming rib 328 toward the inner surfaces of the first and second main channels 301*a* and 301*b*, and may contact first and second lower ribs 342*a* and 342*b* formed in the main arm lower housing 340, a description of which will follow, to define the channels.

In addition, first and second extension upper ribs 325*a* and 325*b* formed in the first and second auxiliary channels 301*c* and 301*d* may protrude from the upper channel-forming rib 328 toward the inner surfaces of the first and second auxiliary channels 301*c* and 301*d* and may contact first and second extension lower ribs 352*a* and 352*b* formed in the main arm lower housing 340, a description of which will follow, to define the channels.

In some implementations, the first and second extension upper ribs 325*a* and 325*b* formed in the first and second auxiliary channels 301*c* and 301*d* may be inclined so as to correspond to the shape of first and second discharge ports 324*a* and 324*b* formed in the first and second extension units 300*c* and 300*d* such that wash water flowing in the first and second auxiliary channels 301*c* and 301*d* can be smoothly introduced into the first and second discharge ports 324*a* and 324*b*.

The first and second auxiliary arm connection units 330*a* and 330*b* are integrally formed at the ends of the first and second upper extension units 322*a* and 322*b*. The first and second auxiliary arm connection units 330*a* and 330*b* have the same shape and are formed in opposite directions. Hereinafter, therefore, only the first auxiliary arm connection unit 330*a* formed at the first upper extension unit 322*a* will be described.

Figure 8:
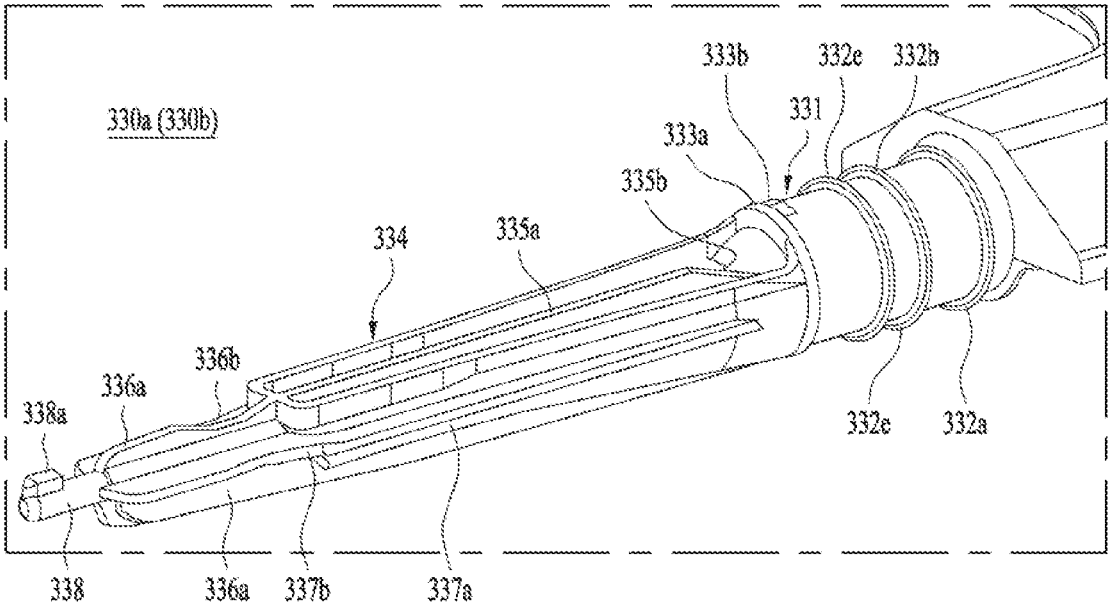
FIG. 8 is a diagram illustrating an example auxiliary arm connection unit of a main arm of a dishwasher.

FIG. 8 illustrates an example auxiliary arm connection unit of a main arm of a dishwasher.

As shown in FIG. 8, the first auxiliary arm connection unit 330*a* includes an extension pipe 331 communicating with the first discharge port 324*a* of the first upper extension unit 322*a*, a channel part 334 communicating with the end of the extension pipe 331 for diverting the flow of wash water upward, and a shaft 338 extending from the end of the channel part 334 for rotatably supporting the first auxiliary arm 400*a*.

The extension pipe 331 is provided on the outer circumferential surface thereof with a plurality of sealing ribs 332*a*, 332*b*, and 332*c* protruding in a ring shape for watertightness with the first auxiliary arm 400*a* and channel-forming protrusions 333*a*. Channel-forming protrusions 333*a* are provided between the extension pipe 331 and the channel part 334. The channel-forming protrusions 333*a* are formed at predetermined intervals along the outer circumferential surface of the extension pipe 331 in a protruding fashion such that some of the wash water introduced into the extension pipe 331 is introduced to the sealing ribs 332*a*, 332*b*, and 332*c*.

The sealing ribs 332*a*, 332*b*, and 332*c* and the channel-forming protrusions 333*a* may be spaced apart from the inner circumferential surface of the first auxiliary arm 400*a* by a predetermined distance. If the sealing ribs 332*a*, 332*b*, and 332*c* and the channel-forming protrusions 333*a* are in tight contact with the first auxiliary arm 400*a*, the rotation of the first auxiliary arm 400*a* may be restricted due to frictional force.

Consequently, the sealing ribs 332*a*, 332*b*, and 332*c* and the channel-forming protrusions 333*a* are spaced apart from the first auxiliary arm 400*a* by a predetermined distance such that the first auxiliary arm 400*a* can be rotated.

In some implementations, the distance between at least one pair of sealing ribs, among the sealing ribs 332*a*, 332*b*, and 332*c*, may be equal to or greater than the width of a foreign matter discharge port 419*a* formed in the first auxiliary arm 400*a* (see FIG. 13), a description of which will follow.

When wash water is introduced into the first auxiliary arm 400*a*, some of the wash water may be introduced into the gap between the extension pipe 331 and the first auxiliary arm 400*a* through the channel-forming protrusions 333*a* due to the pressure of the wash water. The introduced wash water may discharge foreign matter introduced into the gap between the extension pipe 331 and the first auxiliary arm 400*a* through the foreign matter discharge port 419*a*.

An upper support protrusion 333*b* and a lower support protrusion 333*c* protrude from the front upper surface and the rear lower surface of the extension pipe 331, respectively. The upper support protrusion 333*b* and the lower support protrusion 333*c* prevent damage to the sealing ribs 332*a*, 332*b*, and 332*c* and the channel-forming protrusions 333*a* due to an insertion error when the extension pipe 331 is inserted into the first auxiliary arm 400*a*, or prevent damage to the sealing ribs 332*a*, 332*b*, and 332*c* and the channel-forming protrusions 333*a* when the spray arm assembly 100 is moved in the state in which the first auxiliary arm 400*a* is coupled thereto.

The upper support protrusion 333*b* and the lower support protrusion 333*c* may have the same height as the sealing ribs 332*a*, 332*b*, and 332*c* or the channel-forming protrusions 333*a* but may have a larger area than the sealing ribs 332*a*, 332*b*, and 332*c* or the channel-forming protrusions 333*a*. As a result, the upper support protrusion 333*b* and the lower support protrusion 333*c* may have higher strength than the sealing ribs 332*a*, 332*b*, and 332*c* or the channel-forming protrusions 333*a*.

The channel part 334 may be formed in the shape of a box that extends from the end of the extension pipe 331, is open at the upper part thereof, and has a predetermined length. The channel part 334 diverts the flow of wash water upward such that the wash water that has passed through the extension pipe 331 moves toward the spray ports 414*a*, 415*a*, and 422*a* of the first auxiliary arm 400*a*.

The channel part 334 may be further provided on the inside thereof with a channel-forming rib 335*a* extending in the longitudinal direction of the channel part 334. The channel-forming rib 335*a* extends perpendicularly from the inside of the channel part 334 to increase the strength of the channel part 334 such that the shape of the channel part 334 is maintained and to reduce the inner volume of the channel part 334 such that the pressure of the wash water passing through the channel part 334 is temporarily increased.

In some implementations, the channel-forming rib 335*a* may be further provided at the front end thereof (i.e. the end thereof that faces the extension pipe 331) with an inclined part 335*b* inclined downward toward the extension pipe 331 such that, when the foreign matter is contained in the wash water introduced into the extension pipe 331, the foreign matter is prevented from being caught by the channel-forming rib 335*a*.

In addition, a plurality of horizontal reinforcement ribs 337*a* for protecting the channel part 334 from horizontal impacts applied to the channel part 334 may be formed at opposite sides of the channel part 334. Furthermore, a plurality of vertical reinforcement ribs 336*a* for protecting the channel part 334 from vertical impacts and loads applied to the channel part 334 may also be formed at the upper part and the lower part of the channel part 334.

The vertical impacts and loads applied to the channel part 334 may be greater than the horizontal impacts applied to the channel part 334. For this reason, the number of vertical reinforcement ribs 336*a* may be greater than the number of horizontal reinforcement ribs 337*a*.

In addition, the vertical reinforcement ribs 336*a* and the horizontal reinforcement ribs 337*a* may be adjacent to the inner circumferential surface of the first auxiliary arm 400*a*. The reason for this is that it is necessary to reduce the inner volume of the first auxiliary arm 400*a* so as to temporarily increase the pressure of the wash water supplied to the first auxiliary arm 400*a*, in the same manner as the channel-forming rib 335*a*.

In some implementations, the vertical reinforcement ribs 336*a* and the horizontal reinforcement ribs 337*a* may be provided at the outsides thereof with a plurality of recesses 336*b* and 337*b* for preventing interference with the spray ports formed in the first auxiliary arm 400*a*.

That is, the vertical reinforcement ribs 336*a* and the horizontal reinforcement ribs 337*a* may be inserted into the first auxiliary arm 400*a* so as to be adjacent to the inner circumferential surface of the first auxiliary arm 400*a* such that, when the first auxiliary arm 400*a* is rotated, the spray ports 414*a*, 415*a*, and 422*a* formed in the first auxiliary arm 400*a* are closed by the vertical reinforcement ribs 336*a* and the horizontal reinforcement ribs 337*a*.

Consequently, the vertical reinforcement ribs 336*a* and the horizontal reinforcement ribs 337*a* may be further provided at the outsides thereof with a plurality of recessed parts 336*b* and 337*b* for allowing wash water to be introduced into the spray ports 414*a*, 415*a*, and 422*a* when the first auxiliary arm 400*a* is rotated.

The shaft 338 protrudes from the end of the channel part 334 so as to be inserted into the inner end of the first auxiliary arm 400*a* for rotatably supporting the first auxiliary arm 400*a*. The shaft 338 may be spaced apart from the extension pipe 331 so as to distribute the load of the first auxiliary arm 400*a*.

In some implementations, an insertion key 338*a* protrudes from one side of the end of the shaft 338. The insertion key 338*a* is inserted into a key recess 417*a* formed in the first auxiliary arm 400*a* (see FIG. 14) to prevent the first auxiliary arm 400*a* from being separated from the shaft. To this end, the insertion key 338*a* and the key recess 417*a* may be located so as to face opposite directions in the state in which the first auxiliary arm 400*a* is normally installed.

That is, the first auxiliary arm 400*a* is coupled to the first auxiliary arm connection unit 330*a* in the state in which the first auxiliary arm 400*a* is inverted such that the insertion key 338*a* of the shaft 338 can be inserted into the key recess 417*a* of the first auxiliary arm 400*a*, and after the first auxiliary arm 400*a* is completely inserted, the first auxiliary arm 400*a* is inverted again such that the insertion key 338*a* of the shaft 338 cannot be separated from the key recess 417*a*.

Figure 9:
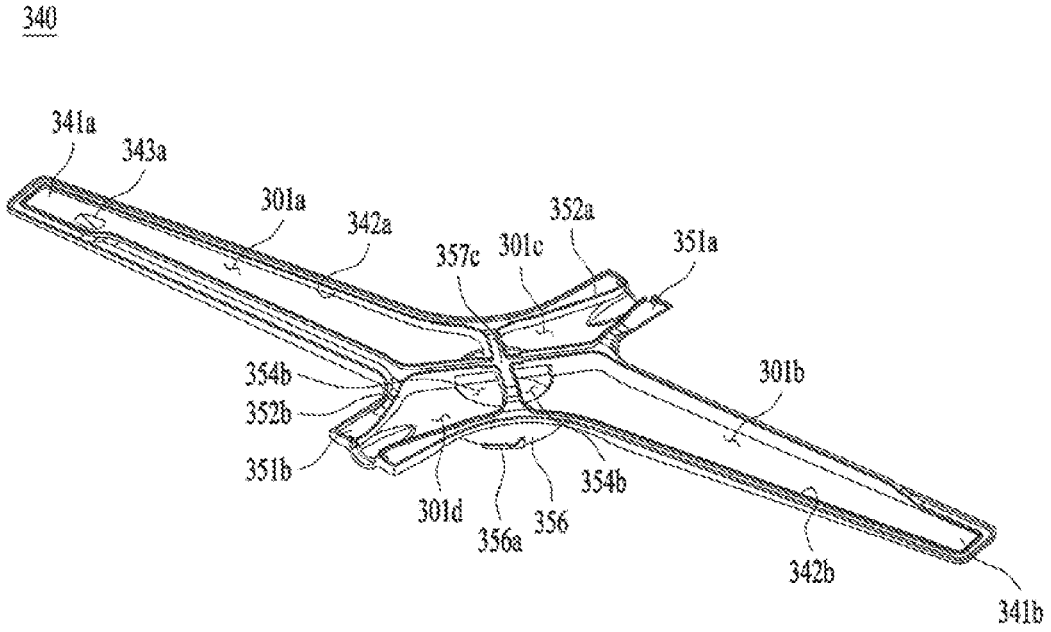
FIGS. 9 and 10 are diagrams illustrating an example lower housing of a main arm of a dishwasher.
Figure 10:
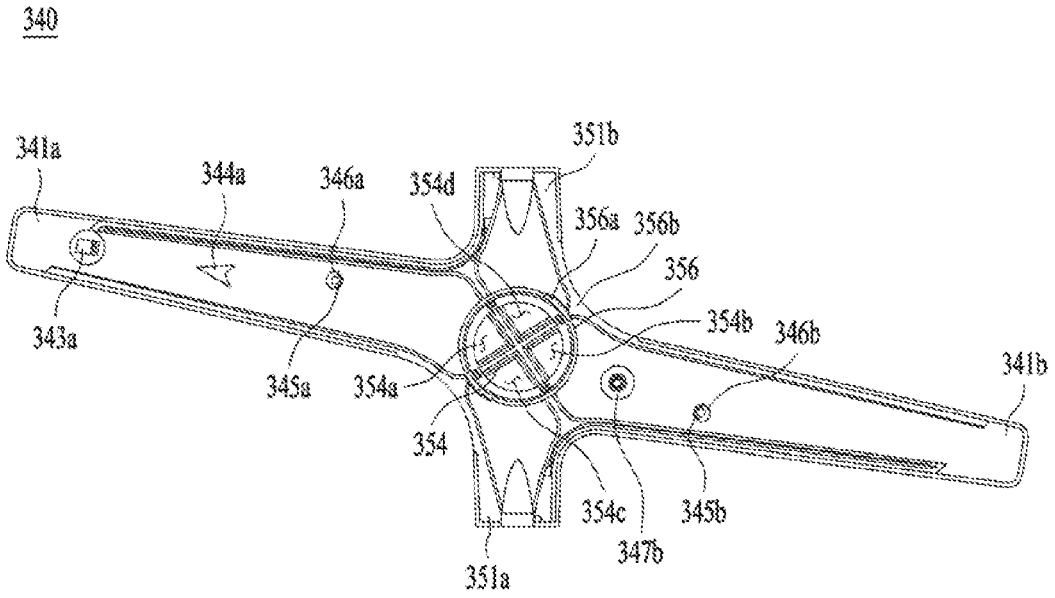

FIGS. 9 and 10 illustrate an example lower housing of a main arm of a dishwasher.

As shown in FIGS. 9 and 10, the main arm lower housing 340 is provided with first and second lower main arms 341*a* and 341*b*, which form the lower parts of the first and second main arms 300*a* and 300*b*, and first and second lower extension units 351*a* and 351*b*, which form the lower parts of the first and second extension units 300*c* and 300*d*. A spray arm holder coupling part 356 protrudes from the lower part of the center of rotation of the main arm lower housing 340.

The first and second lower main arms 341*a* and 341*b* and the first and second lower extension units 351*a* and 351*b* are formed so as to have shapes corresponding to the shapes of the first and second upper main arms 312*a* and 312*b* and the first and second upper extension units 322*a* and 322*b*. A detailed description of the shapes of the first and second lower main arms 341*a* and 341*b* and the first and second lower extension units 351*a* and 351*b* will be omitted.

In some implementations, the main arm lower housing 340 is provided on the upper surface thereof with a fusion step 357, to which the fusion rib 327 of the main arm upper housing 310 is fused, as shown in FIG. 9. The fusion step 357 extends to partition the first and second lower main arms 341*a* and 341*b* and the first and second lower extension units 351*a* and 351*b* such that the first and second main channels 301*a* and 301*b* and the first and second auxiliary channels 301*c* and 301*d* are defined.

A cross-shaped lower channel-forming rib 354 for enabling wash water to be introduced into the first and second main channels 301*a* and 301*b* and the first and second auxiliary channels 301*c* and 301*d* is formed at the middle part of the spray arm holder coupling part 356.

In some implementations, a plurality of lower ribs 342*a*, 342*b*, 352*a*, and 352*b* contacting the upper ribs 316*a*, 316*b*, 325*a*, and 325*b* of the main arm upper housing 310 for guiding the flow of the wash water flowing in the first and second main channels 301*a* and 301*b* and the first and second auxiliary channels 301*c* and 301*d* may be provided on the inside of the fusion step 357 (i.e. on the inside of the fusion step 357 defining the respective channels).

The first and second lower ribs 342*a* and 342*b* may protrude from the lower channel-forming rib 335*a* toward the inner surfaces of the first and second main channels 301*a* and 301*b*, and may contact first and second upper ribs 316*a* and 316*b* formed in the main arm upper housing 310 to define the first and second main channels 301*a* and 301*b*.

In addition, first and second extension lower ribs 352*a* and 352*b* formed in the first and second auxiliary channels 301*c* and 301*d* may protrude from the lower channel-forming rib 335*a* toward the inner surfaces of the first and second auxiliary channels 301*c* and 301*d*, and may contact the first and second extension upper ribs 325*a* and 325*b* formed in the main arm upper housing 310 to define the first and second auxiliary channels 301*c* and 301*d*.

In some implementations, the first and second extension lower ribs 352*a* and 352*b* formed in the first and second auxiliary channels 301*c* and 301*d* may be inclined so as to correspond to the shape of the first and second discharge ports 324*a* and 324*b* formed in the first and second extension units 300*c* and 300*d* such that wash water flowing in the first and second auxiliary channels 301*c* and 301*d* can be smoothly introduced into the first and second discharge ports 324*a* and 324*b*.

The spray arm holder coupling part 356 is formed in a cylindrical shape. The spray arm holder coupling part 356 is provided on the lower parts of the opposite sides of the outer circumferential surface thereof with spray arm holder coupling protrusions 356*a*, to which the spray arm holder 600 is coupled. When the main arm insertion unit 610 of the spray arm holder 600 is inserted into the spray arm holder coupling part 356 and the spray arm holder 600 is rotated in one direction, the spray arm holder 600 is held by the spray arm holder coupling protrusions 356*a*, whereby the spray arm holder 600 is fixed. When the spray arm holder 600 is rotated in the other direction, the spray arm holder 600 is separated from the spray arm holder coupling protrusions 356*a*, whereby the spray arm holder 600 may be removed.

In some implementations, the main arm lower housing is provided at the middle part of the lower surface thereof with a spray arm holder coupling part 356, as shown in FIG. 10. A lower channel-forming rib 354 is formed in the spray arm holder coupling part 356. The interior of the spray arm holder coupling part 356 is partitioned into first and second main channel inlets 354*a* and 354*b* and first and second extension channel inlets 354*c* and 354*d* by the lower channel-forming rib 354 such that wash water can be introduced into the first and second main channels 301*a* and 301*b* and the first and second auxiliary channels 301*c* and 301*d*.

The first and second main channel inlets 354*a* and 354*b* and the first and second extension channel inlets 354*c* and 354*d* communicate with the first and second main channels 301*a* and 301*b* and the first and second auxiliary channels 301*c* and 301*d*, respectively. The first and second main channel inlets 354*a* and 354*b* and the first and second extension channel inlets 354*c* and 354*d* may be sequentially opened and closed by the channel-switching unit 700, a description of which will follow.

In some implementations, a washing spray port 343*a* for spraying wash water toward the shaft of the spray arm assembly 100 is formed in the end of the first lower main arm 341*a*. When the spray arm 200 is rotated, the washing spray port 343*a* sprays wash water toward the shaft of the spray arm assembly 100 such that foreign matter remaining in the lower part of the washing tub 10 and the sump cover 50 can be introduced to the filter cover 60 and the filter 70.

In addition, the first lower main arm 341*a* may be further provided at the middle part thereof with a specific figure- or letter-type lower indication part 344*a* for enabling the direction in which the main arm lower housing 340 is fused to be checked when the main arm upper housing 310 and the main arm lower housing 340 are fused.

In some implementations, the first and second lower main arms 341*a* and 341*b* are provided with first and second guide protrusions 345*a* and 345*b*, to which the first and second main links 920*a* and 920*b* of the link member 900 are reciprocably coupled, respectively. The first and second guide protrusions 345*a* and 345*b* are provided with first and second extension steps 346*a* and 346*b* movably coupled to the first and second main links 920*a* and 920*b* of the link member 900 for preventing the separation of the first and second main links 920*a* and 920*b*. In addition, a gear shaft 347*b*, to which the eccentric gear unit 800 is rotatably coupled, protrudes from the second lower main arm 341*b*.

The link member 900, which is movably coupled to the first and second guide protrusions 345*a* and 345*b*, is reciprocated along the first and second guide protrusions 345*a* and 345*b* when the eccentric gear unit 800, which is coupled to the gear shaft 347*b*, is rotated. In addition, the movement of the link member 900 may be limited by the spray arm holder 600 in the state in which the spray arm holder 600 is inserted into the rim-shaped body 910.

Consequently, the centers of the first and second guide protrusions 345*a* and 345*b*, which guide the movement of the link member 900, the gear shaft 347*b*, to which the eccentric gear unit 800 is coupled, and the spray arm holder 600, which is inserted into the link member 900, may be arranged in a straight line.

In some implementations, the spray arm holder coupling part 356 may be provided in the outer circumferential surface thereof with a plurality of drainage channels 356*b* extending between the first and second lower main arms 341*a* and 341*b* and the first and second lower extension units 351*a* and 351*b*. The drainage channels 356*b* may be formed in the lower surface of the main arm lower housing 340 along the fusion step 357 formed on the upper surface of the main arm lower housing 340.

When the spray arm 200 is rotated, foreign matter and wash water remaining on the lower surface of the main arm lower housing 340 are discharged from the main arm lower housing 340 through the drainage channels 356*b* due to the centrifugal force generated by the rotation of the spray arm 200.

Figure 11:
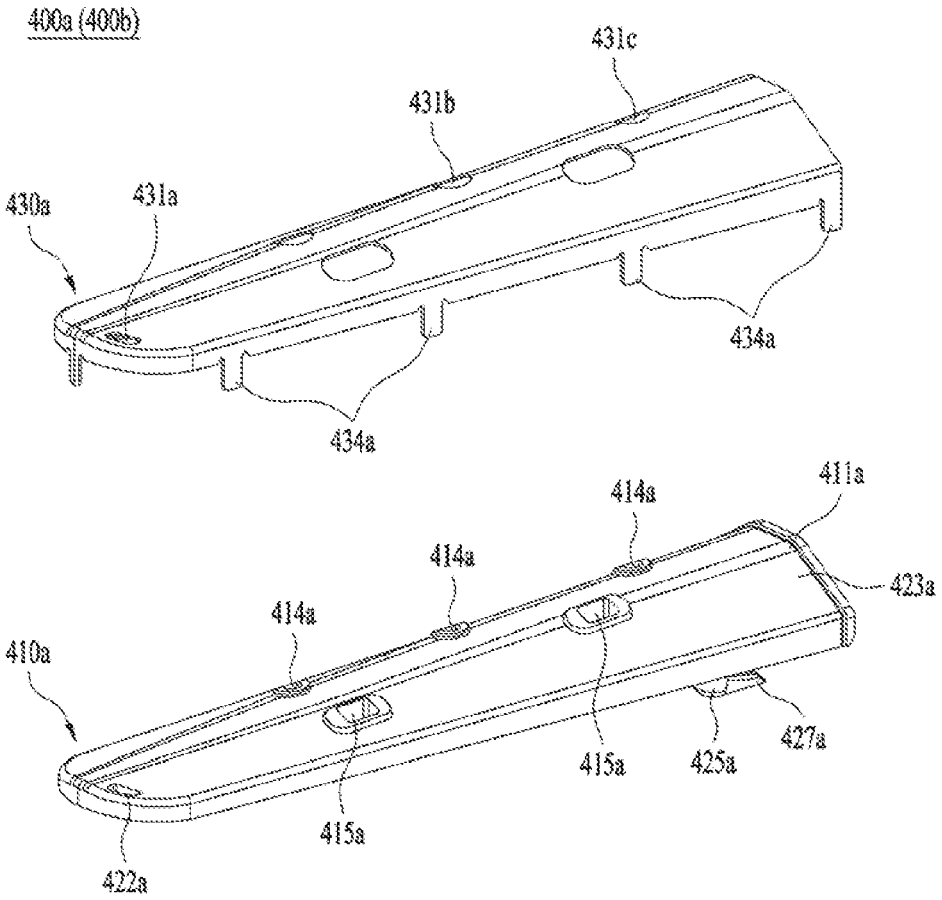
FIG. 11 is a diagram illustrating an example auxiliary arm of a dishwasher.
Figure 12:
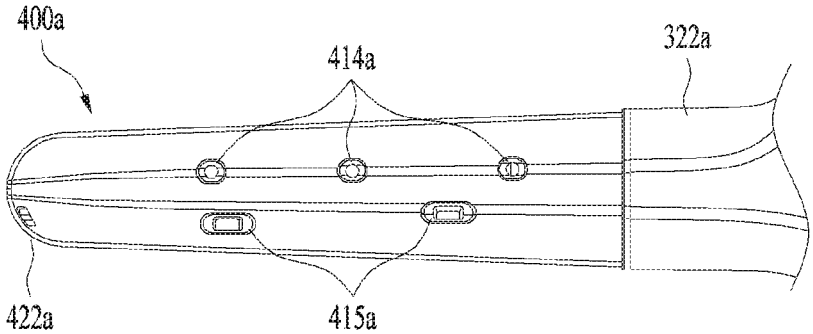
FIGS. 12 to 14 are diagrams illustrating an example auxiliary arm of a dishwasher.
Figure 12:
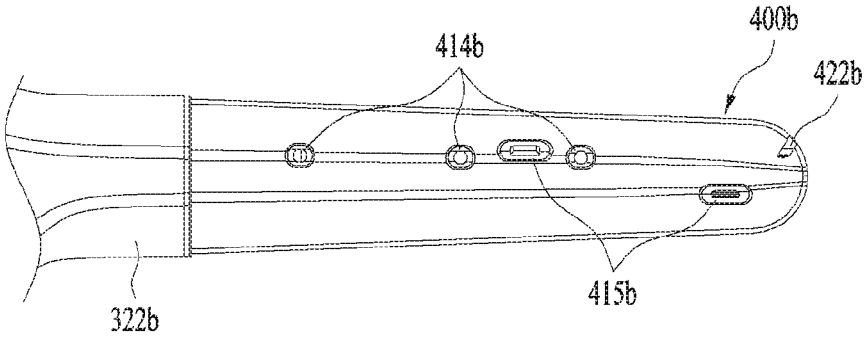

FIG. 11 illustrates an example auxiliary arm of a dishwasher. FIG. 12 illustrates an example auxiliary arm of a dishwasher.

In some implementations, an auxiliary arm 400 can include the first and second auxiliary arms 400*a* and 400*b*. The first and the second auxiliary arms 400*a* and 400*b* can have almost the same structure except positions and shapes of the spray ports 414*a*, 415*a*, 414*b*, 415*b*, 422*a*, and 422*b* formed in the first and second auxiliary arms 400*a* and 400*b*. Thus, the descriptions regarding the structure of the first auxiliary arm 400*a* can be applied to the structure of the second auxiliary arm 400*b*. In some other implementations, the structure of the second auxiliary arm 400*b* can be different from the structure of the first auxiliary arm 400*a*.

As shown in FIGS. 11 and 12, the first auxiliary arm 400*a* includes an auxiliary arm housing 410*a* rotatably coupled to the first auxiliary arm connection unit 330*a* and rotated to spray wash water supplied from the first auxiliary arm connection unit 330*a* in response to the operation of the link member 900 and a decoration panel 430*a* fastened to the upper part of the auxiliary arm housing 410*a* for defining the upper surface of the auxiliary arms 400*a* and 400*b*.

The auxiliary arm housing 410*a* is provided with an auxiliary arm channel part 411*a* formed in a cylindrical shape for defining an auxiliary arm channel 412*a*, into which the first auxiliary arm connection unit 330*a* is inserted, and symmetrical extension ribs 423*a* (see FIG. 36) extending from the upper side of the auxiliary arm channel part 411*a* to the opposite sides of the auxiliary arm channel part 411*a* in the longitudinal direction so as to correspond to the outer shape of the first extension unit 300*c*.

The extension ribs 423*a* may have shapes that are symmetrical with respect to the longitudinal direction of the upper surface of the auxiliary arm channel part 411*a*, and may be bent downward from the auxiliary arm channel part 411*a* at the opposite sides of the auxiliary arm channel part 411*a* in the longitudinal direction. The decoration panel 430*a* may be fixed to the outer surfaces of the extension ribs 423*a*.

In some implementations, the auxiliary arm channel part 411*a* may be provided in the upper side thereof with first auxiliary spray ports 414*a* for spraying wash water in a direction approximately perpendicular to the first auxiliary arm 400*a* and first auxiliary inclined spray ports 415*a* formed so as to be inclined in a direction opposite the direction in which the first auxiliary arm 400*a* is rotated for generating thrust force necessary to rotate the spray arm 200 when wash water is sprayed through the first auxiliary arm 400*a*.

The decoration panel 430*a* covers the upper surface of the auxiliary arm housing 410*a*. The decoration panel 430*a* may be made of a glossy metal material having a predetermined thickness, and may be formed by pressing so as to correspond to the curved shape of the upper surface of the auxiliary arm housing 410*a*.

In some implementations, the decoration panel 430*a* is provided in the inner part thereof with a plurality of through holes 431*a*, 431*b*, and 431*c* formed so as to correspond to the first auxiliary spray ports 414*a* or the first auxiliary inclined spray ports 415*a* of the auxiliary arm housing 410*a* such that the first auxiliary spray ports 414*a* or the first auxiliary inclined spray ports 415*a* can be exposed.

The decoration panel 430*a* is provided on the outer circumferential surface thereof with a plurality of fixing pins 434*a* held by the extension ribs 423*a* of the auxiliary arm housing 410*a*. The fixing pins 434*a* are bent inward at the lower sides of the extension ribs 423*a* to fix the decoration panel 430*a* to the auxiliary arm housing 410*a*. Alternatively, the decoration panel 430*a* and the auxiliary arm housing 410*a* may be fixed to each other using an adhesive, in addition to the fixing pins 434*a*.

The auxiliary arm channel part 411*a* is provided on the lower part thereof with a turning protrusion 425*a*, to which the first auxiliary link 950*a* of the link member 900 is coupled. A separation prevention protrusion 427*a* bent from the turning protrusion 425*a* for holding the lower surface of the first auxiliary link 950*a* is formed on the end of the turning protrusion 425*a*. The separation prevention protrusion 427*a* may extend toward the center of the spray arm 200 so as to be securely coupled to the first auxiliary link 950*a*. In addition, the separation prevention protrusion 427*a* may be shorter than at least a first turning slot 971*a* formed in the first auxiliary link 950*a*, and may have a length sufficient to be held in the first turning slot 971*a* when the link member 900 is installed (see FIG. 35).

In some implementations, each of the first auxiliary spray ports 414*a* and the first auxiliary inclined spray ports 415*a* may be formed in the shape of a circular hole or a slot in order to extend a wash water spraying region. In addition, the direction in which wash water is sprayed through the first auxiliary spray ports 414*a* and the first auxiliary inclined spray ports 415*a* is set to generate thrust force necessary to rotate the spray arm 200 even when the first auxiliary arm 400*a* is rotated.

That is, the magnitude of thrust force generated by wash water sprayed through the first auxiliary spray ports 414*a* or the first auxiliary inclined spray ports 415*a* may be increased or decreased as a result of the rotation of the first auxiliary arm 400*a*; however, the direction of thrust force generated by wash water sprayed through the first auxiliary spray ports 414*a* or the first auxiliary inclined spray ports 415*a* may be uniform.

Figure 13:
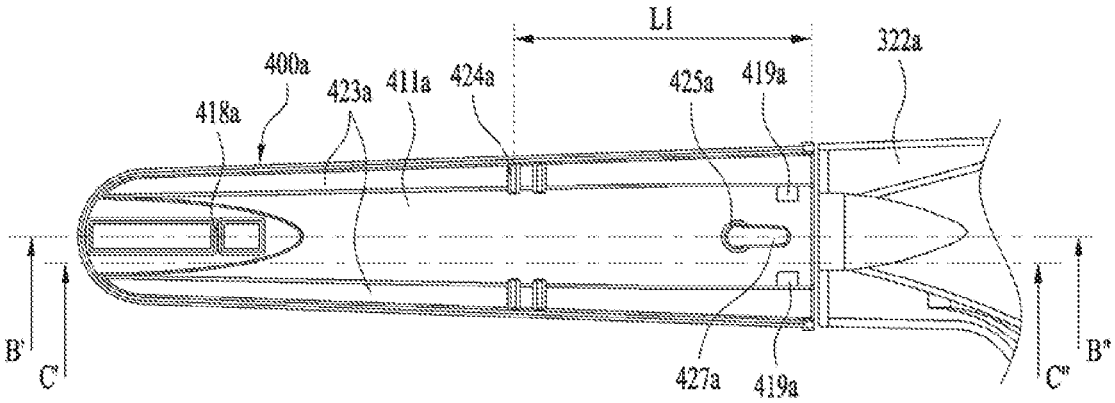
Figure 13:
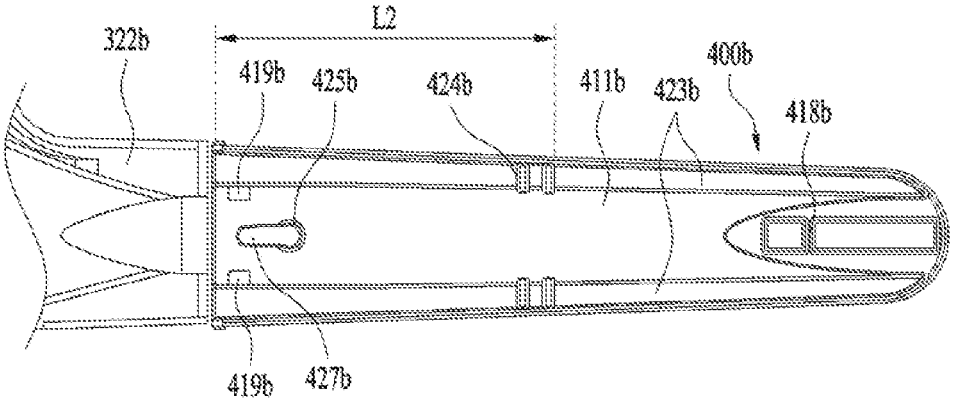
Figure 14:
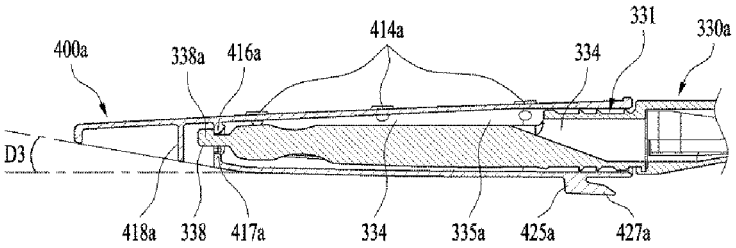
Figure 14:
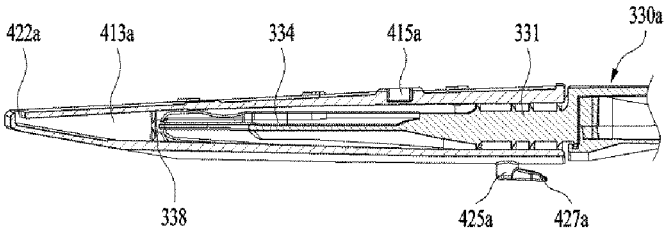

In some implementations, as shown in FIGS. 13 and 14, the auxiliary arm channel 412*a* is formed in the inner end thereof with a coupling hole 416*a*, into which the shaft 339 of the first auxiliary arm connection unit 330*a* is inserted, and a key recess 417*a*, into which the insertion key 338*a* formed on the shaft 339 is inserted, is formed in one side of the coupling hole 416*a*.

The key recess 417*a* formed in the coupling hole 416*a* may be located so as to be opposite the insertion key 338*a* in the state in which the first auxiliary arm 400*a* is normally installed. That is, when the first auxiliary arm 400*a* is installed, the first auxiliary arm connection unit 330*a* is inserted into the first auxiliary arm 400*a* in the state in which the first auxiliary arm 400*a* is inverted, whereby the shaft 339 of the first auxiliary arm connection unit 330*a* is inserted into the coupling hole 416*a*, and at the same time the insertion key 338*a* of the shaft 339 is inserted into the key recess 417*a* of the coupling hole 416*a*.

When the first auxiliary arm connection unit 330*a* is completely inserted into the first auxiliary arm 400*a*, the first auxiliary arm 400*a* is rotated such that the key recess 417*a* of the coupling hole 416*a* is not aligned with the insertion key 338*a* of the shaft 339, whereby the first auxiliary arm 400*a* is prevented from being separated from the first auxiliary arm connection unit 330*a*.

In some implementations, a reflection plate 418*a* for preventing scattering of wash water discharged to the coupling hole 416*a* and the key recess 417*a* is formed outside the coupling hole 416*a* of the first auxiliary arm 400*a*. The coupling hole 416*a* and the key recess 417*a* of the first auxiliary arm 400*a* are formed in the end of the auxiliary arm channel 412*a*, along which wash water flows. When wash water is sprayed through the first auxiliary spray ports 414*a* or the first auxiliary inclined spray ports 415*a* of the first auxiliary arm 400*a*, some of the wash water may be discharged to the coupling hole 416*a* and the key recess 417*a*. The wash water discharged to the coupling hole 416*a* and the key recess 417*a* may unintentionally scatter to the inner wall of the washing tub 10. The reflection plate 418*a* is provided to prevent scattering of the wash water discharged to the coupling hole 416*a* and the key recess 417*a* and to guide the wash water to the sump cover 50.

The auxiliary arm channel part 411*a* is provided in the front end thereof (i.e. the end thereof located at the extension pipe 331 of the first auxiliary arm connection unit 330*a*) with a foreign matter discharge hole 419*a* for discharging foreign matter introduced into the auxiliary arm channel 412*a* of the auxiliary arm channel part 411*a*. The foreign matter discharge hole 419*a* is located between at least one pair of sealing ribs, among the sealing ribs 332*a*, 332*b*, and 332*c* formed on the extension pipe 331 of the first auxiliary arm connection unit 330*a*.

When wash water is introduced into the auxiliary arm channel 412*a* of the first auxiliary arm 400*a*, therefore, some of the wash water is introduced into the gap between the extension pipe 331 and the first auxiliary arm 400*a* through the channel-forming protrusions 333*a* due to the pressure of the wash water. The introduced wash water may discharge foreign matter introduced into the gap between the extension pipe 331 and the first auxiliary arm 400*a* through the foreign matter discharge hole 419*a*.

When the spray arm 200 is rotated, the first auxiliary arm 400*a* is rotated about the first auxiliary arm connection unit 330*a* in a reciprocating fashion and sprays wash water through the first auxiliary spray ports 414*a* and the first auxiliary inclined spray ports 415*a*. As a result, thrust force generated by the wash water sprayed through the spray ports 414*a* and 415*a* may be increased and decreased at predetermined intervals.

The change in thrust force for the first auxiliary arm 400*a* may change the rotational speed of the spray arm 200 or reduce the washing efficiency of wash water. Consequently, it is necessary to maintain the thrust force generated by wash water sprayed though the first auxiliary arm 400*a* relatively uniform.

To this end, the auxiliary arm channel part 411*a* may be further provided in the end thereof with a first thrust force spray port 422*a* (see FIG. 12) for generating thrust force for the first auxiliary arm 400*a*. The first thrust force spray port 422*a* may be formed so as to be inclined in a direction opposite the direction in which the first auxiliary arm 400*a* is rotated, and may be formed so as to generate thrust force greater than the thrust force generated by the first auxiliary inclined spray ports 415*a*. The first thrust force spray port 422*a* is formed to generate the thrust force for the first auxiliary arm 400*a*. In addition, the first thrust force spray port 422*a* may be formed to wash the outer part of the washing tub 10.

In some implementations, the auxiliary arm channel 412*a* may be further provided in the end thereof with an auxiliary arm divergence channel 413*a* (see FIG. 14(*a*)) having a smaller sectional area than the auxiliary arm channel 412*a* for supplying wash water to the first thrust force spray port 422*a*. The sectional area of the auxiliary arm divergence channel 413*a* is gradually reduced to increase the pressure of wash water sprayed through the first thrust force spray port 422*a*.

In some implementations, the first and second auxiliary arms 400*a* and 400*b* have very similar external structures but are different from each other in terms of the positions of the first auxiliary spray ports 414*a* and the first auxiliary inclined spray ports 415*a*. That is, the first and second auxiliary spray ports 414*a* and 414*b* and the first and second auxiliary inclined spray ports 415*a* and 415*b* formed in the first and second auxiliary arms 400*a* and 400*b* have different spray regions when the spray arm 200 is rotated. When the first auxiliary arm 400*a* (or the second auxiliary arm 400*b*) is installed in each of the first and second auxiliary arm connection units 330*a* and 330*b*, therefore, the same spray region is formed by the first auxiliary arm 400*a* (or the second auxiliary arm 400*b*), whereby washing efficiency may be reduced.

In order to distinguish between the first and second auxiliary arms 400*a* and 400*b*, therefore, an auxiliary arm indication part may be further formed. The auxiliary arm indication part may be formed at the lower surface of the auxiliary arm housing 410*a* in a specific figure or letter form.

Alternatively, additional reinforcement ribs 424*a* (see FIG. 13) may be formed to increase the strength of the extension ribs 423*a* of the auxiliary arm housing 410*a*. The reinforcement ribs 424*a* may be formed at different positions of the first and second auxiliary arms 400*a* and 400*b* in order to distinguish between the first and second auxiliary arms 400*a* and 400*b*. For example, in the case in which the reinforcement ribs 424*a* formed at the first auxiliary arm 400*a* are located in region L1, the reinforcement ribs 424*a* formed at the second auxiliary arm 400*b* may be located in region L2 in order to distinguish between the first and second auxiliary arms 400*a* and 400*b*.

In some implementations, the first auxiliary arm 400*a* may be provided on the lower surface of the end thereof with an upwardly inclined surface 428*a* (see FIG. 14(*a*)) that is inclined upward toward the outside of the spray arm 200. The upwardly inclined surface 428*a* may be formed to prevent contact with the washing tub 10 when the spray arm is rotated or stopped.

Figure 15:
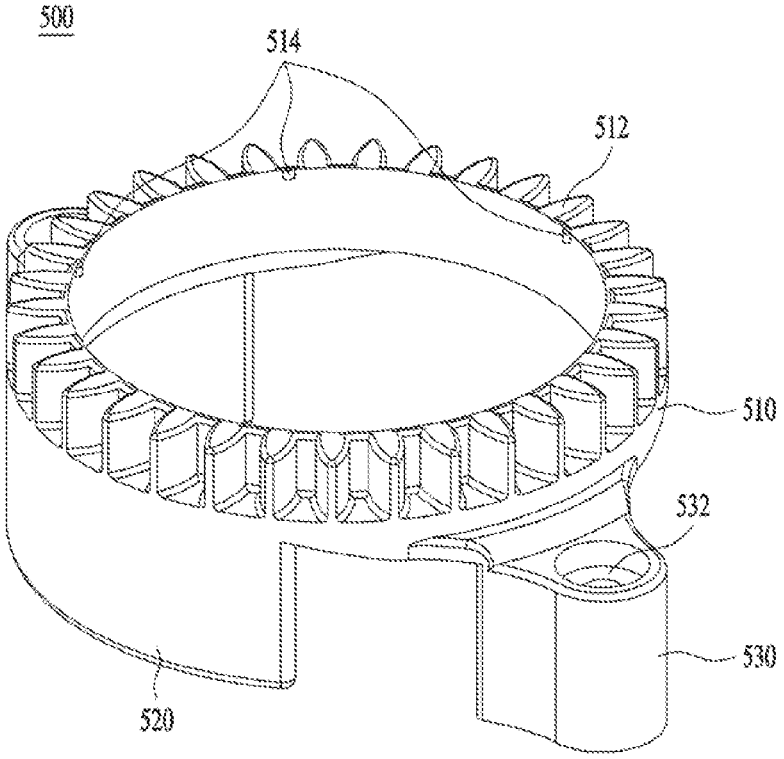
FIG. 15 is a diagram illustrating an example stationary gear unit of a dishwasher.
Figure 16:
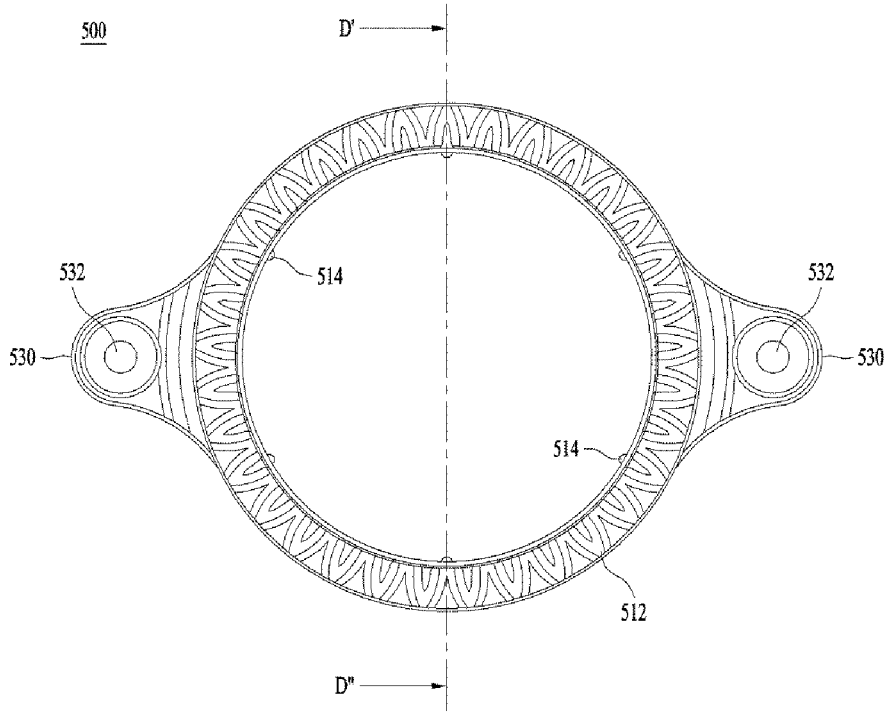
FIGS. 16 and 17 are diagrams illustrating an example stationary gear unit of a dishwasher.
Figure 17:
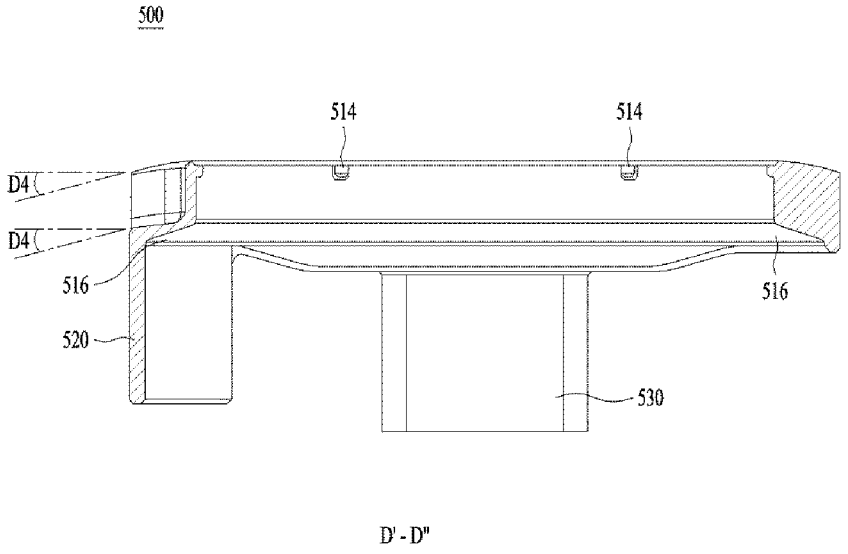
Figure 18:
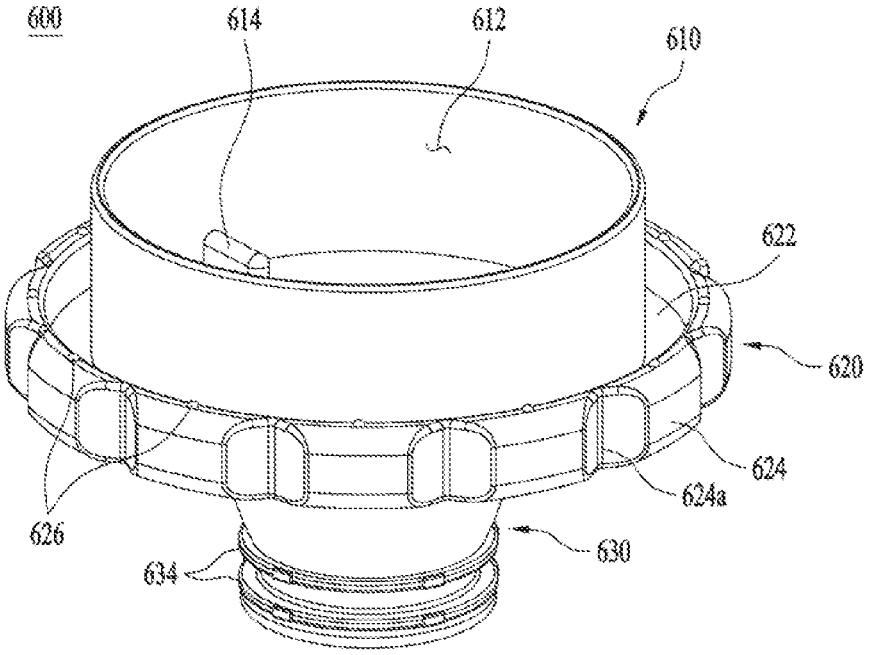
FIGS. 18 to 21 are diagrams illustrating an example spray arm holder of a dishwasher.
Figure 19:
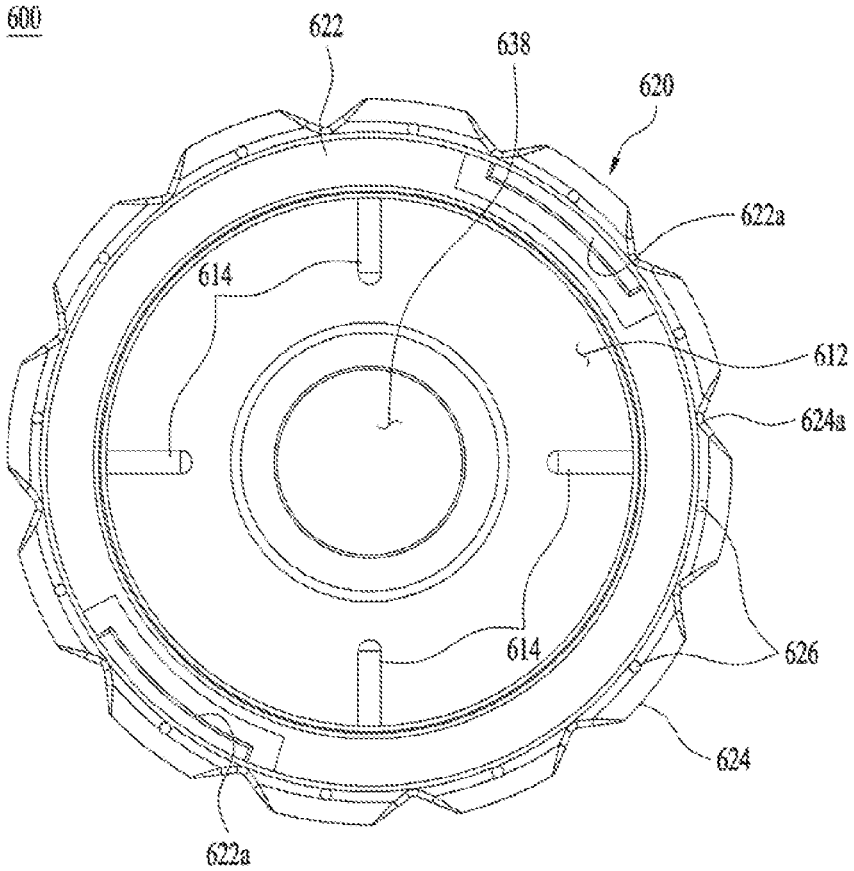
Figure 20:
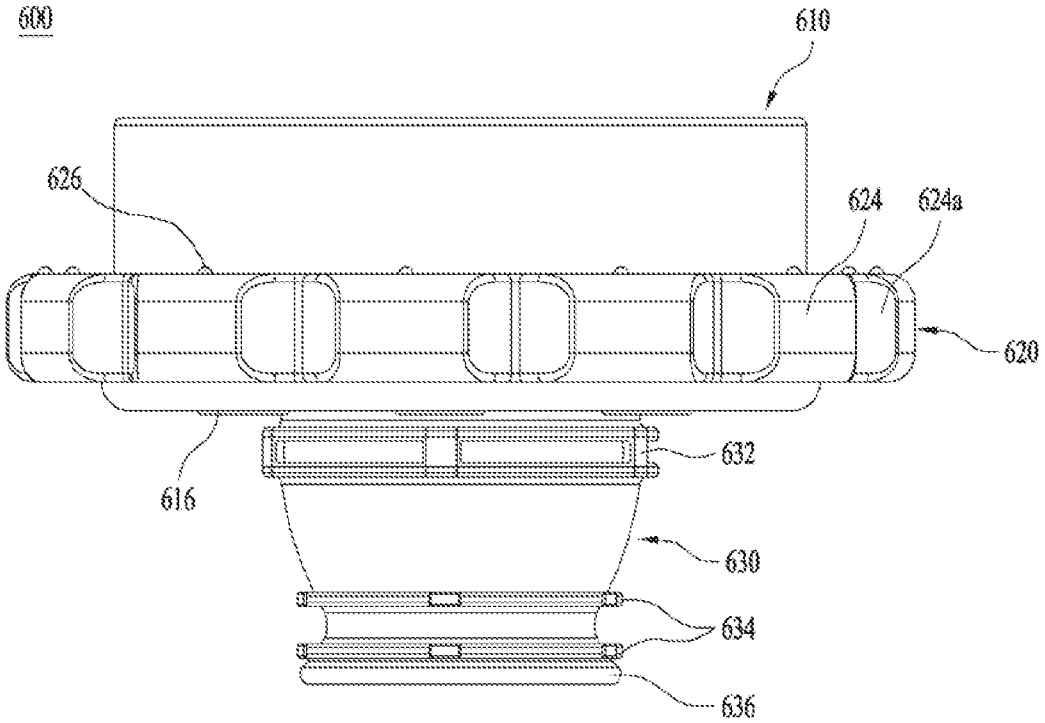
Figure 21:
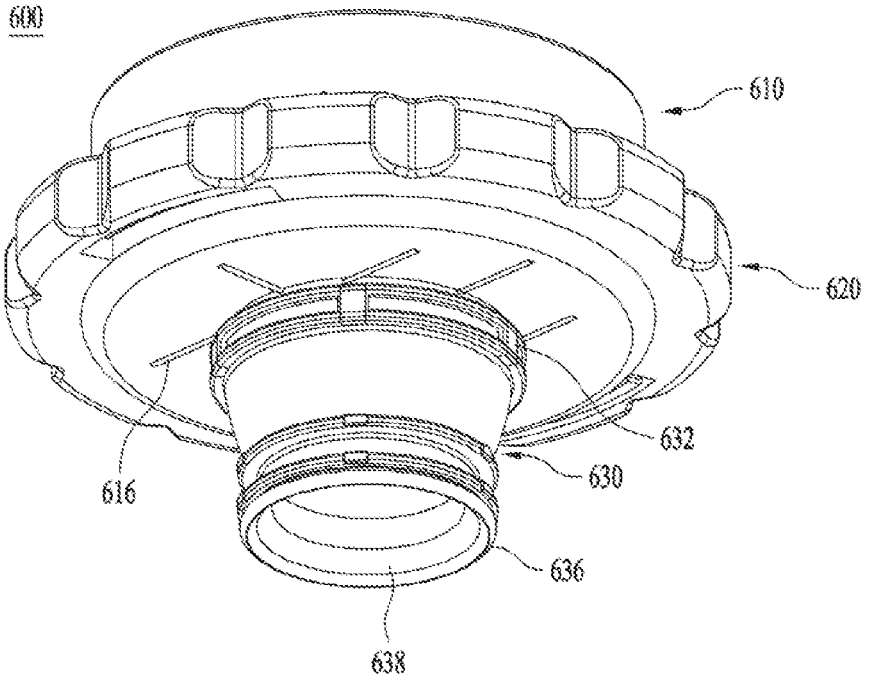

FIG. 15 illustrates an example stationary gear unit of a dishwasher. FIGS. 16 and 17 illustrate an example stationary gear unit of a dishwasher.

The stationary gear unit 500 includes a rim part 510, through which the spray arm holder coupling part 356 formed in the main arm lower housing 340 rotatably extends, a plurality of first gear teeth 512 being formed on the outer circumferential surface of the rim part 510, fastening parts 530 extending from opposite sides of the rim part 510 so as to be coupled to the coupling bosses 51 of the sump cover 50, and a shielding rib 520 extending downward from one side of the rim part 510 for shielding the inside of the stationary gear unit 500.

The first gear teeth 512 are formed on the outer circumferential surface of the upper part of the rim part 510 in the shape of a ring that is larger than the outer circumferential surface of the spray arm holder coupling part 356. The rim part 510 is provided on the inner circumferential surface thereof with at least three gap-maintaining protrusions 514 for maintaining the gap from the spray arm holder coupling part 356 and preventing friction.

In some implementations, the upper surfaces of the first gear teeth 512 and the upper surface of the rim part 510, at which the first gear teeth 512 are formed, are formed so as to be inclined downward toward the outside of the rim part 510 by a predetermined angle D4. That is, when washing is performed using wash water, the wash water and foreign matter may be introduced to the upper parts of the first gear teeth 512. In order to discharge the introduced wash water and foreign matter, therefore, the upper surfaces of the first gear teeth 512 and the upper surface of the rim part 510, at which the first gear teeth 512 are formed, may be formed so as to be inclined downward toward the outside of the rim part 510.

In addition, the rim part 510 is provided on the lower surface thereof with a support surface 516 configured to contact the separation prevention unit 620 of the spray arm holder 600. The support surface 516 may be formed so as to be inclined upward toward the center of the rim part 510.

In some implementations, when the spray arm 200 is rotated, the spray arm holder 600, which is coupled to the spray arm 200, is also rotated. The spray arm holder 600 is rotated while being floated by the upward pressure of the wash water in the state of being inserted into the spray arm holder location unit 53 of the sump cover 50. The spray arm holder 600 may move horizontally due to the gap between the spray arm holder 600 and the stationary gear unit 500.

The support surface 516 of the rim part 510 may prevent the separation prevention unit 620 of the spray arm holder 600 from moving due to the inclination of the support surface 516 when the spray arm holder 600 is moved upward by the pressure of wash water according to the rotation of the spray arm.

The fastening parts 530 extend from opposite sides of the rim part 510 toward the lower side of the rim part 510. The fastening parts 530 are provided with fastening holes 532, into which the coupling bosses 51 of the sump cover 50 are inserted. The fastening parts 530 may be fixed using additional fastening members (e.g. screws).

In some implementations, the shielding rib 520 is formed at the front side of the rim part 510 (i.e. at the side of the rim part 510 adjacent to the door 30) to shield the spray arm holder 600 located in the stationary gear unit 500. For example, the shielding rib 520 prevents foreign matter from being introduced into the stationary gear unit 500 or a user's hand from being inserted into the stationary gear unit 500 when the filter 70 and the filter cover 60, which are located in front of the shielding rib 520, are mounted and removed.

FIGS. 18 to 21 illustrate an example spray arm holder of a dishwasher.

As shown in FIGS. 18 to 21, the spray arm holder 600 includes a main arm insertion unit 610 inserted into the spray arm holder coupling part 356 of the spray arm 200 for defining a space for installation of the channel-switching unit 700, a separation prevention unit 620 formed on the outer circumferential surface of the main arm insertion unit 610 so as to be fixed to the spray arm holder coupling part 356 and to be held by the support surface 516 of the stationary gear unit 500, and a sump insertion unit 630 protruding from the lower part of the main arm insertion unit 610 so as to be rotatably inserted into the spray arm holder location unit 53 of the sump cover 50.

The main arm insertion unit 610 is formed such that the outer circumferential surface of the main arm insertion unit 610 corresponds to the inner circumferential surface of the spray arm holder coupling part 356. A valve chamber 612, into which the channel-switching unit 700 is inserted, is formed in the main arm insertion unit 610. The valve chamber 612 is provided on the lower surface thereof with a plurality of support protrusions 614 contacting the lower inclined protrusions 730*a*, 730*b*, 730*c*, and 730*d* of the channel-switching unit 700 to rotate the channel-switching unit 700. A hollow portion, through which wash water is introduced, is formed in the center of the lower part of the valve chamber 612.

The number of support protrusions 614 may be changed depending on the number of channels formed in the spray arm 200. At least four support protrusions 614 may be provided since the first and second main channels 301*a* and 301*b* and the first and second auxiliary channels 301*c* and 301*d* are provided.

In addition, each of the support protrusions 614 may be rotated about 30 to 45 degrees from the lower channel-forming rib 354, which defines the first and second main channel inlets 354*a* and 354*b* and the first and second extension channel inlets 354*c* and 354*d*.

The separation prevention unit 620 includes a main arm location part 622 formed at the lower part of the main arm insertion unit 610 so as to be larger than the main arm insertion unit 610, the lower end of the spray arm holder coupling part 356 contacting the main arm location part 622. The main arm location part 622 is provided on the outer circumferential surface thereof with a grip part 624 for mounting the spray arm holder 600 to the spray arm holder coupling part 356.

The main arm location part 622 is provided on the inner circumferential surface thereof with catching protrusions 622*a* held by the spray arm holder coupling protrusions 356*a* formed on the outer circumferential surface of the spray arm holder coupling part 356. The spray arm holder coupling protrusions 356*a* and the catching protrusions 622*a* are configured so as to be engaged to and disengaged from each other according to the rotation of the spray arm holder 600.

The grip part 624 may be provided on the upper surface thereof with a plurality of friction prevention protrusions 626 for reducing friction with the support surface 516 of the stationary gear unit 500 when the separation prevention unit 620 is rotated while contacting the support surface 516. In some implementations, the grip part 624 may be further provided on the outer circumferential surface thereof with a plurality of catching recesses 624*a* for easy rotation of the spray arm holder 600 when the spray arm holder 600 is mounted.

In some implementations, the main arm insertion unit 610 is provided on the lower surface thereof with a plurality of wear prevention ribs 616 for minimizing contact with the support boss 55 of the spray arm holder location unit 53 to prevent wear when the spray arm holder 600 is inserted into the spray arm holder location unit 53.

In some implementations, the sump insertion unit 630 is provided with a hollow portion communicating with the center of the lower surface of the main arm insertion unit 610 for allowing wash water supplied from the sump to be introduced therethrough. The sump insertion unit 630 is provided at the lower end thereof with an extension part 636 configured to be located on the location rib 57 formed on the spray arm holder location unit 53 of the sump cover 50.

The sump insertion unit 630 is provided at the lower side of the outer circumferential surface thereof with a plurality of sealing ribs 634 protruding toward the inner circumferential surface of the spray arm holder location unit 53. The sump insertion unit 630 is provided at the upper side of the outer circumferential surface thereof with a plurality of distance-maintaining protrusions 632 for maintaining the distance from the inner circumferential surface of the spray arm holder location unit 53.

Figure 22:
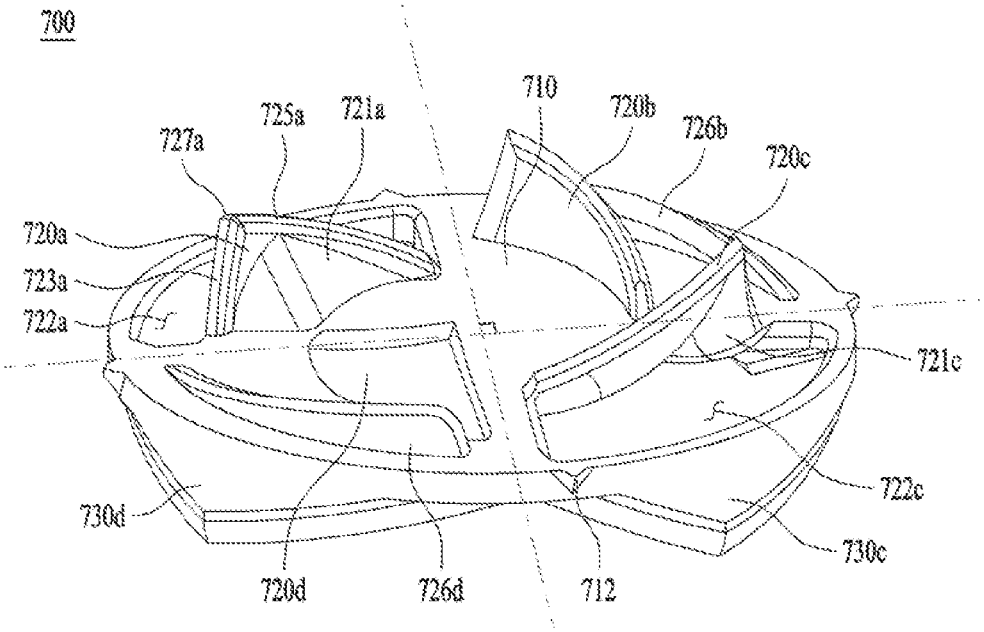
FIGS. 22 and 23 are diagrams illustrating an example channel-switching unit of a dishwasher.
Figure 23:
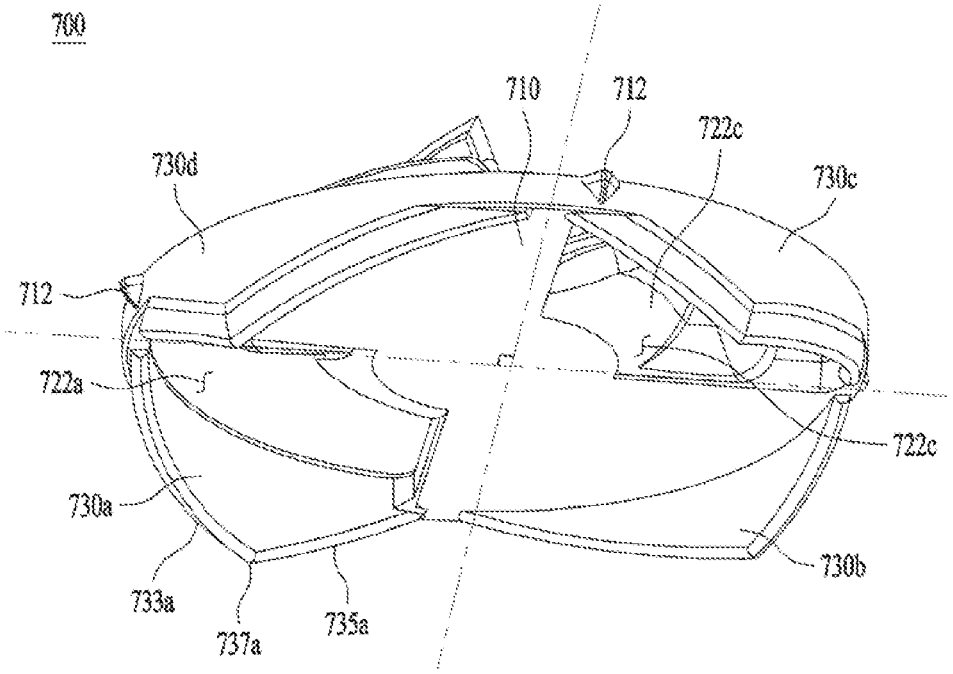
Figure 24:
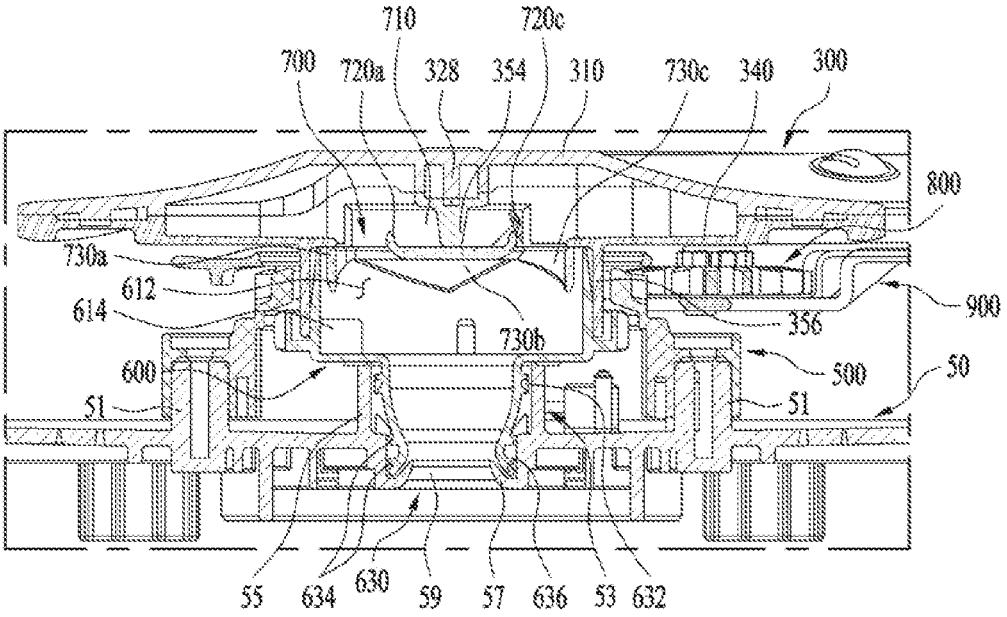
FIG. 24 is a diagram illustrating an example stationary gear unit, an example spray arm holder, and an example channel-switching unit of a dishwasher.

FIGS. 22 and 23 illustrates an example channel-switching unit of a dishwasher. FIG. 24 illustrates an example stationary gear unit, an example spray arm holder, and an example channel-switching unit of a dishwasher.

As shown in FIGS. 22 to 24, the channel-switching unit 700 includes a disc-shaped rotary plate 710 inserted into the valve chamber 612 of the spray arm holder 600, first, second, third, and fourth upper inclined protrusions 720*a*, 720*b*, 720*c*, and 720*d* formed on the upper part of the rotary plate 710 and inserted into the lower channel-forming rib 354 of the main arm lower housing 340 for rotating the rotary plate 710, and first, second, third, and fourth lower inclined protrusions 730*a*, 730*b*, 730*c*, and 730*d* formed on the lower part of the rotary plate 710 and held by the support protrusions 614 formed on the valve chamber 612 of the spray arm holder 600 for rotating the rotary plate 710.

The rotary plate 710 may be received in the valve chamber 612 of the spray arm holder 600, and may be vertically reciprocated in the valve chamber 612 depending on the pressure of the wash water passing through the valve chamber 612.

Consequently, the rotary plate 710 may be formed in the shape of a disc so as to correspond to the sectional shape of the valve chamber 612. The rotary plate 710 is provided on the outer circumferential surface thereof with a plurality of distance-maintaining protrusions 712 for maintaining the distance from the inner circumferential surface of the valve chamber 612 and minimizing friction.

In some implementations, first and second open holes 722*a* and 722*c*, through which wash water passes, may be formed outside the first and third upper inclined protrusions 720*a* and 720*c* of the rotary plate 710. When the upper inclined protrusions 720*a*, 720*b*, 720*c*, and 720*d* are inserted into the lower channel-forming rib 354 of the main arm lower housing 340, the first and second open holes 722*a* and 722*c* may communicate with the first and second main channel inlets 354*a* and 354*b* or the first and second extension channel inlets 354*c* and 354*d* of the main arm lower housing 340.

The first, second, third, and fourth upper inclined protrusions 720*a*, 720*b*, 720*c*, and 720*d* may be disposed so as to correspond to the first and second main channel inlets 354*a* and 354*b* and the first and second extension channel inlets 354*c* and 354*d*, which are defined by the lower channel-forming rib 354 of the main arm lower housing 340.

In addition, the first, second, third, and fourth upper inclined protrusions 720*a*, 720*b*, 720*c*, and 720*d* may be spaced apart from the center of the rotary plate 710 and the outer circumferential surface of the rotary plate 710 by a predetermined distance. The first and second open holes 722*a* and 722*c* may be formed respectively in the outsides of the first and third upper inclined protrusions 720*a* and 720*c*, which face each other, among the first, second, third, and fourth upper inclined protrusions 720*a*, 720*b*, 720*c*, and 720*d*.

In some implementations, first and second rotational inclined surfaces 721*a* and 721*b* are further formed between the first and third upper inclined protrusions 720*a* and 720*c* and the rotary plate 710. The first and second rotational inclined surfaces 721*a* and 721*b* generate rotational resistance such that the channel-switching unit 700 can be rotated by the wash water passing through the first and second open holes 722*a* and 722*c* when the channel-switching unit 700 moves upward and downward.

When wash water is supplied, therefore, the channel-switching unit 700 can be rotated in one direction by the wash water passing through the first and second open holes 722*a* and 722*c*. Even when the supply of wash water is interrupted, the channel-switching unit 700 can be rotated in one direction by the wash water passing through the first and second open holes 722*a* and 722*c* when the channel-switching unit 700 moves downward due to gravity.

In some implementations, the second and fourth upper inclined protrusions 720*b* and 720*d* may be provided on the insides thereof with first and second introduction prevention protrusions 726*a* and 726*b* spaced apart from the second and fourth upper inclined protrusions 720*b* and 720*d* by a predetermined distance for sealing the first and second main channel inlets 354*a* and 354*b* (or the first and second extension channel inlets 354*c* and 354*d*).

When the first and second main channel inlets 354*a* and 354*b* (or the first and second extension channel inlets 354*c* and 354*d*) are opened through the first and second open holes 722*a* and 722*c*, the first and second introduction prevention protrusions 726*a* and 726*b* may be inserted into the first and second extension channel inlets 354*c* and 354*d* (or the first and second main channel inlets 354*a* and 354*b*) to seal the first and second extension channel inlets 354*c* and 354*d* (or the first and second main channel inlets 354*a* and 354*b*).

In addition, each of the first, second, third, and fourth upper inclined protrusions 720*a*, 720*b*, 720*c*, and 720*d* is provided with a first upper inclined surface 723*a* and a second upper inclined surface 725*a*. An upper corner 727*a* is formed between the first and second upper inclined surfaces 723*a* and 725*a*.

The first upper inclined surface 723*a* is formed in the direction in which the channel-switching unit 700 is rotated, and the second upper inclined surface 725*a* is formed in a direction opposite the direction in which the channel-switching unit 700 is rotated. The first and second upper inclined surfaces 723*a* and 725*a* have different inclinations. The angle of inclination of the first upper inclined surface 723*a* may be larger than that of the second upper inclined surface 725*a*.

In some implementations, the first, second, third, and fourth lower inclined protrusions 730*a*, 730*b*, 730*c*, and 730*d* are located on the support protrusions 614 provided on the valve chamber 612 to rotate the rotary plate 710. The first, second, third, and fourth lower inclined protrusions 730*a*, 730*b*, 730*c*, and 730*d* may be arranged about the rotary plate 710 at intervals of 90 degrees.

Each of the first, second, third, and fourth lower inclined protrusions 730*a*, 730*b*, 730*c*, and 730*d* is provided with first and second lower inclined surfaces 733*a* and 735*a* and a lower corner 737*a* formed between the first and second lower inclined surfaces 733*a* and 735*a*.

The first lower inclined surface 733*a* is formed in the direction in which the channel-switching unit 700 is rotated, and the second lower inclined surface 735*a* is formed in a direction opposite the direction in which the channel-switching unit 700 is rotated. The first and second lower inclined surfaces 733*a* and 735*a* have different inclinations. The angle of inclination of the first lower inclined surface 733*a* may be smaller than that of the second lower inclined surface 735*a*.

Figure 25:
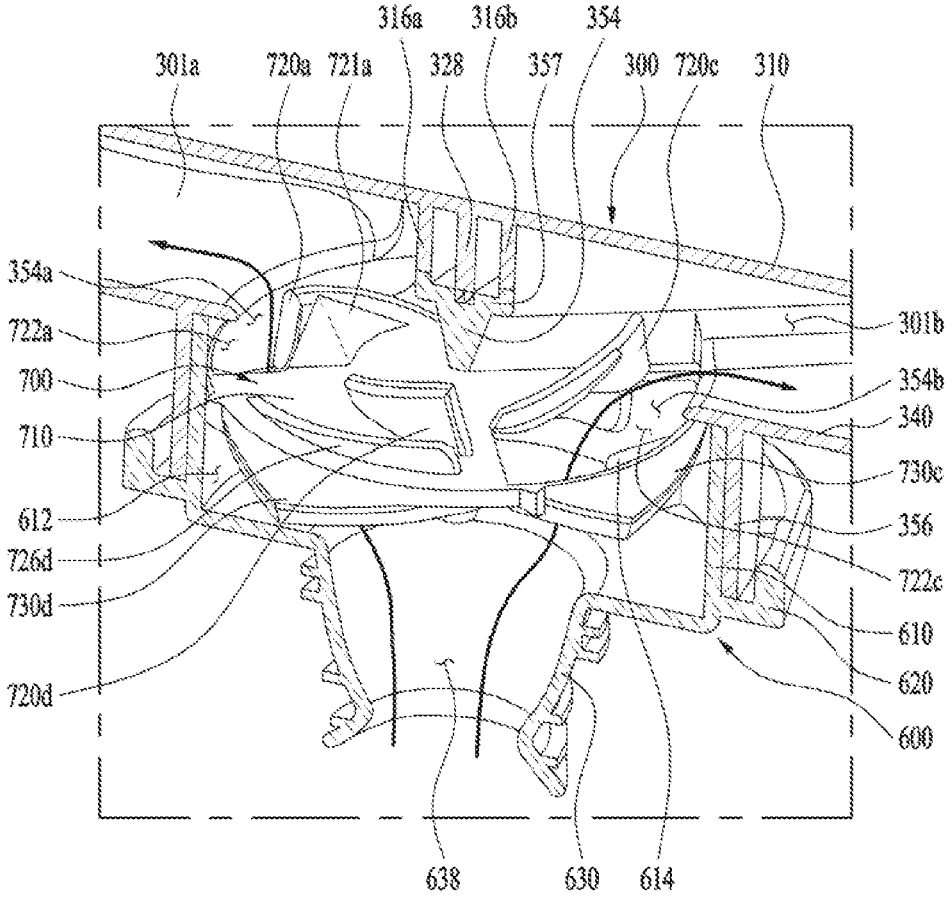
FIGS. 25 and 26 are diagrams illustrating an example operation of a channel-switching unit of a dishwasher.
Figure 26:
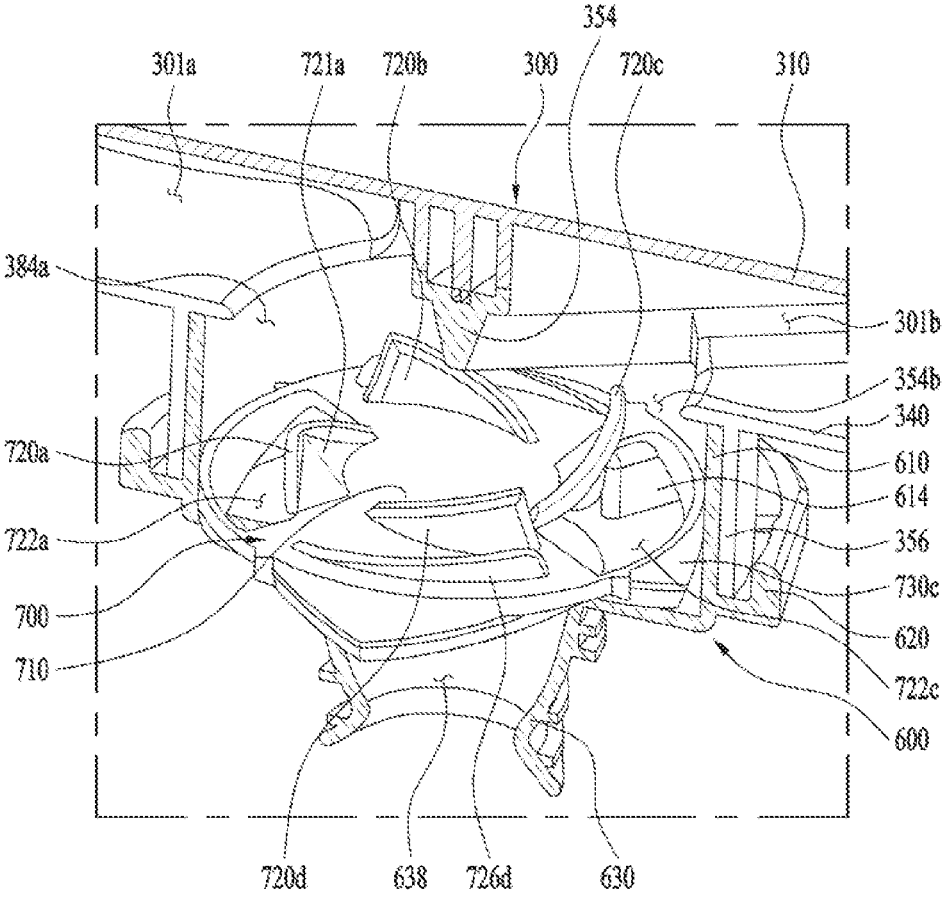

FIGS. 25 and 26 illustrate an example operation of a channel-switching unit of a dishwasher.

As shown in FIGS. 25 and 26, when wash water is supplied through an introduction part 638 formed in the sump insertion unit 630 of the spray arm holder 600, the channel-switching unit 700, which is located in the valve chamber 612, is moved upward by the pressure of the supplied wash water.

As the channel-switching unit 700 is moved upward, the first, second, third, and fourth upper inclined protrusions 720*a*, 720*b*, 720*c*, and 720*d* are inserted respectively into the first and second main channel inlets 354*a* and 354*b* and the first and second extension channel inlets 354*c* and 354*d* of the lower channel-forming rib 354 formed in the main arm lower housing 340.

At this time, the wash water introduced into the introduction part 638 may be introduced into the first main channel inlet 354*a* through the first open hole 722*a*, and the wash water that has passed through the second open hole 722*c* may be introduced into the second main channel inlet 354*b*.

In some implementations, the first extension channel inlet 354*c* and the second extension channel inlet 354*d* are closed by the rotary plate 710. As a result, the introduction of wash water through the first and second extension channel inlets 354*c* and 354*d* is interrupted.

In some implementations, when the supply of wash water is interrupted, the pressure of the wash water to move the channel-switching unit 700 upward is removed, and the channel-switching unit 700 moves downward due to gravity. At this time, wash water passes through the first and second open holes 722*a* and 722*c* of the channel-switching unit 700, which moves downward, and the channel-switching unit 700 is rotated by a predetermined angle in one direction by the first and second rotational inclined surfaces 721*a* and 721*b* formed at the first and second open holes 722*a* and 722*c*.

As a result, the first, second, third, and fourth lower inclined protrusions 730*a*, 730*b*, 730*c*, and 730*d* provided at the channel-switching unit 700 are further rotated by a predetermined angle in one direction while sliding along the support protrusions 614 provided at the spray arm holder 600 and are then held by the support protrusions 614.

When the channel-switching unit 700 moves downward, the channel-switching unit 700 is rotated by a predetermined angle in one direction while the first, second, third, and fourth lower inclined protrusions 730*a*, 730*b*, 730*c*, and 730*d* are held by the support protrusions 614.

At this time, the channel-switching unit 700 may be rotated about 90 degrees. The reason for this is that the first and second lower inclined surfaces 733*a* and 735*a* provided at the first, second, third, and fourth lower inclined protrusions 730*a*, 730*b*, 730*c*, and 730*d* occupy 90 degrees of the circumference of the rotary plate 710.

Although not shown, when wash water is introduced through the introduction part 638 formed in the sump insertion unit 630 after the channel-switching unit 700 has moved downward, the channel-switching unit 700 is moved upward, with the result that the first, second, third, and fourth upper inclined protrusions 720*a*, 720*b*, 720*c*, and 720*d* are inserted respectively into the first and second main channel inlets 354*a* and 354*b* and the first and second extension channel inlets 354*c* and 354*d* of the lower channel-forming rib 354 formed in the main arm lower housing 340.

As wash water is supplied, the channel-switching unit 700 is moved upward by the pressure of the supplied wash water, and the wash water passes through the first and second open holes 722*a* and 722*c* of the channel-switching unit 700, which is moved upward. The wash water passing through the first and second open holes 722*a* and 722*c* applies pressure to the first and second rotational inclined surfaces 721*a* and 721*b* formed at the first and second open holes 722*a* and 722*c*, and the channel-switching unit 700 is rotated by a predetermined angle in one direction by the pressure of the wash water applied to the first and second rotational inclined surfaces 721*a* and 721*b*.

At this time, the first, second, third, and fourth upper inclined protrusions 720*a*, 720*b*, 720*c*, and 720*d* of the channel-switching unit 700 are inserted into the first and second main channel inlets 354*a* and 354*b* and the first and second extension channel inlets 354*c* and 354*d* of the channel-forming rib 335*a*, whereby the channel-switching unit 700 is further rotated by a predetermined angle in one direction.

At this time, the channel-switching unit 700 may be rotated about 90 degrees. The reason for this is that the first and second upper inclined surfaces 723*a* and 725*a* provided at the first, second, third, and fourth upper inclined protrusions 720*a*, 720*b*, 720*c*, and 720*d* occupy 90 degrees of the circumference of the rotary plate 710.

At this time, the first and second open holes 722*a* and 722*c* of the channel-switching unit 700 communicate with the first and second extension channel inlets 354*c* and 354*d*, rather than the first and second main channel inlets 354*a* and 354*b*. As a result, the wash water introduced through the introduction part 638 may be introduced into the first extension channel inlet 354*c* through the first open hole 722*a*, and the wash water that has passed through the second open hole 722*c* may be introduced into the second extension channel inlet 354*d*.

In some implementations, the first main channel inlet 354*a* and the second main channel inlet 354*b* are closed by the rotary plate 710. As a result, the introduction of wash water through the first and second main arms 300*a* and 300*b* is interrupted.

The water supply pump provided in the sump may intermittently supply wash water. Specifically, the water supply pump may supply wash water to the spray arm holder 600 for a predetermined time and may interrupt the supply of wash water for a predetermined time.

That is, the sump alternately supplies and interrupts the supply of wash water. Consequently, the channel-switching unit 700 is rotated while repeatedly moving upward and downward, whereby the first and second main channel inlets 354*a* and 354*b* and the first and second extension channel inlets 354*c* and 354*d* may be alternately opened and closed.

Figure 27:
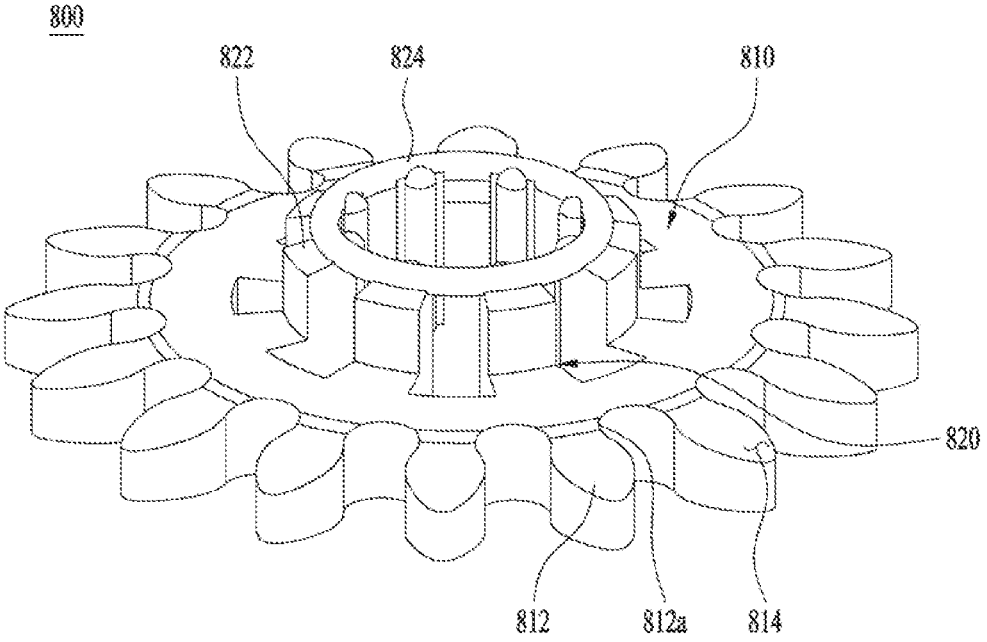
FIGS. 27 to 30 are diagrams illustrating an example eccentric gear unit of a dishwasher.
Figure 28:
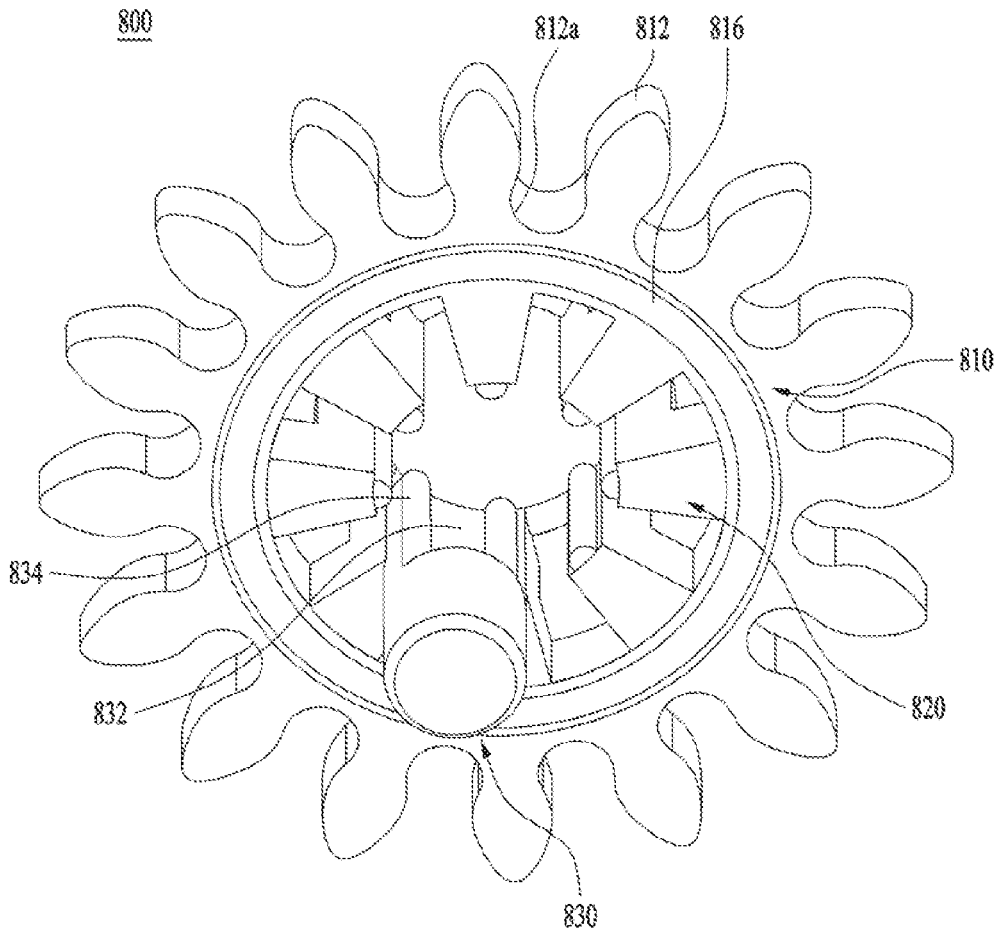
Figure 29:
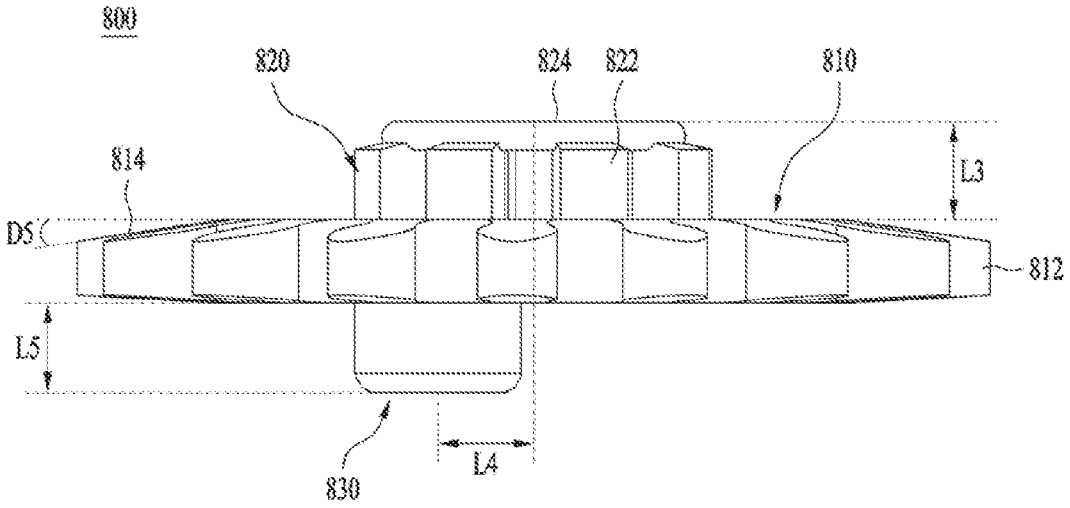

FIGS. 25 and 26 illustrate an example operation of a channel-switching unit of a dishwasher. FIGS. 27 to 29 illustrate an example eccentric gear unit of a dishwasher.

As shown in FIGS. 27 to 29, the eccentric gear unit 800 includes a rim part 810 having a plurality of second gear teeth 812 formed on the outer circumferential surface thereof, a shaft support protrusion 820, in which the gear shaft 347*b* is received, and an eccentric protrusion 830 inserted into the link member 900 for reciprocating the link member 900.

The rim part 810 is formed in a ring shape, and the second gear teeth 812 are formed along the outer circumferential surface of the rim part 810. The rim part 810 is provided on the lower surface thereof with a protruding friction prevention rib 816 for minimizing friction with the eccentric gear receiving part 940 of the link member 900, which supports the eccentric gear unit 800.

In some implementations, the second gear teeth 812 are provided on the upper surfaces thereof with inclined surfaces 814 inclined downward toward the outside of the rim part 810 by a predetermined angle D5. That is, when washing is performed using wash water, the wash water and foreign matter may be introduced to the upper parts of the second gear teeth 812. In order to discharge the introduced wash water and foreign matter, therefore, the second gear teeth 812 may be provided on the upper surfaces thereof with inclined surfaces 814 inclined downward toward the outside of the rim part 810 by a predetermined angle D5.

A plurality of shaft support protrusions 820 protrudes from the inner circumferential surface of the rim part 810 constituting the eccentric gear unit 800 to support the outer circumferential surface of the gear shaft 347*b* formed at the second lower main arm 341*b* of the main arm lower housing 340. The shaft support protrusions 820 may be disposed in line contact with the gear shaft 347*b*, whereby friction with the gear shaft 347*b* is relatively reduced.

The shaft support protrusions 820 protrude from the inner circumferential surface of the rim part 810 of the eccentric gear unit 800. That is, a plurality of spaces is provided between the respective shaft support protrusions 820. The shaft support protrusions 820 may be elastically deformed in the spaces between the respective shaft support protrusions 820. That is, when external force is applied to the rim part 810 of the eccentric gear unit 800, the shaft support protrusions 820 may be deformed in adjacent spaces.

In some implementations, a protruding part 822 for securing the state in which the gear shaft 347*b* is supported is formed on the end of each of the shaft support protrusions 820. In the case in which the gear shaft 347*b* is supported by the shaft support protrusions 820, the eccentric gear unit 800 may move due to the gap between the shaft support protrusions 820 when the eccentric gear unit 800 is rotated. In order to secure the state in which the gear shaft 347*b* is supported, therefore, the protruding parts 822 may extend to a predetermined height.

The protruding parts 822 may serve to secure the installation position of the eccentric gear unit 800. The eccentric gear unit 800 is installed at the lower part of the second lower main arm 341*b*, and the separation of the eccentric gear unit 800 is prevented by the link member 900.

In some implementations, the link member 900 is located at the lower part of the second lower main arm 341*b*. The installation position of the eccentric gear unit 800 must be lowered by at least the thickness of the link member 900, or the thickness of the eccentric gear unit 800 must be increased. Consequently, the protruding parts 822 are formed to have a height L3 larger than the thickness of the link member, whereby the installation position of the eccentric gear unit 800 may be secured without increasing the thickness of the eccentric gear unit 800.

In addition, a shaft ring 824 disposed in line contact with the gear shaft 347*b* may be further formed on the end of each of the protruding parts 822. The shaft rings 824 are arranged in the circumferential direction. In the case in which the protruding parts 822 are formed on the shaft support protrusions 820, the state in which the gear shaft 347*b* is supported may be somewhat secured. However, the protruding parts 822 extend from the shaft support protrusions 820, and the eccentric gear unit 800 may move due to the gap between the shaft support protrusions 820 and the protruding parts 822. In order to further secure the state in which the gear shaft 347*b* is supported, therefore, the shaft rings 824 may be further provided.

In some implementations, the eccentric protrusion 830 extends from the lower part of the eccentric gear unit 800 in the state of being spaced apart from the shaft of the eccentric gear unit 800 by a predetermined distance L4. In addition, the eccentric protrusion 830 is inserted into the eccentric gear receiving part 940 of the link member 900, in which the eccentric gear unit 800 is received. Consequently, the eccentric protrusion 830 may have a height L5 greater than at least the thickness of the eccentric gear receiving part 940.

When the eccentric gear unit 800 rotates and revolves along the outer circumferential surface of the stationary gear unit 500 in the state of being engaged with the stationary gear unit 500, the eccentric protrusion 830 converts the rotational force of the eccentric gear unit 800 into linear reciprocation and transfers the linear reciprocation to the link member 900.

The distance L4 between the eccentric protrusion 830 and the shaft is related to the reciprocation distance of the link member 900 and to the rotational angle of the first and second auxiliary arms 400*a* and 400*b* reciprocably rotated by the link member 900. That is, the greater the distance between the eccentric protrusion 830 and the shaft, the greater the reciprocation distance of the link member 900. As the reciprocation distance of the link member 900 is increased, the rotational angle of the first and second auxiliary arms 400*a* and 400*b* may be increased.

The eccentric protrusion 830 may protrude from the shaft support protrusions 820 of the eccentric gear unit 800 in a direction opposite the protruding direction of the protruding parts 822. In addition, in the case in which the eccentric position of the eccentric protrusion 830 overlaps the insertion region of the gear shaft 347*b* supported by the shaft support protrusions 820, a shaft recess 832, into which the gear shaft 347*b* is inserted, may be further formed in the inside of the eccentric protrusion 830 (i.e. in the region into which the gear shaft 347*b* is inserted).

In the same manner as the shaft support protrusions 820, the shaft recess 832 may be further provided with shaft recess support protrusions 834 disposed in line contact with the outer circumferential surface of the gear shaft 347*b* for preventing friction with the outer circumferential surface of the gear shaft 347*b*.

In some implementations, the rim part 810, the shaft support protrusions 820, and the eccentric protrusion 830 constituting the eccentric gear unit 800 may be integrally formed of a synthetic resin material by injection molding. Alternatively, at least one of the rim part 810, the shaft support protrusions 820, and the eccentric protrusion 830 constituting the eccentric gear unit 800 may be separately formed and may then be assembled with the other components.

Figure 30:
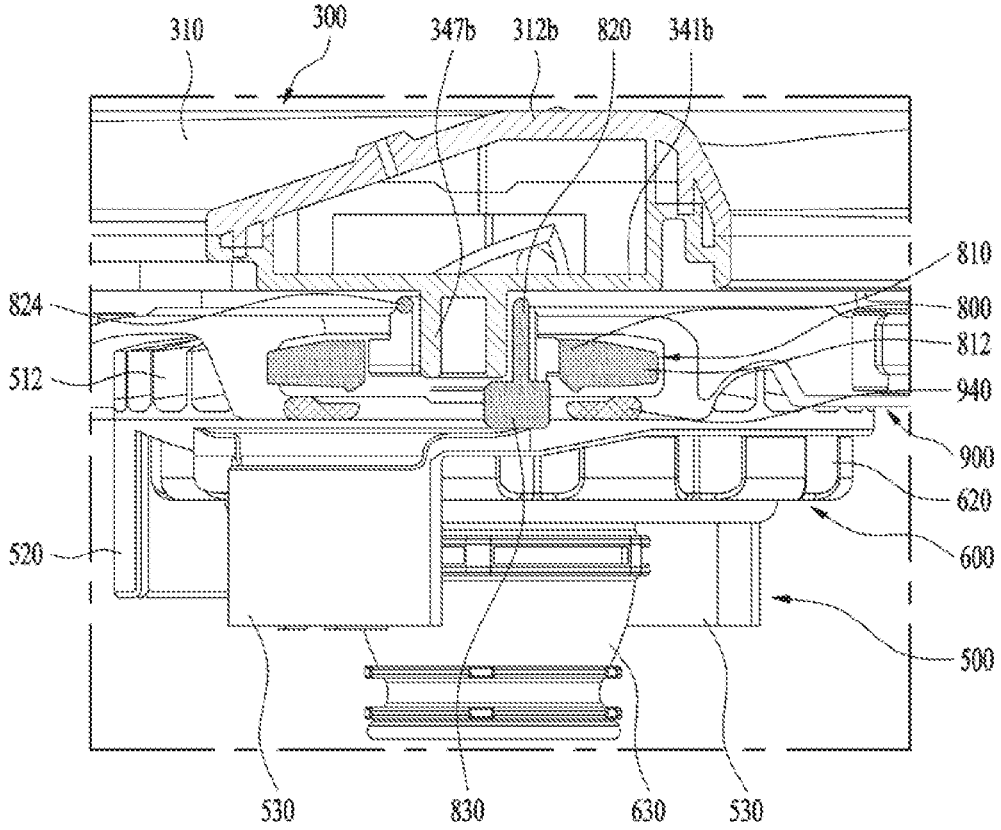
Figure 31:
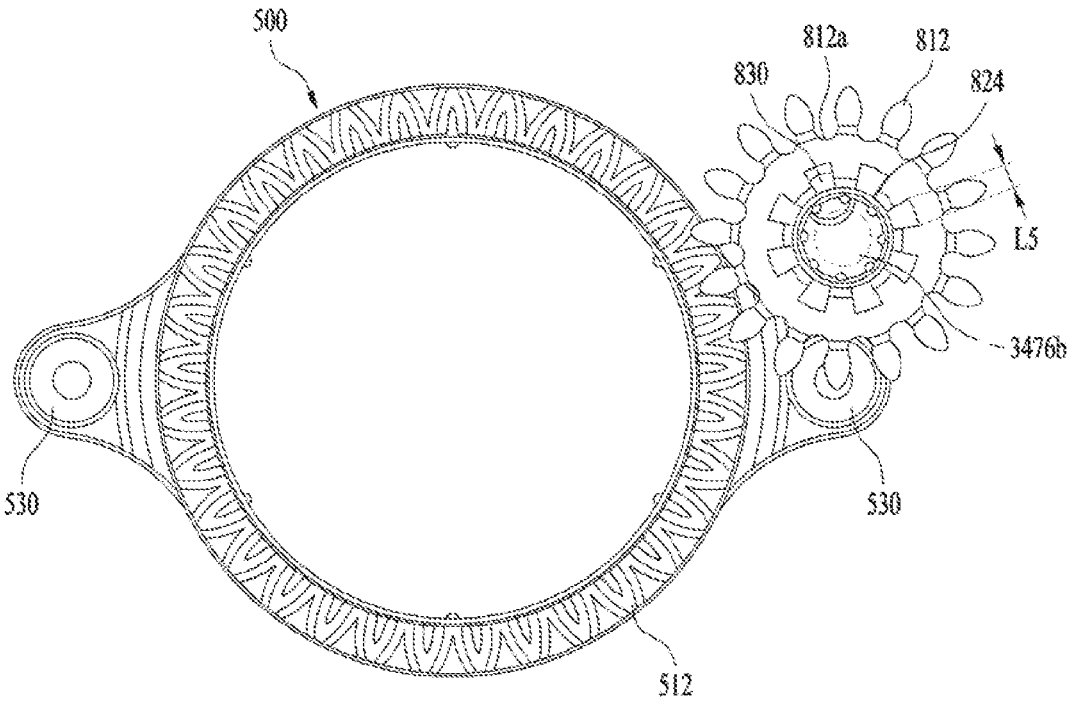
FIG. 31 is a diagram illustrating an example stationary gear unit and an example eccentric gear unit of a dishwasher.

FIG. 30 illustrates an example eccentric gear unit of a dishwasher. FIG. 31 illustrates an example stationary gear unit and an example eccentric gear unit of a dishwasher.

As shown in FIGS. 30 and 31, the eccentric gear unit 800 is rotatably inserted into the gear shaft 347*b* formed at the second lower main arm 341*b* of the main arm lower housing 340, and is supported by the eccentric gear receiving part 940 of the link member 900. The second gear teeth 812 of the eccentric gear unit 800 are engaged with the first gear teeth 512 of the stationary gear unit 500.

In some implementations, the number of second gear teeth 812 formed at the eccentric gear unit 800 and the number of the first gear teeth 512 formed at the stationary gear unit 500 may be related to the rotation of the spray arm 200 and the rotation of the first and second auxiliary arms 400*a* and 400*b*.

In the case in which the first gear teeth 512 of the stationary gear unit 500 and the second gear teeth 812 of the eccentric gear unit 800 have a specific relationship, the spray arm 200 and the first and second auxiliary arms 400*a* and 400*b* may be rotated in a specific cycle depending on the relationship between the first and second gear teeth 512 and 812.

That is, when the first and second gear teeth 512 and 812 have the relationship, the rotation of the first and second auxiliary arms 400*a* and 400*b* may be uniformly repeated depending on the rotational position of the spray arm 200. Consequently, the wash water sprayed through the first and second auxiliary arms 400*a* and 400*b* may be repeatedly sprayed to a constant position. That is, the spray pattern of the wash water sprayed through the first and second auxiliary arms 400*a* and 400*b* may be uniformly repeated.

In this case, the spray pattern of the wash water sprayed through the spray arm 200 and the spray pattern and the spray region of the wash water sprayed through the first and second auxiliary arms 400*a* and 400*b* are repeated in a specific cycle, with the result that the wash water sprayed through the first and second auxiliary arms 400*a* and 400*b* is sprayed to a constant position.

That is, in the case in which the wash water sprayed through the first and second auxiliary arms 400*a* and 400*b* washes only a specific region, the spray region of the wash water sprayed through the first and second auxiliary arms 400*a* and 400*b* is limited, whereby the washing force of the wash water sprayed through the first and second auxiliary arms 400*a* and 400*b* is reduced. In addition, in the case in which the spray pattern of the wash water sprayed through the first and second auxiliary arms 400*a* and 400*b* is uniform, the spray range of the wash water is uniform, whereby the washing force of the dishwasher 1 may be reduced.

Consequently, it is necessary to vary the spray pattern of the wash water sprayed through the first and second auxiliary arms 400*a* and 400*b*. To this end, the number of first gear teeth 512 of the stationary gear unit 500 and the number of second gear teeth 812 of the eccentric gear unit 800 may be set so as to have a relative prime relationship. In the case in which the number of first gear teeth 512 of the stationary gear unit 500 and the number of second gear teeth 812 of the eccentric gear unit 800 are set so as to have a relative prime relationship, the rotation pattern cycle of the stationary gear unit 500 and the eccentric gear unit 800 is longer than the multiple relationship between the first and second gear teeth 512 and 812, whereby the spray pattern of the wash water sprayed through the first and second auxiliary arms 400*a* and 400*b* may be varied.

In some implementations, the second gear teeth 812 of the eccentric gear unit 800 have a smaller diameter than the first gear teeth 512 of the stationary gear unit 500, and may be worn due to friction with the first gear teeth 512. In order to prevent wear of the second gear teeth 812 due to friction, therefore, undercut recesses 812*a* may be further formed in the second gear teeth 812.

In addition, in the case in which the stationary gear unit 500, having the first gear teeth 512, and the eccentric gear unit 800, having the second gear teeth 812, are made of the same material, both the stationary gear unit 500 and the eccentric gear unit 800 may be worn due to friction therebetween.

In this case, it is difficult to maintain the stationary gear unit 500 and the eccentric gear unit 800. For this reason, the stationary gear unit 500, having the first gear teeth 512, and the eccentric gear unit 800, having the second gear teeth 812, may be made of different materials. The stationary gear unit 500 may be made of a harder material than the eccentric gear unit 800.

In some implementations, foreign matter generated during washing may be caught between the first gear teeth 512 of the stationary gear unit 500 and the second gear teeth 812 of the eccentric gear unit 800, whereby the rotation of the eccentric gear unit 800 may be impossible. When the rotation of the eccentric gear unit 800 is impossible, the rotation of the spray arm 200 may be limited by the eccentric gear unit 800 in the state in which the stationary gear unit 500 and the eccentric gear unit 800 are engaged with each other.

In the eccentric gear unit 800, the gear shaft 347*b* is supported by the shaft support protrusions 820. The shaft support protrusions 820 are spaced apart from each other by a distance L5, and therefore each of the shaft support protrusions 820 may be elastically deformed in a space corresponding to the distance L5. When foreign matter is caught between the first gear teeth 512 of the stationary gear unit 500 and the second gear teeth 812 of the eccentric gear unit 800, therefore, external force is applied to the rim part 810 of the eccentric gear unit 800 due to the volume of the foreign matter. As a result, the shaft support protrusions 820 inside the rim part 810 are elastically deformed, whereby the eccentric gear unit 800 may be rotated along the stationary gear unit 500 despite the foreign matter caught between the first and second gear teeth.

Figure 32:
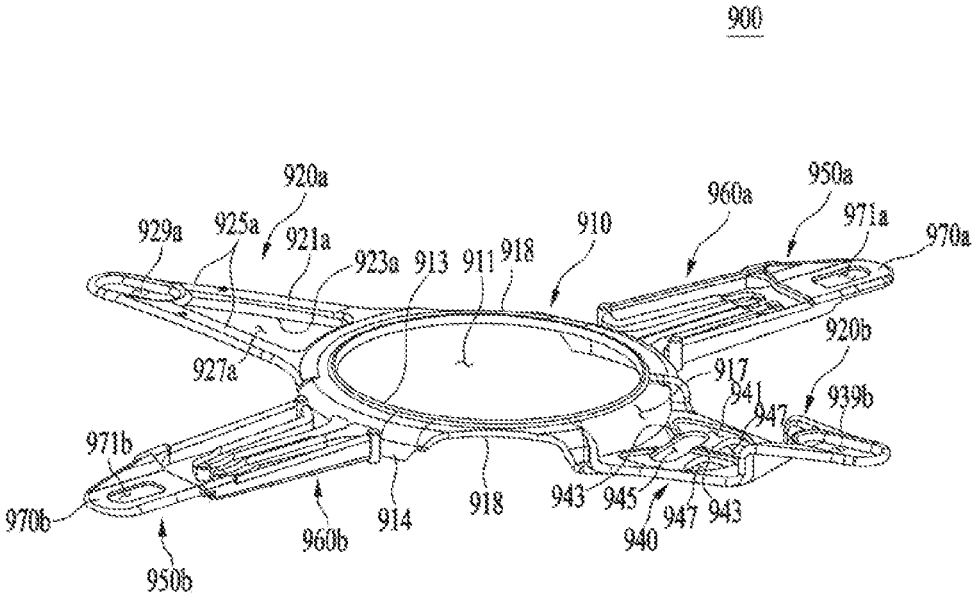
FIGS. 32 to 34 are diagrams illustrating an example link member of a dishwasher.
Figure 33:
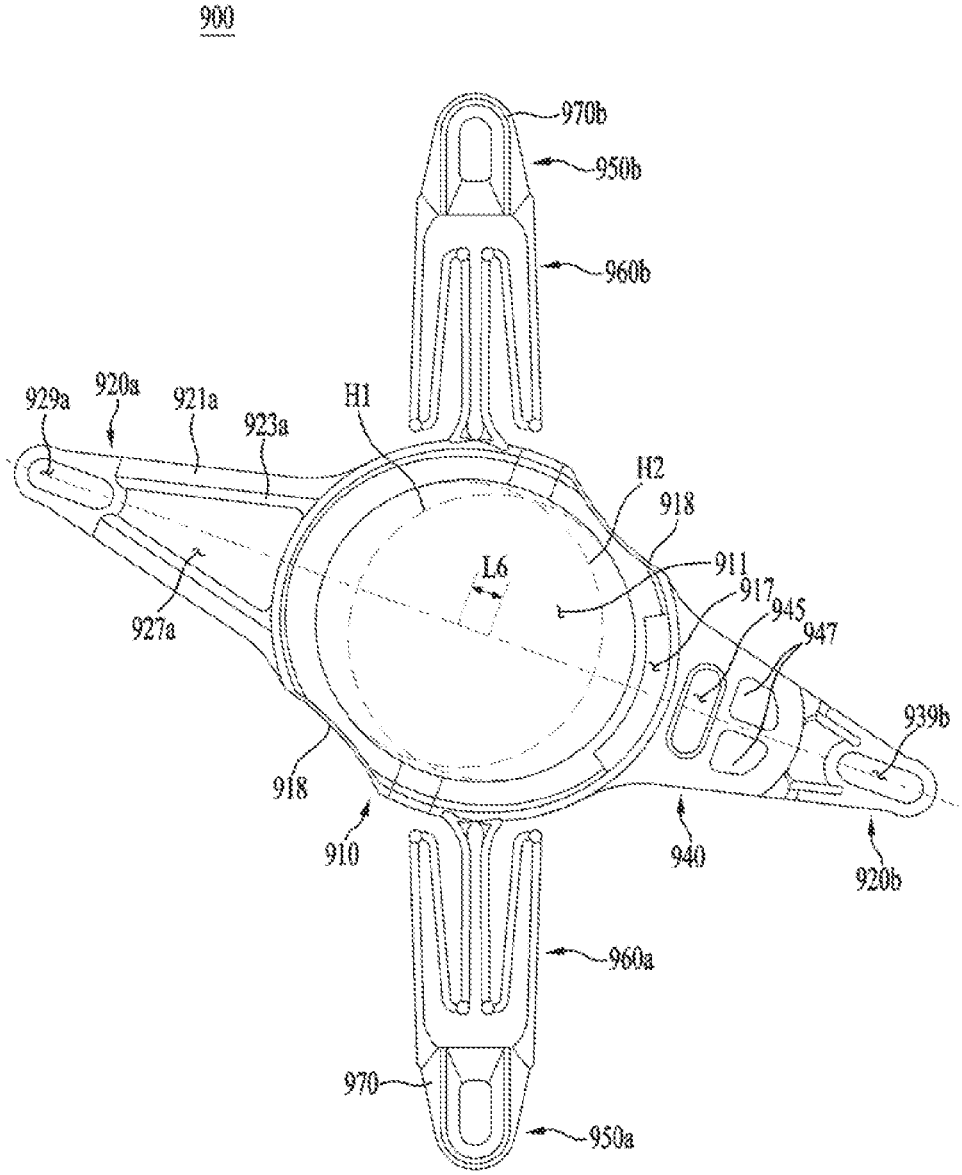
Figure 34:
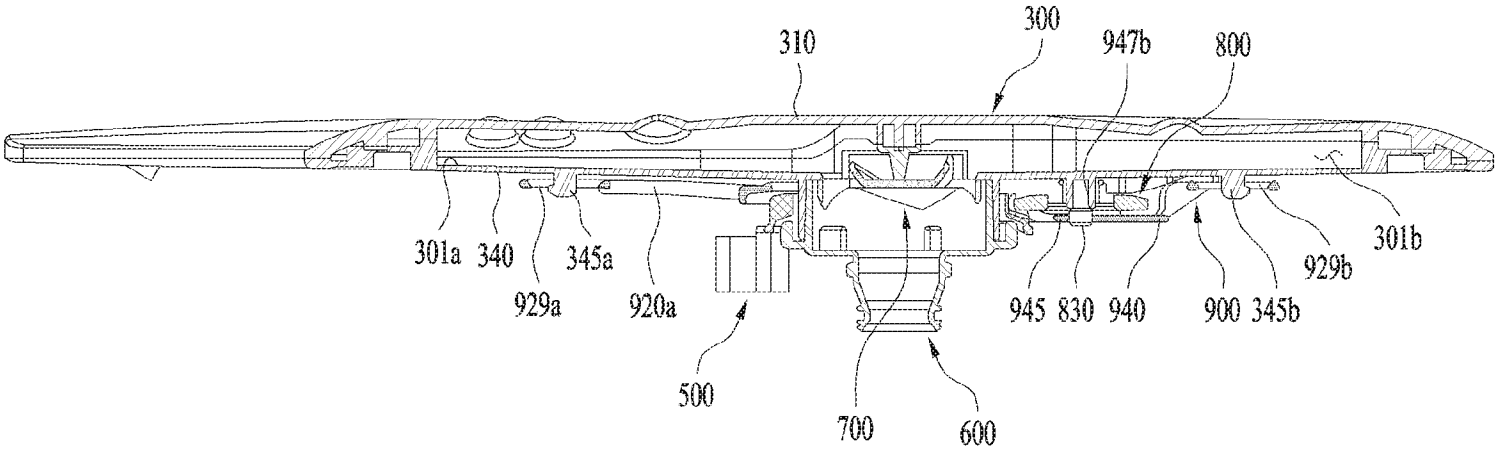

FIGS. 32 to 34 illustrate an example link member of a dishwasher.

As shown in FIGS. 32 to 34, the link member 900 includes a rim-shaped body 910 having a slot-shaped hole, into which the spray arm holder coupling part 356 of the main arm lower housing 340 is movably inserted, a first main link 920*a* extending from the rim-shaped body 910 toward the first main arm 300*a* so as to be movably coupled to the first main arm 300*a*, a second main link 920*b* extending from the rim-shaped body 910 toward the second main arm 300*b* so as to be movably coupled to the second main arm 300*b* and to be connected to the eccentric gear unit 800, a first auxiliary link 950*a* extending toward the first extension unit 300*c* so as to be connected to the first auxiliary arm 400*a*, and a second auxiliary link 950*b* extending toward the second extension unit 300*d* so as to be connected to the second auxiliary arm 400*b*.

The rim-shaped body 910 is provided therein with a rectangular hole 911, into which the spray arm holder coupling part 356 is inserted. The width of the rectangular hole 911 corresponds to the diameter of the spray arm holder coupling part 356 and the length of the rectangular hole 911 corresponds to the movement distance of the link member 900 such that the link member 900 is movable relative to the spray arm holder 600. The rectangular hole 911 may be defined by a hole H2 having a center that is spaced apart, by a movement distance L6 of the link member 900, from the center of a hole H1 that becomes slightly larger than the spray arm holder coupling part 356 according to the movement distance of the link member.

In some implementations, the rectangular hole 911 is provided on the inner circumferential surface thereof with an upward reinforcement rib 913 for increasing the strength of the rim-shaped body 910. The upward reinforcement rib 913 extends in the upward direction of the rim-shaped body 910. In addition, the rectangular hole 911 is provided on the outer circumferential surface thereof with a downward reinforcement rib 914 for increasing the strength of the rim-shaped body 910. The downward reinforcement rib 914 extends in the downward direction of the rim-shaped body 910.

The upward reinforcement rib 913 and the downward reinforcement rib 914 increase the strength of the rim-shaped body 910, and at the same time discharge wash water and foreign matter introduced to the upper part of the link member 900 out of the rim-shaped body 910.

That is, wash water and foreign matter introduced to the upper part of the link member 900 is prevented from being introduced to the spray arm holder coupling part 356 by the upward reinforcement rib 913, which protrudes upward from the inside of the rim-shaped body 910, and is guided to the lower side of the link member 900 along the downward reinforcement rib 914, which protrudes downward from the outside of the rim-shaped body 910.

The downward reinforcement rib 914 may be formed by extending the first and second main links 920*a* and 920*b* and the first and second auxiliary links 950*a* and 950*b*. Consequently, the downward reinforcement rib 914 may be higher than the first and second main links 920*a* and 920*b* and the first and second auxiliary links 950*a* and 950*b* such that the first and second main links 920*a* and 920*b* and the first and second auxiliary links 950*a* and 950*b* can be formed.

In some implementations, the rim-shaped body 910 is provided in opposite sides of the outer circumferential surface thereof with cut parts 918 for preventing the link member 900 from being exposed to the outside of the spray arm 200. For example, the cut parts 918 may be formed between the first main arm 300*a* and the first extension unit 300*c* and between the second main arm 300*b* and the second extension unit 300*d*.

That is, the angle between the first main arm 300*a* and the first extension unit 300*c* and between the second main arm 300*b* and the second extension unit 300*d* is an obtuse angle D2 (see FIG. 5), with the result that the link member 900 at the lower part of the spray arm 200 may be easily exposed to the upper part of the spray arm 200. However, the position of the cut parts 918 is not limited. The cut parts 918 may be formed at different positions as needed.

The first main link 920*a* may be provided with a first extension plate 921*a* extending from the downward reinforcement rib 914 of the rim-shaped body 910 toward the first main arm 300*a*, a first drainage hole 927*a* formed in the first extension plate 921*a*, and a first moving slot 929*a* formed in the end of the first extension plate 921*a* so as to be movably coupled to the first guide protrusion 345*a* of the first lower main arm 341*a*.

The width of the first extension plate 921*a* is smaller than that of the first main arm 300*a*. The first extension plate 921*a* is provided on the inner circumferential surface thereof (i.e. on the outer circumferential surface of the first drainage hole 927*a*) with a first reinforcement rib 923*a* extending in the downward direction of the first extension plate 921*a*. The first extension plate 921*a* is provided on the upper surface thereof with a plurality of first wear prevention ribs 925*a* for preventing friction with the first lower main arm 341*a*.

In some implementations, when wash water and foreign matter are introduced to the upper part of the first extension plate 921*a*, the first reinforcement rib 923*a* also serves to guide the wash water and foreign matter to the lower side of the first extension plate 921*a*.

The first moving slot 929*a* extends in a direction parallel to the reciprocation direction of the link member 900. The length of the first moving slot 929*a* may be greater than the reciprocation distance of the link member 900.

The second main link 920*b* may be provided with a second extension plate 921*b* extending from the downward reinforcement rib 914 of the rim-shaped body 910 toward the second main arm 300*b* and a second moving slot 939*b* formed in the end of the eccentric gear receiving part 940, recessed downward from the middle part of the second extension plate 921*b* for receiving the eccentric gear unit 800, and the end of the second extension plate 921*b* so as to be movably coupled to the second guide protrusion 345*b* of the second lower main arm 341*b*.

The width of the second extension plate 921*b* is smaller than that of the second main arm 300*b*. The eccentric gear receiving part 940 is formed in the second extension plate 921*b*

The second moving slot 939*b* extends in a direction parallel to the reciprocation direction of the link member 900. The length of the second moving slot 939*b* may be greater than the reciprocation distance of the link member 900.

In some implementations, the downward reinforcement rib 914, at which the second extension plate 921*b* is formed, may be provided with a rotary gear insertion slot 917, through which the eccentric gear unit 800 received in the eccentric gear receiving part 940 is exposed to the stationary gear unit 500. The eccentric gear receiving part 940 may extend from the lower side of the downward reinforcement rib 914 toward the second main arm 300*b*.

The eccentric gear receiving part 940 may have a depth greater than at least the height of the eccentric gear unit 800 excluding the eccentric protrusion 830 such that at least the eccentric gear unit 800 can be received in the eccentric gear receiving part 940.

In addition, the eccentric gear receiving part 940 is provided in the upper surface thereof with a recessed part 941 for preventing direct contact with the eccentric gear unit 800. At least three wear prevention ribs 943 configured to contact the friction prevention rib 816 of the eccentric gear unit 800 may protrude from the recessed part 941.

The recessed part 941 of the eccentric gear receiving part 940 is provided with an eccentric protrusion insertion slot 945, into which the eccentric protrusion 830 of the eccentric gear unit 800 is inserted, and a second drainage hole 947 for discharging wash water and foreign matter introduced into the eccentric gear unit 800 and the eccentric gear receiving part 940.

The eccentric protrusion insertion slot 945 extends in a direction perpendicular to the movement direction of the link member. When the eccentric gear unit 800 inserted into the gear shaft 347*b* is rotated, therefore, the eccentric protrusion 830 of the eccentric gear unit 800 applies external force to the eccentric protrusion insertion slot 945 in a direction parallel to the first and second moving slots 929*a* and 939*b*, whereby the link member 900 may be reciprocated.

The eccentric protrusion insertion slot 945 is formed so as to be larger than at least the rotational radius of the eccentric protrusion 830. The direction in which the eccentric protrusion insertion slot 945 is formed may be differently set depending on the movement distance of the link member 900. That is, in the case in which the direction in which the eccentric protrusion insertion slot 945 is formed is perpendicular to the movement distance of the link member 900, the link member may have the largest reciprocation distance.

In some implementations, the centers of the rectangular hole 911 of the rim-shaped body 910, the first moving slot 929*a* of the first main link 920*a*, the second moving slot 939*b* of the second main link 920*b*, and the eccentric protrusion insertion slot 945 of the eccentric gear receiving part 940 may be arranged in a straight line. The reason for this is that the link member 900 may be most efficiently reciprocated by the eccentric gear unit 800.

The first auxiliary link 950*a* extends toward the first extension unit 300*c* and is coupled to the turning protrusion 425*a* formed on the lower part of the first auxiliary arm 400*a*, which is rotatably coupled to the first extension unit 300*c*. The first auxiliary link 950*a* may be provided with a first elastic shock-absorbing unit 960*a* extending from the downward reinforcement rib 914 of the rim-shaped body 910 toward the first extension unit 300*c* and a first auxiliary arm coupling unit 970*a* formed at the end of the first elastic shock-absorbing unit 960*a* so as to be fastened to the turning protrusion 425*a*.

In addition, the second auxiliary link 950*b* extends toward the second extension unit 300*d* and is coupled to the turning protrusion 425*a* formed on the lower part of the second auxiliary arm 400*b*, which is rotatably coupled to the second extension unit 300*d*. The second auxiliary link 950*b* may be provided with a second elastic shock-absorbing unit 960*b* extending from the downward reinforcement rib 914 of the rim-shaped body 910 toward the second extension unit 300*d* and a second auxiliary arm coupling unit 970*b* formed at the end of the second elastic shock-absorbing unit 960*b* so as to be fastened to the turning protrusion 425*a*.

In some implementations, the rim-shaped body 910, the first and second main links 920*a* and 920*b*, and the first and second auxiliary links 950*a* and 950*b* constituting the link member 900 may be separately manufactured and then assembled. In some other implementations, the rim-shaped body 910, the first and second main links 920*a* and 920*b*, and the first and second auxiliary links 950*a* and 950*b* can be integrally formed by an injection molding technique.

The first and second elastic shock-absorbing units 960*a* and 960*b* and the first and second auxiliary arm coupling units 970*a* and 970*b* may have the same shape, and may be formed at the rim-shaped body 910 in a symmetrical fashion. Therefore, the first and second elastic shock-absorbing units 960*a* and 960*b* and the first and second auxiliary arm coupling units 970*a* and 970*b* will not be individually described. Hereinafter, the first elastic shock-absorbing unit 960*a* and the first auxiliary arm coupling unit 970*a* will be described by way of example.

Figure 35:
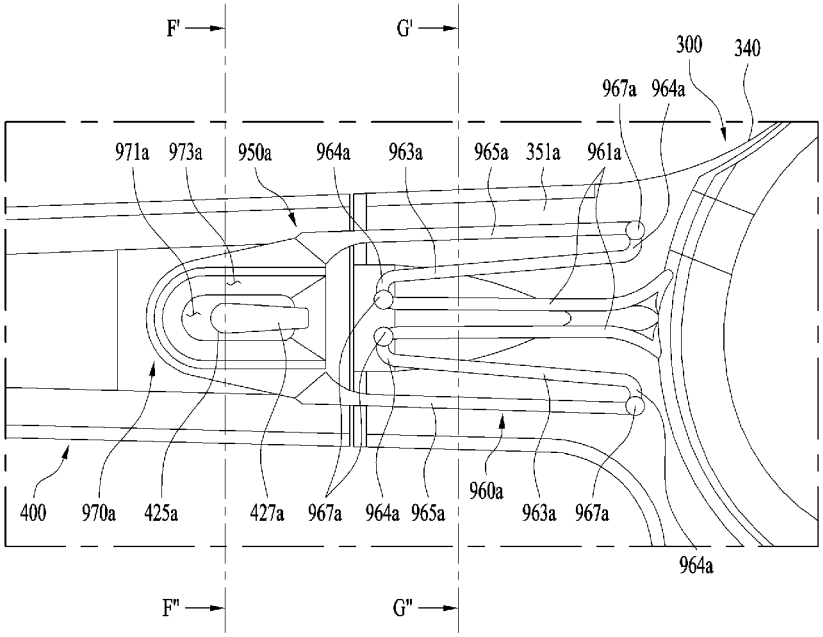
FIGS. 35 to 37 are diagrams illustrating an example first elastic shock-absorption unit and an example first auxiliary arm coupling unit of a link member of a dish washer.
Figure 36:
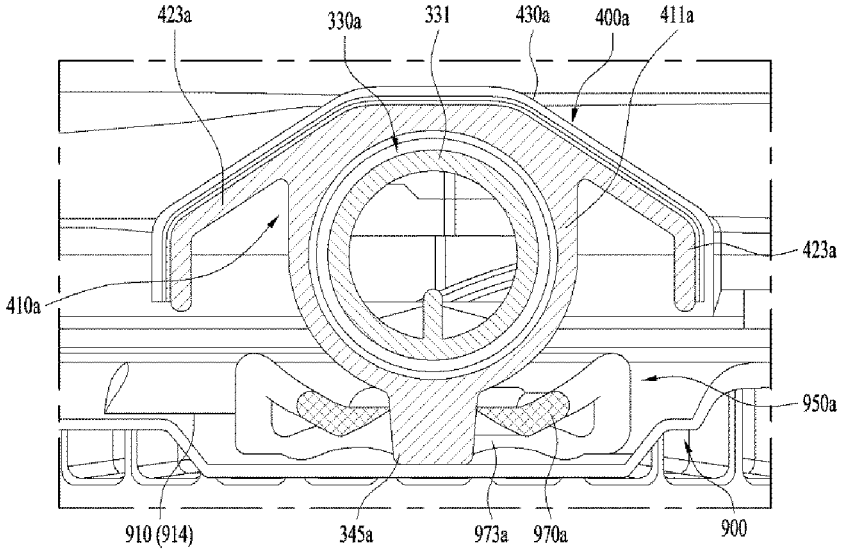

FIGS. 35 to 36 illustrate an example first elastic shock-absorption unit and an example first auxiliary arm coupling unit of a link member of a dish washer.

As shown, the first auxiliary arm coupling unit 970*a* is provided with a first turning slot 971*a* formed in the end of the first auxiliary link 950*a* for allowing the turning protrusion 425*a* formed on the lower part of the first auxiliary arm 400*a* to be inserted thereinto. The first auxiliary arm coupling unit 970*a* is provided on the lower surface thereof adjacent to the first turning slot 971*a* with a first inclined surface 973*a* for securing turning space for the turning slot during rotation of the first auxiliary arm 400*a*.

The upper surface of the first auxiliary arm coupling unit 970*a* at the first turning slot 971*a* is concave in conformity with the shape of the lower part of the first auxiliary arm 400*a*, and opposite sides of the first auxiliary arm coupling unit 970*a* extend upward (see FIG. 36). In some implementations, wash water and foreign matter introduced to the upper part of the first auxiliary arm coupling unit 970*a* move from the opposite sides of the first auxiliary arm coupling unit 970*a* to the first turning slot 971*a* along the shape of the upper part of the first auxiliary arm coupling unit 970*a*, and are discharged through the first turning slot 971*a*.

In some implementations, the first turning slot 971*a* may have a predetermined length sufficient to allow the turning protrusion 425*a* formed at the first auxiliary arm 400*a* to be inserted thereinto. The length of the first turning slot 971*a* may be greater than at least the length of the separation prevention protrusion 427*a* formed at the turning protrusion 425*a*. In addition, the first turning slot 971*a* may have a width sufficient to prevent interference between the turning protrusion 425*a* and the first turning slot 971*a* when the link member 900 is reciprocated to rotate the first auxiliary arm 400*a*.

In addition, the first auxiliary arm coupling unit 970*a* may be located at a position at which, when the turning protrusion 425*a* of the first auxiliary arm 400*a* is inserted into the first turning slot 971*a* formed in the first auxiliary arm coupling unit 970*a*, the first turning slot 971*a* and the turning protrusion 425*a* do not directly contact each other or have minimum contact force therebetween.

That is, the first turning slot 971*a* of the first auxiliary arm coupling unit 970*a* applies pressure to the turning protrusion 425*a* when the link member 900 is reciprocated to rotate the first auxiliary arm 400*a*, with the result that the turning protrusion 425*a* or the first turning slot 971*a* may become worn. In order to prevent wear of the first turning slot 971*a* and the turning protrusion 425*a*, therefore, the contact force between the first turning slot 971*a* and the turning protrusion 425*a* is minimized.

In some implementations, the first elastic shock-absorbing unit 960*a* may include a pair of first extension links 961*a* extending from the downward reinforcement rib 914 of the rim-shaped body 910 toward the middle of the first auxiliary arm connection unit 330*a*, a pair of second extension links 965*a* extending from the outside of the first auxiliary arm connection unit 330*a* toward the outsides of the first extension links 961*a* while being spaced apart from each other by a predetermined distance, and elastic links 963*a* for connecting the ends of the first extension links 961*a* with the ends of the second extension links 965*a* outside the first extension links 961*a* and inside the second extension links 965*a*.

The first extension links 961*a* may be formed such that the sectional area of the first extension links 961*a* is gradually reduced as the first extension links 961*a* extend from the downward reinforcement rib 914. The first extension links 961*a* may be symmetrical with respect to the middle between the first extension links 961*a*.

The reason for this is that it is necessary to provide the first extension links 961*a* with predetermined elastic force, to transfer kinematic force based on the reciprocation of the rim-shaped body 910 to the first auxiliary arm connection unit 330*a* as the rim-shaped body 910 is reciprocated according to the rotation of the eccentric gear unit 800, and to maintain the strength of the rim-shaped body 910. That is, the first extension links 961*a* are formed in a symmetrical fashion in order to maintain the strength of the rim-shaped body 910 depending on the movement direction of the rim-shaped body 910 based on the reciprocation thereof.

In some implementations, the second extension links 965*a* extend from the first auxiliary arm connection unit 330*a* to the rim-shaped body 910 outside the first extension links 961*a* while being spaced apart from each other by a predetermined distance. The second extension links 965*a* may be formed in the shape of a bar in which the sectional area of the second extension links 965*a* is gradually increased as the second extension links 965*a* extend from the first auxiliary arm connection unit 330*a* to the rim-shaped body 910. The second extension links 965*a* may be symmetrical with respect to the middle between the first extension links 961*a*.

In some implementations, the elastic links 963*a* may connect the ends of the first extension links 961*a* with the ends of the second extension links 965*a*, and may exhibit elastic force in directions parallel to and perpendicular to the reciprocation direction of the first auxiliary arm connection unit 330*a*.

That is, the first and second extension links 961*a* and 965*a* extend parallel to each other, thereby exhibiting elastic force with respect to kinematic force in a direction perpendicular to the direction in which the first and second extension links 961*a* and 965*a* are formed. However, the first and second extension links 961*a* and 965*a* cannot exhibit elastic force with respect to kinematic force in a direction parallel to the direction in which the first and second extension links 961*a* and 965*a* are formed.

The elastic links 963*a* connect the ends of the first and second extension links 961*a* and 965*a* so as to be inclined at a predetermined angle, thereby exhibiting elastic force in a different direction which the first and second extension links 961*a* and 965*a* cannot exhibit.

Each of the elastic links 963*a* may be provided with curved parts 964*a* formed at one side thereof connected to a corresponding one of the first extension links 961*a* and the other side thereof connected to a corresponding one of the second extension links 965*a* so as to be curved in opposite directions. The curved parts 964*a* increase the directivity of elastic force that can be exhibited by the elastic links 963*a*.

In some implementations, contact points of the first extension links 961*a*, the second extension links 965*a*, and the elastic links 963*a* may be damaged due to stress concentration when elastic force is repeatedly applied to the links. In order to prevent damage to the contact points of the first extension links 961*a*, the second extension links 965*a*, and the elastic links 963*a* due to stress concentration, therefore, link reinforcement parts 967*a* may be further provided at the contact points. The link reinforcement parts 967*a* may be formed in the shape of a cylinder which the ends of the links contact in the longitudinal direction of the outer circumferential surface thereof.

Figure 37:
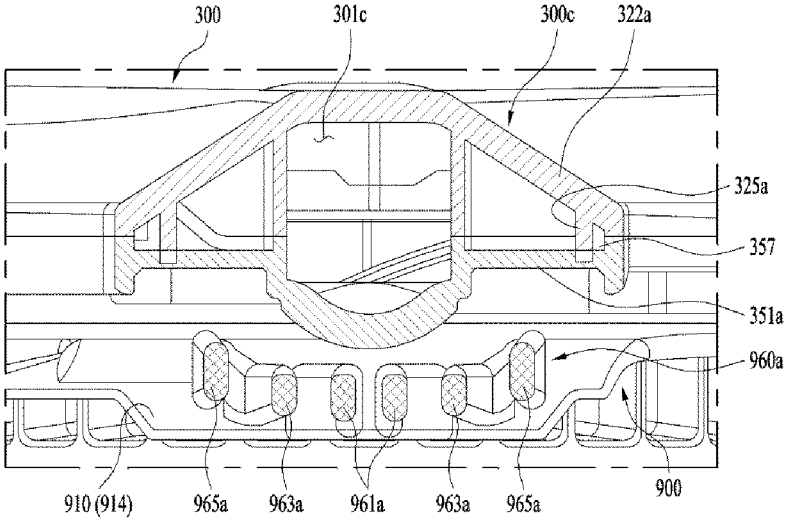

FIG. 37 illustrates an example first elastic shock-absorption unit and an example first auxiliary arm coupling unit of a link member of a dish washer.

As shown in FIG. 37, the horizontal widths of the sectional shapes of the first extension links 961*a*, the second extension links 965*a*, and the elastic links 963*a* may be less than the vertical widths of the sectional shapes of the first extension links 961*a*, the second extension links 965*a*, and the elastic links 963*a* in order to discharge wash water and foreign matter introduced to the upper part of the first elastic shock-absorbing unit 960*a*. That is, in the case in which the horizontal widths of the sectional shapes of the first extension links 961*a*, the second extension links 965*a*, and the elastic links 963*a* are greater than the vertical widths of the sectional shapes of the first extension links 961*a*, the second extension links 965*a*, and the elastic links 963*a*, the possibility of the wash water and foreign matter remaining on the upper parts of the first extension links 961*a*, the second extension links 965*a*, and the elastic links 963*a* may be increased.

In addition, in the case in which the horizontal widths of the sectional shapes of the first extension links 961*a*, the second extension links 965*a*, and the elastic links 963*a* are less than the vertical widths of the sectional shapes of the first extension links 961*a*, the second extension links 965*a*, and the elastic links 963*a*, the shock absorption of the first elastic shock-absorbing unit 960*a* may be improved. That is, in the case in which the sectional shapes of the first extension links 961*a*, the second extension links 965*a*, and the elastic links 963*a* are formed, as described above, these links are perpendicular to the reciprocation direction of the link member 900, thereby effectively exhibiting elastic force with respect to the movement direction of the link member 900.

In addition, the elastic force of the first elastic shock-absorbing unit 960*a* may be changed depending on the material, the shape, etc. of the first extension links 961*a*, the second extension links 965*a*, and the elastic links 963*a*. That is, the first extension links 961*a*, the second extension links 965*a*, and the elastic links 963*a* may be made of materials having different elastic strains to adjust the elastic force of the first elastic shock-absorbing unit 960*a*. Alternatively, the thicknesses, the lengths, the widths, etc. of the first extension links 961*a*, the second extension links 965*a*, and the elastic links 963*a* may be changed to adjust the elastic force of the first elastic shock-absorbing unit 960*a*. Further alternatively, the angles and shapes of the elastic links 963*a* connecting the first extension links 961*a* with the second extension links 965*a* may be changed to adjust the elastic force of the first elastic shock-absorbing unit 960*a*.

In some implementations, the range in which the first elastic shock-absorbing unit 960*a* is elastically deformed may be set depending on the distances between the first extension links 961*a*, the second extension links 965*a*, and the elastic links 963*a*. That is, in the case in which the distances between the first extension links 961*a*, the second extension links 965*a*, and the elastic links 963*a* are increased, the range in which the first elastic shock-absorbing unit 960*a* is elastically deformed may be increased. In the case in which the distances between the first extension links 961*a*, the second extension links 965*a*, and the elastic links 963*a* are decreased, the range in which the first elastic shock-absorbing unit 960*a* is elastically deformed may be decreased.

In addition, the first extension links 961*a*, the second extension links 965*a*, and the elastic links 963*a* may be formed so as to have different heights and different vertical widths in response to the shape of the lower surface of the first extension unit 300*c*, on which the first elastic shock-absorbing unit 960*a* is positioned.

In some implementations, the elastic force of the first elastic shock-absorbing unit 960*a* must satisfy minimum elastic force that is capable of rotating the first auxiliary arm 400*a* by transferring kinematic force of the link member 900, by which the link member 900 will be reciprocated according to the rotation of the eccentric gear unit 800, to the first auxiliary arm 400*a* and elastic force that is capable of performing shock absorption without transferring the kinematic force of the link member 900 to the first auxiliary arm 400*a* when the rotation of the first auxiliary arm 400*a* is restricted.

In some implementations, the rotation of the first auxiliary arm 400*a* may be restricted for some reason, such as the accumulation of foreign matter. In this case, the operation of the link member 900, the eccentric gear unit 800, the spray arm 20, and the stationary gear unit 500, which transfer power to the first auxiliary arm 400*a*, may be successively restricted by the first auxiliary arm 400*a*, the rotation of which is restricted.

That is, when the rotation of the first auxiliary arm 400*a* is restricted, the reciprocation of the link member 900, which rotates the first auxiliary arm 400*a*, is restricted by the first auxiliary arm 400*a*. As the reciprocation of the link member 900 is restricted, the rotation of the eccentric gear unit 800, which reciprocates the link member 900, is restricted by the link member 900. As the rotation of the eccentric gear unit 800 is restricted, the relative rotation between the eccentric gear unit 800 and the stationary gear unit 500 is restricted. As a result, the rotation of the spray arm 200, to which the eccentric gear unit 800 is coupled, is restricted.

When the rotation of the first auxiliary arm 400*a* is restricted, the first elastic shock-absorbing unit 960*a* of the first auxiliary link 950*a* may absorb the force transferred from the link member 900 using predetermined elastic force such that the link member 900 can be reciprocated. Even when the rotation of the first auxiliary arm 400*a* is restricted, therefore, the link member 900 configured to rotate the first auxiliary arm 400*a* may be reciprocated, whereby the link member 900, the eccentric gear unit 800, the spray arm 20, and the stationary gear unit 500, which transfer power to the first auxiliary arm 400*a*, may be driven.

Hereinafter, the installation state of the link member 900 will be described in detail with reference to the accompanying drawings.

Figure 38:
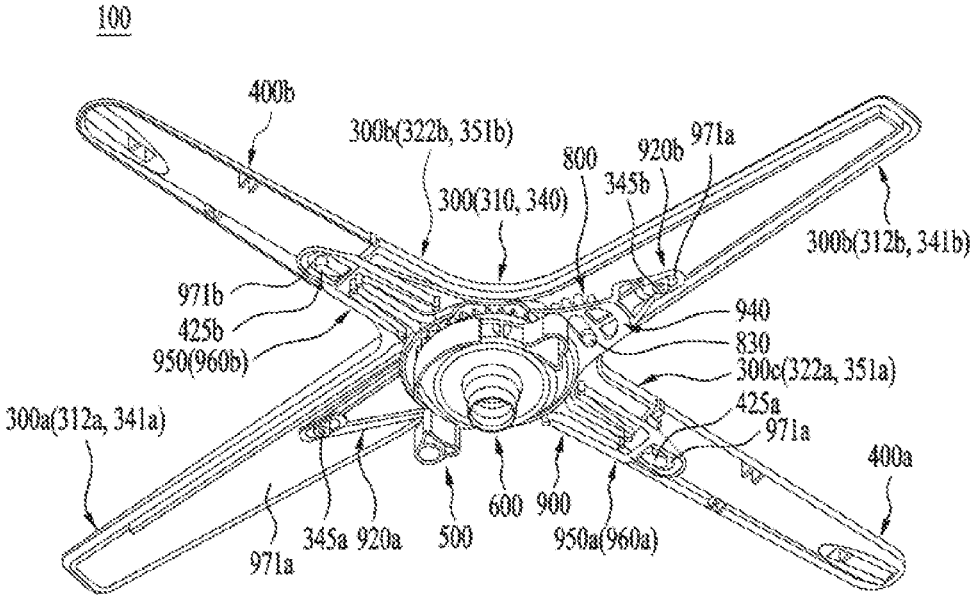
FIG. 38 is a diagram illustrating an example coupling state of a link member of a dishwasher.

FIG. 38 illustrates an example coupling state of a link member of a dishwasher.

As shown in FIGS. 38, 2, and 3, the first auxiliary arm 400*a* and the second auxiliary arm 400*b* may be coupled respectively to the first extension unit 300*c* and the second extension unit 300*d* of the main arm 300, and the eccentric gear unit 800 may be inserted into the gear shaft 347*b* formed at the second main arm 300*b* of the spray arm 200.

The spray arm holder coupling part 356 of the main arm lower housing 340 is movably coupled into the rectangular hole of the rim-shaped body 910 of the link member 900. The first and second main links 920*a* and 920*b* of the link member 900 are movably coupled to the first and second guide protrusions 345*a* and 345*b* of the first and second main arms 300*a* and 300*b*, and the first and second auxiliary links 950*a* and 950*b* are coupled to the turning protrusions of the first and second auxiliary arms 400*a* and 400*b*.

First, the turning protrusion 425*a* of the first auxiliary arm 400*a* is movably inserted into the first turning slot 971*a* of the first auxiliary link 950*a*. At this time, the first elastic shock-absorbing unit 960*a* formed at the first auxiliary link 950*a* is bent a predetermined distance while being tensioned by the elastic force thereof such that the separation prevention protrusion 427*a* formed at the turning protrusion 425*a* can be inserted into the first turning slot 971*a* of the first auxiliary link 950*a*. After the insertion of the separation prevention protrusion 427*a*, the first elastic shock-absorbing unit 960*a* returns to the original state thereof, whereby the turning protrusion 425*a* is held in the first turning slot 971*a*.

The turning protrusion 425*a* of the second auxiliary arm 400*b* is movably inserted into the second turning slot 971*b* of the second auxiliary link 950*b*. At this time, the second elastic shock-absorbing unit 960*b* formed at the second auxiliary link 950*b* is bent a predetermined distance while being tensioned by the elastic force thereof such that the separation prevention protrusion 427*b* formed at the turning protrusion 425*a* can be inserted into the second turning slot 971*b* of the second auxiliary link 950*b*. After the insertion of the separation prevention protrusion 427*b*, the second elastic shock-absorbing unit 960*b* returns to the original state thereof, whereby the turning protrusion 425*a* is held in the second turning slot 971*b*.

In some implementations, the first guide protrusion 345*a* of the first main arm 300*a* is movably inserted into a guide recess, e.g., the first moving slot 929*a* of the first main link 920*a*. The first extension step 346*a* formed at the first guide protrusion 345*a* is fitted into the first moving slot 929*a* in an interference fitting fashion. Consequently, the first guide protrusion 345*a* is movably inserted into the first moving slot 929*a*, and is prevented from being separated from the first moving slot 929*a* by the first extension step 346*a*.

In addition, the second guide protrusion 345*b* of the second main arm 300*b* is movably inserted into the second moving slot 939*b* of the second main link 920*b*. The second extension step 346*b* formed at the second guide protrusion 345*b* is fitted into the second moving slot 939*b* in an interference fitting fashion. Consequently, the second guide protrusion 345*b* is movably inserted into the second moving slot 939*b*, and is prevented from being separated from the second moving slot 939*b* by the second extension step 346*b*.

At this time, the eccentric gear unit 800, rotatably coupled to the gear shaft 347*b* of the second main arm 300*b*, is supported by the eccentric gear receiving part 940 of the second main link 920*b*. In addition, the eccentric protrusion 830 of the eccentric gear unit 800 is inserted into the eccentric protrusion insertion slot 945 formed in the eccentric gear receiving part 940 of the second main link 920*b*.

Next, the stationary gear unit 500 is further coupled to the spray arm holder coupling part 356. The stationary gear unit 500 is mounted so as to surround the circumference of the spray arm holder coupling part 356. That is, the spray arm holder coupling part 356 is inserted into the rim part 510 of the stationary gear unit 500. At this time, the first gear teeth 512 of the stationary gear unit 500 are engaged with the second gear teeth 812 of the eccentric gear unit 800.

Next, the spray arm holder 600 is further coupled to the spray arm 200. The spray arm holder 600 is inserted into the spray arm holder coupling part 356, and is then rotated by a predetermined angle. As a result, the catching protrusions 622*a* of the spray arm holder 600 are held by the spray arm holder coupling protrusions 356*a* of the spray arm holder coupling part 356, whereby the spray arm holder 600 is fixed to the spray arm holder coupling part 356.

Subsequently, the sump insertion unit 630 of the spray arm holder 600 is inserted into the spray arm holder location unit 53, and the fastening parts 530 of the stationary gear unit 500 are coupled to the coupling bosses 51 of the sump cover 50, whereby the installation of the spray arm 200 is completed.

Hereinafter, the reciprocating rotation of the first and second auxiliary arms 400*a* and 400*b* in response to the reciprocation of the link member 900 will be described with reference to the accompanying drawings.

Figure 39:
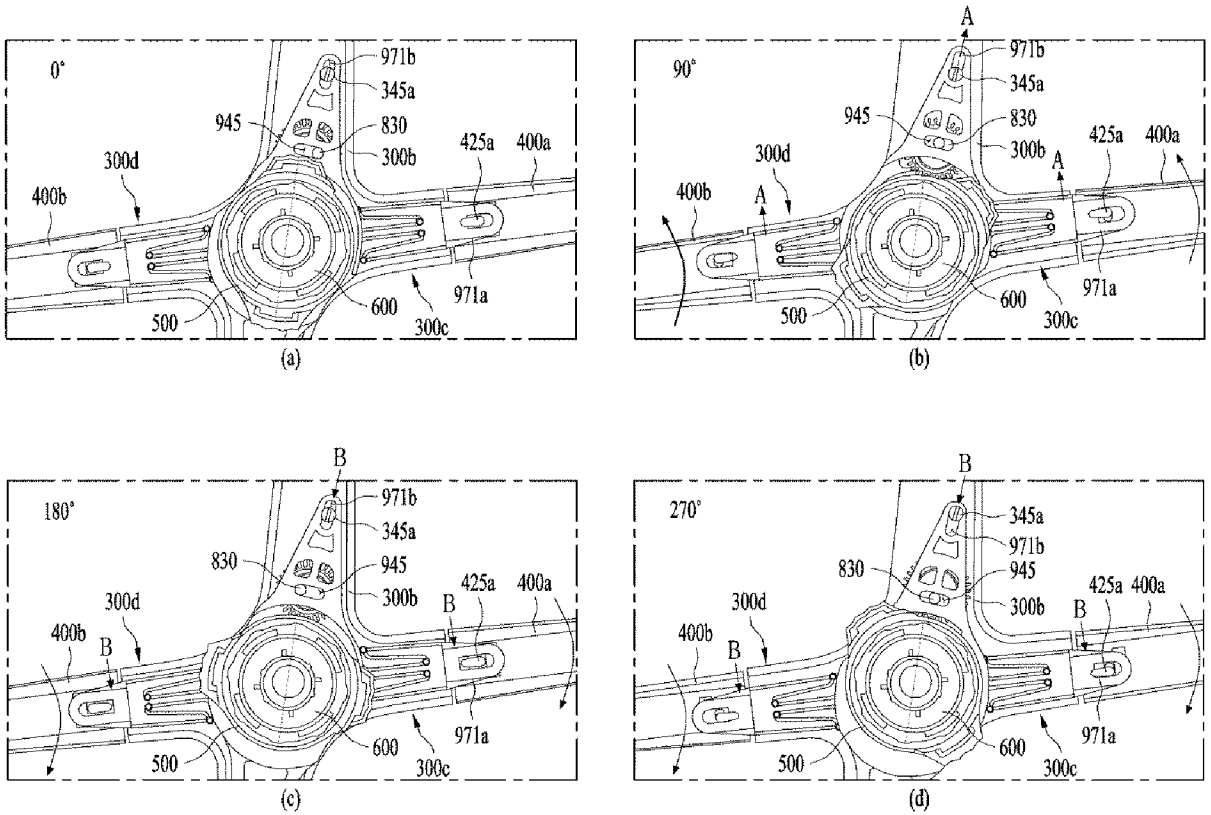
FIG. 39 is a diagram illustrating an example operation of a link member of a dishwasher.
Figure 40:
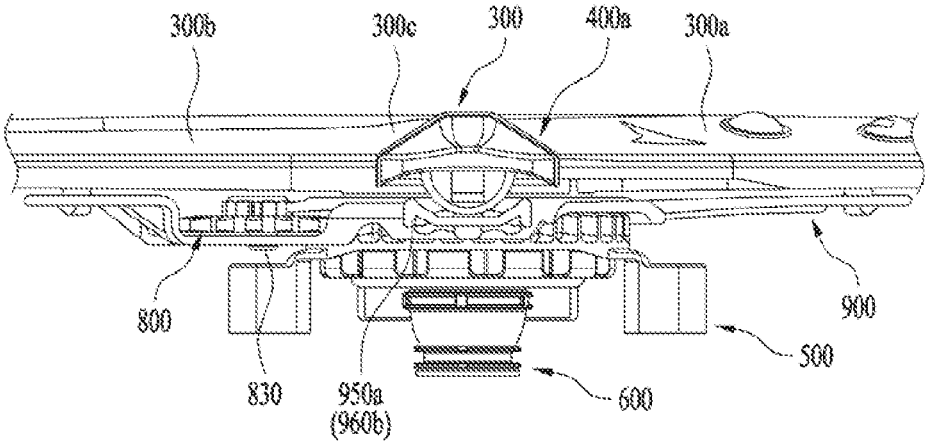
FIG. 40 is a diagram illustrating an example operation of an auxiliary arm of a dishwasher.
Figure 40:
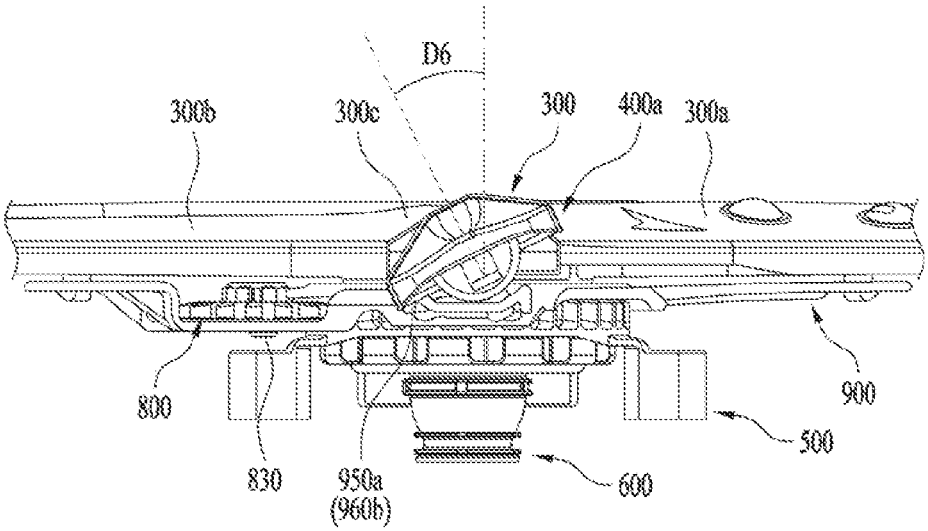

FIG. 39 illustrates an example operation of a link member of a dishwasher. FIG. 40 illustrates an example operation of an auxiliary arm of a dishwasher.

In FIG. 39, the examples (a) to (d) respectively show the lower surface of the spray arm assembly 100 when the eccentric gear unit 800 is rotated by 0, 90, 180, and 270 degrees. In FIG. 40, the example (a) shows the state in which the first auxiliary arm is not rotated and the example (b) shows the state in which the first auxiliary arm is rotated.

Referring to FIGS. 39 and 40, the eccentric protrusion 830 is located in one side of the eccentric protrusion insertion slot 945 in an initial state, in which the eccentric gear unit 800 is not rotated. At this time, the first auxiliary arm 400*a* is disposed parallel to the main arm 300. When wash water is supplied to the spray arm 200, the rotation of the spray arm 200 is started by the wash water sprayed through the first and second main arms 300*a* and 300*b* or the first and second auxiliary arms 400*a* and 400*b*.

As the spray arm 200 is rotated, the eccentric gear unit 800 provided at the spray arm 200 is engaged with the stationary gear unit 500 fixed to the sump cover 50 so as to rotate and revolve along the outer circumferential surface of the stationary gear unit 500.

Referring to the example (b) in FIG. 39 and the example (b) in FIG. 40, when the eccentric gear unit 800 is rotated 90 degrees in the counterclockwise direction according to the rotation of the spray arm 200, the eccentric protrusion 830 inserted into the eccentric protrusion insertion slot 945 of the link member 900 moves to one side of the eccentric protrusion insertion slot 945 to move the link member 900 in a direction A.

As the link member 900 is moved in one direction A, the first and second main links 920*a* and 920*b* are moved while being guided by the first and second guide protrusions 345*a* and 345*b* formed at the first and second main arms 300*a* and

300*b*, and the first auxiliary link 950*a* rotates the turning protrusion 425*a* of the first and second auxiliary arms 400*a* and 400*b* in one direction.

As a result, the first and second auxiliary arms 400*a* and 400*b* are rotated by a predetermined angle in the clockwise direction. The first and second auxiliary arms 400*a* and 400*b* may be rotated within an angular range of about 15 to 40 degrees.

Referring to the example (c), when the eccentric gear unit 800 is further rotated by 90 degrees in the counterclockwise direction as the spray arm 200 is further rotated, the eccentric protrusion 830 inserted into the eccentric protrusion insertion slot 945 of the link member 900 moves to the other side of the eccentric protrusion insertion slot 945 to move the link member 900 in a direction B, which is opposite the direction A. As a result, the link member 900 is returned to a position shown in FIGS. 39(*a*) and 40(*a*). At the same time, the first and second auxiliary arms 400*a* and 400*b* are rotated in the counterclockwise direction by the first and second extension units 300*c* and 300*d* and are returned to the original positions thereof.

Referring to the example (d), when the eccentric gear unit 800 is further rotated by 90 degrees in the counterclockwise direction as the spray arm 200 is further rotated, the link member 900 is moved in the direction B by the eccentric protrusion 830.

At this time, the first auxiliary arm 400*a* is rotated by a predetermined angle in the counterclockwise direction (i.e. in the direction opposite the direction shown in FIG. 40(*b*)). The first and second auxiliary arms 400*a* and 400*b* may be rotated within an angular range of about 15 to 40 degrees.

In some implementations, the first auxiliary arm 400*a* and the second auxiliary arm 400*b* may be simultaneously rotated by the same angle. The link member 900 may be reciprocated by the distance between the center of rotation of the eccentric gear unit 800 and the eccentric protrusion 830 in response to the rotation of the eccentric gear unit 800.

Hereinafter, the principle by which the spray arm 200 is rotated by wash water sprayed through the first and second main arms 300*a* and 300*b* and the first and second auxiliary arms 400*a* and 400*b* will be described.

Figure 41:
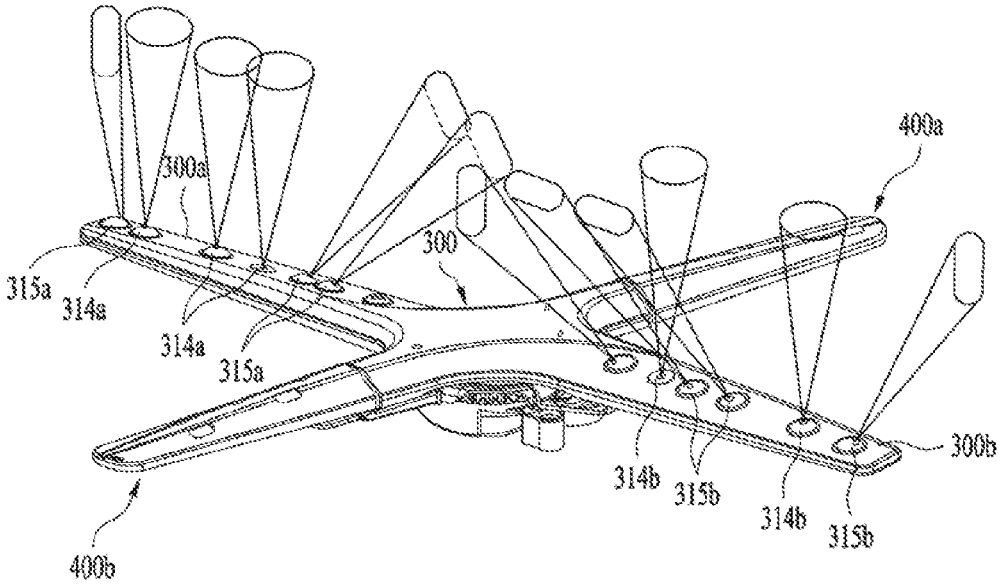
FIGS. 41 and 42 are diagrams illustrating an example operation of a spray arm of a dishwasher.
Figure 42:
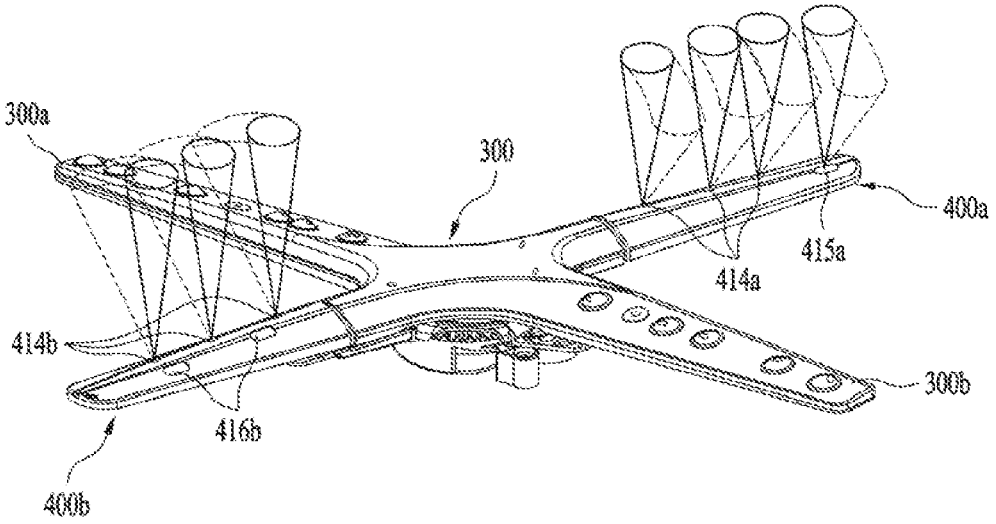
Figure 43:
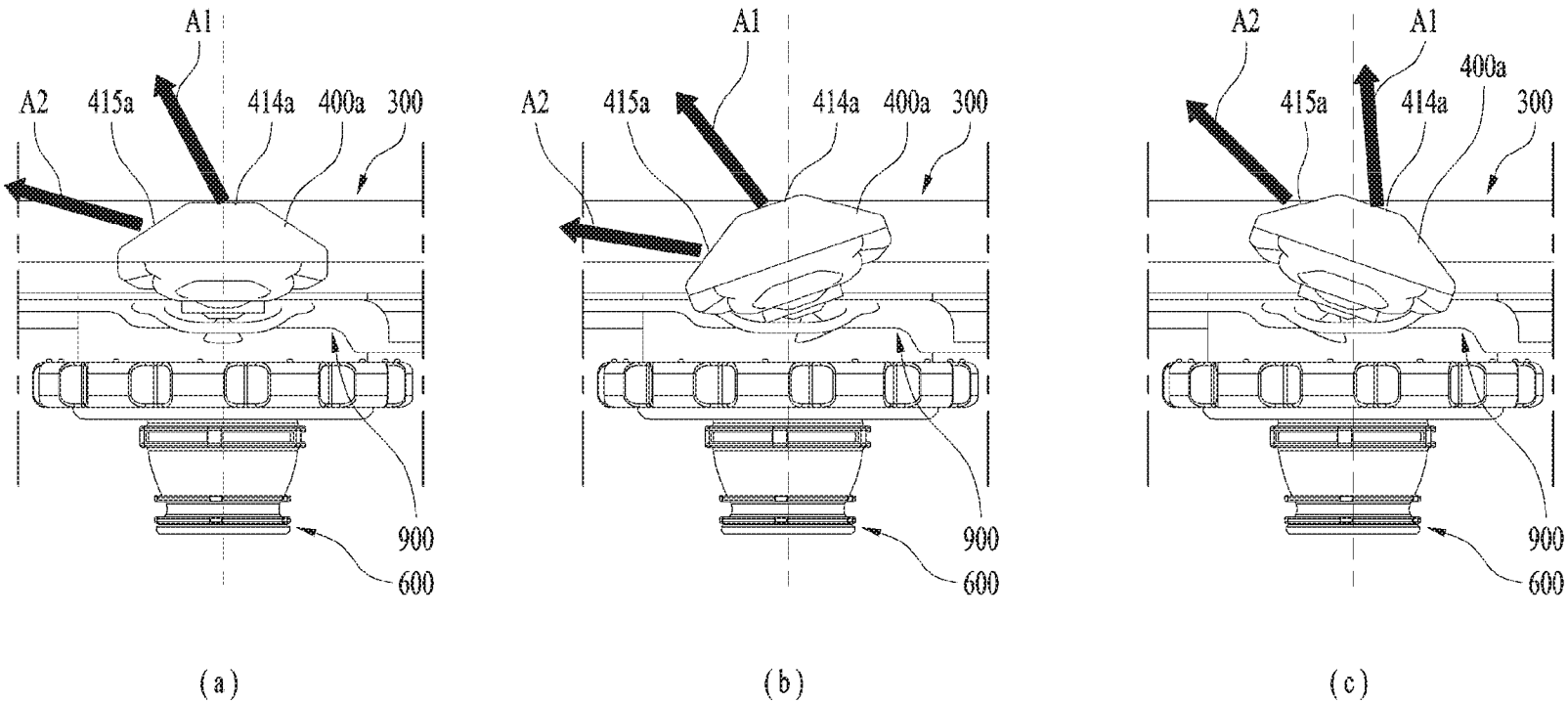
FIG. 43 is a diagram illustrating an example spray operation of an auxiliary arm of a dishwasher.

FIGS. 41 and 42 illustrate an example operation of a spray arm of a dishwasher. FIG. 43 illustrates an example spray operation of an auxiliary arm of a dishwasher.

FIG. 41 shows the state in which wash water is sprayed through the first and second main arms 300*a* and 300*b*, and FIG. 42 shows the state in which wash water is sprayed through the first and second auxiliary arms 400*a* and 400*b*.

As shown in FIG. 41, the first and second main arms 300*a* and 300*b* include a plurality of first and second spray ports 314*a* and 314*b* and a plurality of first and second inclined spray ports 315*a* and 315*b*. Specifically, the first main arm 300*a* may include a plurality of first spray ports 314*a* and a plurality of first inclined spray ports 315*a*. In addition, the second main arm 300*b* may include a plurality of second spray ports 314*b* and a plurality of second inclined spray ports 315*b*. When the first and second main channel inlets 354*a* and 354*b* are opened by the channel-switching unit 700, wash water may be sprayed simultaneously through the first and second spray ports 314*a* and 314*b* and the first and second inclined spray ports 315*a* and 315*b*.

The direction in which the wash water is sprayed through the first and second inclined spray ports 315*a* and 315*b* is opposite the direction in which the first and second main arms 300*a* and 300*b* are rotated. The wash water sprayed through the first and second inclined spray ports 315*a* and 315*b* may be deviated so as to form an acute angle with respect to the rotational plane of the first and second main arms 300*a* and 300*b*.

Consequently, the main arm 300 may be rotated by thrust force generated by the wash water sprayed through the deviated first and second inclined spray ports 315*a* and 315*b*. That is, a predetermined torque value that is capable of rotating the spray arm 200 may be generated as the wash water is sprayed through the first and second inclined spray ports 315*a* and 315*b*.

In some implementations, torque applied to the spray arm 200 by the wash water sprayed through the first inclined spray ports 315*a* of the first main arm 300*a* and torque applied to the spray arm 200 by the wash water sprayed through the second inclined spray ports 315*b* of the second main arm 300*b* have the same directivity based on the center of rotation of the spray arm 200.

In some implementations, at least one selected from between the first inclined spray ports 315*a* and the second inclined spray ports 315*b* may be deviated so as to spray wash water in a tangential direction of the rotational track of the spray arm 200. In this case, rotational force due to the spray of wash water may be further increased.

The first spray ports 314*a* and the second spray ports 314*b* may spray wash water in the direction perpendicular to the spray arm 200, or may have the same directivity as the first and second inclined spray ports 315*a* and 315*b*. The first and second spray ports 314*a* and 314*b* and the first and second inclined spray ports 315*a* and 315*b* may be deviated at different angles so as to spray wash water at various angles. In addition, the first and second spray ports 314*a* and 314*b* and the first and second inclined spray ports 315*a* and 315*b* are spaced apart from the center of rotation of the spray arm 200 by different distances so as to have spray regions that do not overlap each other.

As shown in FIG. 42, the first and second auxiliary arms 400*a* and 400*b* include a plurality of first and second auxiliary spray ports 414*a* and 414*b* and a plurality of first and second auxiliary inclined spray ports 415*a* and 415*b*. Specifically, the first auxiliary arm 400*a* may include a plurality of first auxiliary spray ports 414*a* and a plurality of first auxiliary inclined spray ports 415*a*. In addition, the second auxiliary arm 400*b* may include a plurality of second auxiliary spray ports 414*b* and a plurality of second auxiliary inclined spray ports 415*b*. When the first and second extension channel inlets 354*c* and 354*d* are opened by the channel-switching unit 700, wash water may be sprayed simultaneously through the first and second auxiliary spray ports 414*a* and 414*b* and the first and second auxiliary inclined spray ports 415*a* and 415*b*.

The direction in which the wash water is sprayed through the first and second auxiliary inclined spray ports 415*a* and 415*b* is opposite the direction in which the first and second auxiliary arms 400*a* and 400*b* are rotated. The wash water sprayed through the first and second auxiliary inclined spray ports 415*a* and 415*b* may be deviated so as to form an acute angle with respect to the rotational plane of the first and second auxiliary arms 400*a* and 400*b*.

Consequently, the main arm 300 may be rotated by thrust force generated by the wash water sprayed through the deviated first and second auxiliary inclined spray ports 415*a* and 415*b*. That is, a predetermined torque value that is capable of rotating the spray arm 200 may be generated as the wash water is sprayed through the first and second auxiliary inclined spray ports 415*a* and 415*b*.

In some implementations, the first auxiliary arm 400*a* and the second auxiliary arm 400*b* are rotated in the same direction. Consequently, the magnitude and direction of torque generated by the wash water sprayed through the first and second auxiliary spray ports 414*a* and 414*b* and the first and second auxiliary inclined spray ports 415*a* and 415*b* may be changed.

Hereinafter, the direction in which wash water is sprayed through the first and second auxiliary spray ports 414*a* and 414*b* and the first and second auxiliary inclined spray ports 415*a* and 415*b* of the first and second auxiliary arms 400*a* and 400*b* will be described. The first and second auxiliary arms 400*a* and 400*b* are rotated in the same direction and form torque in the same direction. Therefore, the first auxiliary arm 400*a* will be described by way of example, and a detailed description of the second auxiliary arm 400*b* will be omitted.

FIG. 43 illustrates an example spray operation of an auxiliary arm of a dishwasher In FIG. 43, the example (a) shows the state in which the first auxiliary arm 400*a* is not rotated, the example (b) shows the state in which the first auxiliary arm 400*a* has been maximally rotated in the clockwise direction, and the example (c) shows the state in which the first auxiliary arm 400*a* has been maximally rotated in the counterclockwise direction.

Referring to the example (a), wash water is sprayed simultaneously through the first auxiliary spray ports 414*a* and the first auxiliary inclined spray ports 415*a*. The direction A1 in which the wash water is sprayed through the first auxiliary spray ports 414*a* and the direction A2 in which the wash water is sprayed through the first auxiliary inclined spray ports 415*a* may be the leftward and upward direction in the figure.

In addition, the directions A1 and A2 in which the wash water is sprayed through the first auxiliary spray ports 414*a* and the first auxiliary inclined spray ports 415*a* may form an acute angle with respect to the rotational plane of the spray arm 200. Consequently, rotational torque may be applied to the first auxiliary arm 400*a* in the direction in which the spray arm 200 is rotated by the wash water sprayed through the first auxiliary spray ports 414*a* and the first auxiliary inclined spray ports 415*a*.

Referring to the example (b), the directions A1 and A2 in which the wash water is sprayed through the first auxiliary spray ports 414*a* and the first auxiliary inclined spray ports 415*a* may be opposite the direction in which the spray arm 200 is rotated even in the case in which the first auxiliary arm 400*a* has been maximally rotated in one direction. Consequently, rotational torque may be applied to the first auxiliary arm 400*a* in the direction in which the spray arm 200 is rotated even in the case in which the first auxiliary arm 400*a* has been rotated in the clockwise direction.

Referring to the example (c), the directions A1 and A2 in which the wash water is sprayed through the first auxiliary spray ports 414*a* and the first auxiliary inclined spray ports 415*a* may be opposite the direction in which the spray arm 200 is rotated even in the case in which the first auxiliary arm 400*a* has been maximally rotated in the other direction. Consequently, torque may be applied to the first auxiliary arm 400*a* in the direction in which the spray arm 200 is rotated even in the case in which the first auxiliary arm 400*a* has been rotated in the other direction.

However, the direction A1 in which the wash water is sprayed through the first auxiliary spray ports 414*a* may be the vertically upward direction of the spray arm 200 when the first auxiliary arm 400*a* has been maximally rotated in the other direction. In this case, the direction of torque applied to the spray arm 200 may be changed, which may become an issue.

Consequently, the rotational angle of the first auxiliary arm 400*a* must be smaller than the spray angle of the first auxiliary spray ports 414*a*. The spray angle of the first auxiliary spray ports 414*a* is the angle between the direction A1 in which the wash water is sprayed through the first auxiliary spray ports 414*a* and the vertical line passing through the first auxiliary arm 400*a* in the state in which the first auxiliary arm 400*a* is not rotated.

In addition, the rotational angle of the first auxiliary arm 400*a* must be smaller than the spray angle of the first auxiliary inclined spray ports 415*a*. The spray angle of the first auxiliary inclined spray ports 415*a* is the angle between the direction A2 in which the wash water is sprayed through the first auxiliary inclined spray ports 415*a* and the vertical line passing through the first auxiliary arm 400*a* in the state in which the first auxiliary arm 400*a* is not rotated.

Even when the first auxiliary arm 400*a* has been maximally rotated in opposite directions, therefore, the direction A1 in which the wash water is sprayed through the first auxiliary spray ports 414*a* and the direction A2 in which the wash water is sprayed through the first auxiliary inclined spray ports 415*a* may be opposite the direction in which the spray arm 200 is rotated, whereby rotational torque may be applied to the first auxiliary arm 400*a* in the direction in which the spray arm 200 is rotated.

In the dishwasher 1, the first and second auxiliary arms 400*a* and 400*b* are rotatably mounted at the main arm 300 such that the first and second auxiliary arms 400*a* and 400*b* can be rotated in a reciprocating fashion irrespective of the rotation of the main arm 300, as described above, whereby the spray angle may be varied. Consequently, the washing efficiency of the dishwasher 1 is improved.

In addition, since the first and second auxiliary arms 400*a* and 400*b* as well as the main arm 300 can be rotated by thrust force generated by spraying wash water, no additional driving source is needed.

In addition, the rotational force of the spray arm 200 may be converted into force necessary to rotate the first and second auxiliary arms 400*a* and 400*b* in a reciprocating fashion through interaction between the stationary gear unit 500, the eccentric gear unit 800, and the link member 900. Consequently, an additional driving source for rotating the first and second auxiliary arms 400*a* and 400*b* is not needed.

What is claimed is:

1. A dishwasher comprising:

a washing tub that includes an interior space to accommodate objects;

a main arm that is coupled to the washing tub, that extends in a first direction, and that is configured to rotate in the interior space and spray water to the objects;

an auxiliary arm that is coupled to the main arm, that extends in a second direction, and that is configured to rotate in the interior space and spray water to the objects;

a stationary gear unit that is coupled to the washing tub, that is configured to rotatably support the main arm, and that includes a plurality of gear teeth;

an eccentric gear unit that is coupled to the main arm and that is configured to rotate based on rotation of the main arm, the eccentric gear unit being in engagement with one or more teeth of the plurality of gear teeth of the stationary gear unit, wherein a rotation center of the eccentric gear unit is offset from a center of the stationary gear unit; and at least one link that is supported by the main arm, that couples the eccentric gear unit to the auxiliary arm, and that is configured to (i) generate elastic force based on rotation of the eccentric gear unit and (ii) rotate the auxiliary arm based on elastic force.

2. The dishwasher of claim 1, wherein the at least one link includes:

a rim-shaped body, a main link that couples the rim-shaped body to the main arm and that extends in the first direction, an auxiliary link that couples the rim-shaped body to the auxiliary arm and that extends in the second direction, wherein the second direction is different from the first direction, and an elastic shock-absorbing unit that is located between the rim-shaped body and the auxiliary link and that is configured to generate elastic force.

3. The dishwasher of claim 2, wherein at least a portion of the elastic shock-absorbing unit extends in the second direction.

4. The dishwasher of claim 2, wherein the auxiliary link includes a first end and a second end, the second end being coupled to the rim-shaped body, and wherein the elastic shock-absorbing unit includes:

a first extension link that extends from the rim-shaped body toward the first end of the auxiliary link, a second extension link that extends from a portion of the auxiliary link toward the second end of the auxiliary link, and an elastic link that couples the first extension link to the second extension link.

5. The dishwasher of claim 4, wherein the elastic shock-absorbing unit further includes:

a plurality of reinforcement parts, each of the plurality of reinforcement parts being (i) coupled to the first extension link, the second extension link, and the elastic link respectively and (ii) configured to protect a point of coupling.

6. The dishwasher of claim 4, wherein each of the first extension link, the second extension link, and the elastic link has a bar shape.

7. The dishwasher of claim 4, wherein at least one of the first extension link, the second extension link, and the elastic link has a curved portion.

8. The dishwasher of claim 7, wherein the curved portion is elastic such that (i) the at least one link is configured to generate elastic force and (ii) rotate the auxiliary arm based on elastic force.

9. The dishwasher of claim 4, wherein at least one of the first extension link, the second extension link, and the elastic link has a bar shape and has a first width in a direction in which the auxiliary link moves.

10. The dishwasher of claim 4, wherein the first extension link, the second extension link, and the elastic link are arranged to establish a particular angle with each other.

11. The dishwasher of claim 2, wherein the at least one link includes an integrated body comprising a first material, and wherein the integrated body includes the rim-shaped body, the auxiliary link, and the elastic shock-absorbing unit.

12. The dishwasher of claim 2, wherein the main arm includes a guide protrusion, and wherein the main link includes a guide recess (i) into which the guide protrusion is inserted and (ii) that is configured to guide the at least one link.

13. The dishwasher of claim 12, wherein the at least one link is configured to move in the first direction along the guide protrusion.

14. The dishwasher of claim 2, wherein the eccentric gear unit includes an eccentric protrusion, and wherein the main link defines an eccentric protrusion insertion slot into which the eccentric protrusion is inserted, the eccentric protrusion insertion slot being configured to guide the at least one link.

15. The dishwasher of claim 14, wherein the at least one link is configured to move linearly between a first position and a second position in the first direction.

16. The dishwasher of claim 1, wherein the at least one link is configured to, based on rotation of the eccentric gear unit, move linearly between a first position and a second position.

17. The dishwasher of claim 16, wherein the auxiliary arm is configured to rotate based on linear movement of the at least one link.

18. The dishwasher of claim 1, wherein the main arm includes:

a first spray port that is located at a first portion of the main arm and that is configured to spray water to the objects in a third direction, and a second spray port that is located at a second portion of the main arm and that is configured to spray water in a fourth direction that is different from the third direction.

19. The dishwasher of claim 1, wherein the auxiliary arm is configured to spray water to a first position in the interior space while the auxiliary arm rotates.

20. The dishwasher of claim 1, wherein the auxiliary arm includes:

a first spray port that is located at a first portion of the auxiliary arm and that is configured to spray water to the objects in a third direction, and a second spray port that is located at a second portion of the auxiliary arm and that is configured to spray water in a fourth direction that is different from the third direction.

* * * * *